US005234807A

United States Patent [19]

Texter et al.

[11] Patent Number: 5,234,807

[45] Date of Patent: Aug. 10, 1993

[54] MICROEMULSION POLYMERIZATION - PROCESSES FOR DISPERSING PHOTOGRAPHICALLY USEFUL COMPONENTS

[75] Inventors: John Texter, Rochester; Tienteh Chen; Edward Schofield, both of Penfield, all of N.Y.

[73] Assignee: Eastman Kodak Company, Rochester, N.Y.

[21] Appl. No.: 796,107

[22] Filed: Nov. 21, 1991

[51] Int. Cl.[5] ..... G03C 1/053

[52] U.S. Cl. ..... 430/627; 430/629; 430/630; 430/631; 430/548; 526/207

[58] Field of Search ..... 430/548, 627, 629, 631, 430/630, 546; 526/207

[56] References Cited

U.S. PATENT DOCUMENTS

| | | | |
|---|---|---|---|
| 4,308,335 | 12/1981 | Yamamoto et al. | 430/213 |
| 4,340,664 | 7/1982 | Monbaliu et al. | 430/449 |
| 4,474,870 | 10/1984 | Yagihara et al. | 430/381 |
| 4,510,238 | 4/1985 | Kingston et al. | 430/627 |
| 4,511,647 | 4/1985 | Hirano et al. | 430/381 |
| 4,521,580 | 6/1985 | Turner et al. | 526/303 |
| 4,544,723 | 10/1985 | Upson et al. | 524/347 |
| 4,681,912 | 7/1987 | Durand et al. | 524/827 |
| 4,756,998 | 7/1988 | Helling | 430/548 |
| 4,933,404 | 6/1990 | Beckman et al. | 526/207 |
| 4,946,771 | 8/1990 | Maekawa et al. | 430/548 |
| 5,017,667 | 5/1991 | Cawse et al. | 526/264 |

FOREIGN PATENT DOCUMENTS

| | | |
|---|---|---|
| 0115213A3 | 8/1984 | European Pat. Off. . |
| 0250767A1 | 1/1988 | European Pat. Off. . |
| 1237673 | 6/1986 | U.S.S.R. . |
| 2161492A | 1/1986 | United Kingdom . |

OTHER PUBLICATIONS

"Microemulsion Polymerization in the Water, Aerosol-OT, Tetrahydrofurfuryl Methacrylate System", Textes et al., Polymers Bulletin 27, 487-494 (1992).

A. S. Dunn, Polymerization in Micelles & Microemulsions, Comprehensive Polymer Science, vol. 4, 1989, pp. 219-224.

F. Candau, Polymerization in Inverse Microemulsions, Comprehensive Polymer Science, vol. 4, 1989, pp. 225-229.

Haque & Qutubuddin, J. Polym. Sci., Part C, Polym. Lett., vol. 26, 1989, pp. 429-432.

Candau et al, J. Colloid Interface Sci., vol. 114, 1986, pp. 398-408.

Stoffer & Bone, J. Dispersion Sci. Technol., vol. 1, 1980, pp. 37-54.

Stoffer & Bone, Journal of Polymer Science:Polymer Chemistry Edition, vol. 18, 1980, pp. 2641-2648.

Chew & Gan, J. Polymer Science:Polymer Chemistry Edition, vol. 23, 1985, pp. 2225-2232.

(List continued on next page.)

*Primary Examiner*—Charles L. Bowers, Jr.
*Assistant Examiner*—John A. McPherson
*Attorney, Agent, or Firm*—Paul A. Leipold

[57] ABSTRACT

The polymerization and copolymerization of photographically useful vinyl monomers can be effected by dissolving such monomers in an isotropic oil-in-water microemulsion or in an isotropic water-in-oil microemulsion, each comprising monomers or comonomers, surfactants and/or cosurfactants, water, and optionally electrolytes. The microemulsion may be characterized as transparent or nearly transparent to the eye at 1% (w/w) or greater monomer, ultrafine in particle (droplet) size (typically in the range of 30 to 900 Å in diameter), and spontaneously formed upon combining all the components with moderate stirring. The polymerization process is subsequently initiated with free radical initiators or with ultraviolet light. The components are chosen so that photographically useful polymers or photographically useful latexes are obtained, and said polymers or latexes may be coated in a photographic element.

43 Claims, 1 Drawing Sheet

OTHER PUBLICATIONS

Candau et al, Journal of Colloid and Interface Science, vol. 101, 1984, pp. 167–183.
Candau et al, Progress in Colloid & Polymer Science, vol. 73, 1987, pp. 33–36.
Holtzscherer et al, Colloid & Polymer Science, vol. 73, 1987, pp. 33–36.
Murtagh et al, ACS Polymer Preprints, vol. 28, 1987, pp. 441–442.
Kuo et al, Macromolecules, vol. 20, 1987, pp. 1216–1221.
Gratzel et al, Langmuir, vol. 2, 1986, pp. 292–296.
Jayakrishnan & Shah, Journal of Polymer Science:-Polymer Letters Edition, vol. 22, 1984, pp. 31–38.
Tang et al, Polymer, vol. 25, 1984, pp. 1357–1362.

MICROEMULSION POLYMERIZATION - PROCESSES FOR DISPERSING PHOTOGRAPHICALLY USEFUL COMPONENTS

TECHNICAL FIELD

This invention relates to creating polymers comprising photographically useful components and latexes comprising photographically useful monomers and comonomers and the incorporation and use of such polymer and latexes in photographic elements.

BACKGROUND ART

Photographically useful latexes

Some prior photographic uses of latexes involved their use as a source of a polymeric ingredient in coated layers. Martinez et al. (U.S. Pat. No. 2,269,158), Donn et al. (U.S. Pat. No. 3,518,088), and Van Campen (U.S. Pat. No. 3,619,195) disclose the codissolution of photographically useful hydrophobes and polymeric latexes in organic solvent, prior to being formulated into the remainder of the coating composition. The latex particles that resulted from such formulations were generally large, and even after being subjected to colloid milling procedures were from 1 to 2 microns in diameter.

Burk discloses (U.S. Pat. No. 2,500,023) a method of incorporating small quantities of dye or pigment in latexes, by mixing the dye or pigment with the monomeric precursors and a polymerization initiator. The highest level of incorporated dye or pigment obtained by this method was 0.5% (w/w) of the total casting syrup. Millikan discloses (U.S. Pat. No. 3,418,127) a similar process for incorporating fluorescent components in a latex.

Tong discloses (U.S. Pat. No. 2,772,163) a method of forming finely divided colloidal suspensions of couplers by dissolving them in alkali and, optionally, alcohol, mixing the coupler solution with a latex, and then adding acid to precipitate the coupler in particulate form. More finely divided dispersions of coupler were obtained by this method than were obtained in the absence of the latex.

Cohen et al. (U.S. Pat. Nos. 3,898,088 and 3,944,424) disclose the preparation of polymeric mordants for photographic elements, in which dyes are immobilized on the polymeric mordants.

Upson and Steklenski disclose (U.S. Pat. No. 4,544,723) latex compositions containing vinyl acetate polymers that have excellent adherence to film supports such as cellulose acetate.

Schofield et al. (Eur. Pat. Application 190003 A2) disclose the formulation of latexes of homopolymers or copolymers of vinyl-substituted UV filter dyes by emulsion polymerization methods.

It is well known in the art of color photography that color images are produced by a colored dye which is formed by a coupling reaction between an oxidized product of an aromatic primary amine color developing agent and a coupler. Various types of cyan, magenta, and yellow dye-forming couplers are well known for use in such coupling reactions. For example, a coupler of the acylacetanilide or benzoylacetanilide type may be used for forming yellow dye images, a coupler of the pyrazolone, pyrazoloazole, pyrazolobenzimidazole, cyanoacetophenone or indazolone type may be used for forming a magenta dye image, and a coupler of the phenolic or naphtholic type may be used for forming a cyan dye image.

It is also known in the art that the coupler may be in the form of a polymer which improves the ability of the dye to remain in the location where it is formed in a color photographic element. For example, Monbaliu et al. disclose (U.S. Pat. No. 3,926,436) photographic elements containing polymeric couplers as latexes which show less foaming tendency and which show high compatibility with hydrophilic colloids such as gelatin. Yagihara et al. (U.S. Pat. No. 4,474,870) disclose photographic materials containing polymeric coupler latexes that form magenta dyes upon coupling with oxidized developing agents. Hirano et al. (U.S. Pat. No. 4,511,647) disclose color photographic materials containing cyan color forming coupler latexes. Yagihara et al. (U.K. Pat. No. 2,092,575 B) disclose silver halide photographic materials containing magenta color forming coupler latexes. Cawse and Harris (European Pat. Application 0321399 A3) disclose a method of preparing latexes of color couplers.

Generally, three methods have been employed in the past for dispersing polymeric couplers. These three methods include (1) dispersing the coupler by colloid milling or homogenization methods, along with high and/or low vapor pressure organic solvents in aqueous surfactant and gelatin; (2) direct incorporation of solutions of water soluble polymers; (3) latex formation by emulsion polymerization or suspension polymerization.

Hirano (U.S. Pat. No. 4,522,916) discloses the preparation of polymeric magenta dye forming coupler latexes that provide images of improved light stability. Hirano and Furutachi (U.S. Pat. No. 4,576,910) disclose the preparation of polymeric magenta dye forming coupler latexes formed from triazole and tetrazole monomers. Helling et al. (U.S. Pat. No. 4,756,998) disclose the preparation of polymeric couplers which contain at least one urethane or urea group. Yamanouchi et al. (U.S. Pat. No. 4,874,689) disclose the preparation of polymeric couplers utilizing chain transfer agents of eight or more carbon atoms. Helling (U.S. Pat. No. 4,921,782) discloses the preparation of polymeric magenta dye forming couplers, wherein the magenta coupler monomer contains a carboxyl group. Maekawa and Hirano (U.S. Pat. No. 4,946,771) disclose the preparation of polymeric couplers formulated with certain advantageously incorporated coupling and noncoupling comonomers.

Dappen and Bowman (U.S. Pat. No. 5,015,566) disclose the preparation of polymethacrylate latexes that reduce pressure sensitivity in tabular grain photographic elements.

Other photographically useful polymers

There are numerous varieties of photographically useful polymers. Such polymers include various binders, such as gelatin, polyvinylalcohol, polyvinylpyrolidone, polymers (mordants and receivers) that provide binding sites for photographically important diffusing species (e.g., dyes), polymers that impede the diffusion of photographically important diffusing species to produce barrier layers, and polymers that contain photographically useful groups.

Polymeric couplers can be prepared by joining reactive couplers to synthesized polymers. Such polymers may include polyacrylic acid, poly-p-aminostyrene, and other natural high polymers. Methods for producing such polymeric couplers are described in U.S. Pat. Nos.

2,698,797, 2,852,381, 2,852,383, and 2,870,712 and in Japanese Patent Publication Nos. 16932/1960 and 3661/1969. Methods for forming polymeric couplers from ethylenically unsaturated monomers and other polymerizable monomers are disclosed in British Pat. Nos. 880,206, 955,197, 967,503, 967,504, 995,363, and 1,104,658.

Jones disclosed (U.S. Pat. No. 2,561,205) the formation of water-soluble polymeric couplers derived from $\beta,\gamma$-ethylenically unsaturated amides. Williams disclosed (U.S. Pat. No. 2,739,956) the formation of water-soluble polymeric couplers derived from vinyl-substituted monomers such as 2-vinyl-1-naphthol. Firestine disclosed (U.S. Pat. No. 2,976,294) water-soluble polymers derived from methacrylamide related monomers, such as 1-(m-methacryloylaminophenyl)-2-carboxy-5-pyrazolone.

Umberger (U.S. Pat. No. 3,451,820) discloses dispersions of lipophilic color-forming polymeric couplers. Van Paesschen and Priem (U.S. Pat. No. 4,080,211) disclose a process for making color-coupling agents by emulsion polymerization. Ponticello et al. (U.S. Pat. No. 4,215,195) disclose the preparation of cross-linkable polymers that contain color-forming coupler residues. Hirano et al. (U.S. Pat. No. 4,518,687) disclose a photographic material containing a cyan dye-forming oleophilic polymeric coupler. Lau and Tang (U.S. Pat. No. 4,612,278) disclose photographic materials containing polymeric couplers copolymerized with alkoxyalkylacrylate monomers.

Noonan and McConkey disclose (U.S. Pat. No. 4,097,282) polymer compositions of imino-containing polymeric adhesives for photographic materials and Noonan et al. disclose (U.S. Pat. Nos. 4,291,153 and 4,307,174) water-dispersible polyester adhesives for photographic materials.

Various condensation and addition polymeric adhesives useful in photographic materials are disclosed by Bachelder et al. (U.S. Pat. No. 2,698,243), Campbell (U.S. Pat. No. 3,056,491), Booth (U.S. Pat. No. 3,256,090), Friedman et al. (U.S. Pat. No. 3,309,201), Yokouchi et al. (U.S. Pat. No. 3,376,265), and Dennis et al. (U.S. Pat. No. 3,511,659), Bowman et al. disclose (U.S. Pat. No. 4,297,432) the formulation of proton barrier layers of vinylidene chloride polymers, ionic vinyl polymers, or ionic polyesters useful in two-sheet diffusion transfer photographic elements.

Land discloses (U.S. Pat. No. 3,793,023) the use of polyethylene glycol in diffusion transfer film units, where polyethylene glycol solutions are used to facilitate the lamination of opposing sheets in a diffusion transfer process. Pfingston discloses (U.S. Pat. No. 4,401,746) the formulation of a stripping layer in a diffusion transfer photographic process, wherein the stripping layer is formulated with a mixture of cellulose acetate hydrogen phthalate and straight-chain saturated polyesters of adipic acid. Bowman and Harrison disclose (U.S. Pat. No. 4,871,648) the formulation of stripping layers for imaging elements using N-alkyl substituted acrylamide copolymers.

Masukawa and Koshizuka disclose (U.S. Pat. No. 4,584,267) the use of poly(vinyl alcohol), of restricted degree of polymerization, as a binder component in thermally develop-able light sensitive materials. These authors also disclose the use of vinylidene chloride polymer as an image receiver component in such materials. Komamura discloses (U.S. Pat. No. 4,948,698) the use of phenylcarbamoylated gelatin and polyvinylpyrrolidone as binder components in radiation sensitive silver halide layers, in heat-processible color photographic materials.

Yamaguchi et al. disclose (U.S. Pat. No. 4,294,921) polymers having cross-linkable repeating units, which may be used to harden gelatin at an accelerated rate. Ogawa et al. (U.S. Pat. No. 4,444,926) disclose similar polymers for increasing the rate of gelatin hardening while minimizing post hardening. Nakamura discloses (U.S. Pat. No. 4,663,272) polymers of photographically useful groups having at least one repeating unit having a sulfinic acid group or a sulfinate group. Such polymers may be fixed in a photographic layer by cross-linking, so that the polymer does not substantially migrate thereafter.

Sato et al. (U.S. Pat. No. 4,877,720) and Koya et al. (U.S. Pat. No. 4,916,047) disclose redox activated photographically useful group-releasing polymers, where the photgraphically useful group may optionally be released with a timing group. Specific photographically useful groups claimed by Sato et al. include development inhibitors, development accelerators, desilvering inhibitors, silver halide solvents, developers, fixing accelerators, fixing inhibitors, silver image stabilizers, light filters, antihalation agents, hardeners, desensitizers, contrast intensifiers, chelating agents, mordanting agents, UV absorbers, and nucleation accelerators.

Ohki et al. disclose (U.S. Pat. No. 4,978,606) the use of the combinations of polyacrylamides and antioxidant compounds to enhance the storage stability of antioxidants when used in photographic elements. Ono et al. disclose (U.S. Pat. No. 4,983,506) polyconden-sation product polymers for use as antifoggants in color systems.

Abel and Bowman (U.S. Pat. No. 4,504,569) and Bowman and Verhow (U.S. Pat. No. 4,865,946) disclose polymer compositions useful as temporary barrier layers in photographic elements.

Incorporation of photographically useful components

Photographically useful components that have significant solubility in water or aqueous gelatin or have significant solubility in mixtures of water and water-miscible solvents such as methanol, can often usefully be incorporated in photographic elements by adding solutions of such components directly to coating melts prior to coating the photographic element. This is routinely done with absorber dyes during photographic element manufacture to control the net radiation sensitivity of the sensitized silver halide crystals.

The conventional method of incorporating hydrophobic couplers and other hydrophobic photographically useful components in photographic elements has been described by Jelly and Vittum (U.S. Pat. No. 2,322,027). The component of interest is dissolved in a high boiling water immiscible solvent, mixed with aqueous gelatin and associated dispersing aids, and dispersed using a high shear device such as a colloid mill or a homogenizer. The resulting dispersion is then chill set and stored under refrigeration until it is used. Such dispersions may then be added to the composition of photographic elements by melting them at a suitable temperature and adding the component dispersions to a coating melt in the photographic element, as is well known in the art.

The coupling of micelle-forming couplers has been discussed by Tong (Micelle-Forming Couplers, *Theory of the Photographic Process*, 1977; pp. 346–347). Couplers (so-called Fischer couplers) that have both ionic groups and large hydrophobic groups exhibit amphiphilic behavior and form micelles with low critical micelle concentrations. Solutions of such couplers can be incorporated in photographic elements.

The formation of stable colloidal dispersions of hydrophobic dye-forming couplers starting from a solution state is known. Such processes generally rely on dissolving the coupler with water-miscible solvent or with base to ionize the coupler, the addition of a surfactant, and the subsequent precipitation of coupler by lowering the pH or by shifting the concentration of one of the miscible solvents, such that the coupler is no longer soluble in the continuous phase and precipitates as a dispersion. Such processes have been described by Townsley et al. (U.K. No. 1,193,346), where a color coupler was dissolved in aqueous alkali and water-miscible solvent, and then mixed with an acidic solution of a protective colloid. The color coupler precipitated as a stable dispersion, and was subsequently incorporated in a coated layer containing silver halide emulsion. Related but improved processes have been disclosed by Bagchi (U.S. Pat. Nos. 4,933,270 and 4,970,139) and Chari (U.S. Pat. Nos. 4,957,857 and 5,015,564).

Another method for incorporating photographically useful components is to disperse such components as finely divided, colloidal solids, by milling methods such as sand milling, roller milling, Swaco milling, etc. Processes that produce submicron solid particle colloids have found advantageous use in producing dispersions of photographically useful chemicals such as visible-region filter dyes, sensitizing dyes, etc. Postle et al. (U.S. Pat. Nos. 4,294,916 and 4,294,917) describe solid disperisons of photographic filter dyes and offer the advantage that such dyes in the solid state give broad spectral absorption. The preparation and use of apparently solid particle dispersions of spectrally sensitizing dyes is disclosed in German Patent 1,547,705. A process for producing solid particle dispersions using sand, bead, dyno, and Masap mills and by using mills described in U.S. Pat. Nos. 2,581,414 and 2,855,156 is disclosed in British Patent 1,570,362. The authors of this British patent state that non-diffusing slightly soluble color couplers can be dispersed by the milling process described. DIR (development inhibitor releasing) couplers, spectral sensitizing dyes, and photographic stabilizers are examples of other photographically useful materials that this British Patent (1,570,362) states may be dispersed as solid particle milled dispersions.

An important alternative method for incorporating hydrophobic and photographically useful components, is to load such components into latex particles, and then incorporate the loaded latex particles into the photographic element. Chen discloses (U.S. Pat. Nos. 4,199,363 and 4,304,769) processes for achieving uniform and efficient distribution of hydrophobic materials through hydrophilic colloid layers by using loaded latex compositions. Chen discloses (U.S. Pat. Nos. 4,214,047 and 4,247,627) the formulation of photographic elements having various photographic addenda and ultraviolet absorbers dispersed in such loaded latex particles. Fujiwhara et al. disclose (U.S. Pat. No. 4,368,258) the preparation of copolymeric latexes from vinyl substituted monomers, wherein the polymer contains at least one hydrophilic group, for use in incorporating hydrophobic components. Their process uses a water-miscible organic solvent, and commences with the hydrophobic component in the solid state. Latex imbibition is achieved by virtue of the solubilizing power of the latex and of the water-miscible organic solvent.

Problems associated with prior art processes

Prior art that uses emulsification processes suffer in that a large amount of energy is often required to effect such emulsification. This large energy input usually is dissipated as heat, and this heat often causes thermal degradation of the photographically useful component being dispersed by the emulsification process.

Several of these methods of incorporating photographically useful components suffer from metastability with respect to crystallization or blooming of the useful component. In particular, the methods using loaded latexes and emulsified dispersions (colloid mill and homogenizer based dispersions) can suffer greatly from this malady when the useful component has too much solubility in the aqueous gelatin phase due to intrinsic solubility or due to enhanced solubility from the presence of some carrier (surfactant micelles, auxiliary organic solvents, etc.). Solubilization by these mechanisms lead to wandering of the photographically useful component to layers in photographic elements where other harmful effects may occur.

Methods for incorporating components that absorb ultra-violet or visible light sometimes suffer because the region of absorption of said component is not as extensive as desired. For example, a polymeric ultraviolet component disclosed in British Patent Specification 1,346,764 and comprising dye I-51 (see Table I) has spectral absorption characteristics that allow some unwanted UV radiation to be transmitted.

The standard methods of polymerization usually lead to broad molecular weight distributions in the resulting polymer.

The methods above which incorporate useful components without attaching the component to a polymeric backbone are all subject to having the component wander due to thermal or chemical activation and suffer harmful effects such as those already described. This problem is particularly evident, for example, in the use of water soluble polymers (to introduce ultraviolet absorber components and stabilizer components as disclosed in U.S. Pat. Nos. 3,926,436 and 4,397,943) which are diffusive and which are apt to flow out of the photographic element into the developer solution during development.

The problem of inadequate fastness to diffusion also accompanies the incorporation of certain classes of polymeric couplers. Polymeric couplers which are free to diffuse in the gelatin binder, when swollen with processing fluid, tend to diffuse out of the photographic element. This loss of materials results in dye images that are low in density.

The magenta dyes obtained from polymeric pyrazolone couplers have defective absorption envelopes, in that they often absorb too much blue light. This unwanted absorption necessitates the use of additional masking couplers.

A significant difficulty encountered with the use of polymeric couplers in photographic materials is in providing good dispersions of the polymers, which allow incorporation of the polymers into the photographic material. Known polymeric couplers have insufficient colloid stability and agglomerate during storage. These agglomerates often interfere with coating photographic elements and cause deleterious spots and defects in the coated elements. Furthermore, large agglomerates tend to sediment; such sedimentation yields nonuniformities in coupler concentration. Such agglomerates necessitate the use of filtration procedures and cause the clogging of such filters.

Emulsion polymerization methods for forming photographically useful polymers are disadvantageous in several respects. That is, owing to the low solubility of many photographically useful monomers in water, organic solvents are required in the emulsion polymerization. This tends to reduce the stability of the resulting polymeric latexes and to reduce the percentage of solids in the polymer products. Additionally, the compositions of the polymeric materials are difficult to control because of the heterogeneous nature of the system. Photographically useful monomers often are solid and owing to their low water solubility, they tend to precipitate out in the aqueous phase and fail to copolymerize with other comonomers.

The incorporation methods utilizing latex loading have distinct limitations. In these methods the amount of the photographically useful component to be incorporated in the latex particles is limited due to the finite relative solubility of said component in the latex particle. Attempts to incorporate said component at higher levels result in latex particle aggregation and precipitation of said component outside of the latex particles. These limitations often result in an excessive amount of latex having to be used to incorporate a given amount of photographically useful component. For example, when a photographically useful hydrophobic component such as a coupler is loaded in dispersed latex particles, often more than twice the amount by weight of the polymeric latex, based on coupler, is required. The radiation sensitive elements prepared therefrom become thick in size and the developing properties as well as the image sharpness are degraded. These loading procedures usually require large quantities of water-miscible organic solvent. This condition is especially the case in procedures which require that the hydrophobic component be dissolved in the water-miscible organic solvent before loading. Therefore, large scale processing equipment and lengthy processing times are required to remove this solvent subsequent to loading; all of these excess requirements increase the expense of the incorporation procedures and the cost of the resulting photographic elements.

Microemulsion polymerization

The use of microemulsions to prepare oil-in-water dispersions of water insoluble components has been described by Rosano (U.S. Pat. No. 4,146,499). The general features of microemulsion polymerization have been reviewed by Dunn (Polymerization in Micelles and Microemulsions, In *Comprehensive Polymer Science. The Synthesis, Characterization, Reactions and Applications of Polymers*, Vol. 4, Chain Polymerization II, Eastmond, Ledwith, Russo, and Sigwalt, Editors, Pergamon, 1989, pp. 219–224) and by Candau (J. Chim. Phys. Phys.-Chim. Biol., 1987).

Stoffer and Bone disclose (J. Disp. Sci. Technol., 1, 37, 1980; J. Polym. Sci.: Polym. Chem., 18, 2641, 1980) the polymerization of methylmethacrylate in water-in-oil microemulsions.

Leong et al. (J. Chim. Phys. Phys.-Chim. Biol., 78, 279, 1981) disclose the polymerization of acrylamide in water-in-toluene microemulsions stabilized by triblock copolymers of polystyrene and polytheylene oxide in the presence of 2-propanol to obtain microlatexes.

Atik and Thomas disclose (J. Am. Chem. Soc., 104, 5868, 1982; 105, 4515, 1983) the microemulsion polymerization of styrene and divinylbenzene mixtures. Leong and Candau disclose (J. Phys. Chem., 86, 2269, 1982) the ultraviolet initiated microemulsion polymerization of acrylamide in inverse microemulsions.

Candau et al. disclose (German Offen. 3312711) the preparation of latexes, useful in secondary oil recovery, from water-in-oil microemulsions of water-soluble vinyl monomers. Daniel (Fr. Demande 2528436 A1) discloses the preparation of polymeric latexes for biological use by coating acrylic latexes with vinylaromatic polymers. Gan et al. (J. Macromol. Sci., Chem., A19, 739, 1983) disclose the polymerization of styrene in microemulsions comprising styrene, water, sodium dodecyl sulfate, pentanol or Bu Cellosolve (CAS Registry #111-76-2).

Bock et al. disclose (European Pat. No. 115213 A) the preparation of acrylamide and alkylacrylamide copolymers by microemulsion polymerization. Tang et al. disclose (Polymer, 1984) the microemulsion polymerization of styrene in sodium dodecylsulfate, pentanol, and water microemulsions. The effects of water-soluble and oil-soluble free radical initiators on latex particle size in microemulsion polymerization have been disclosed by Johnson and Gulari (J. Polym. Sci.: Polym. Chem., 22, 3967, 1984). Jayakrishnan and Shah disclose (J. Polym. Sci.: Polym. Letters, 22, 31, 1984) the microemulsion polymerization of styrene using Aerosol MA-80 and Pluronic L-31 surfactants. Candau et al. disclose (J. Colloid Interface Sci., 101, 107, 1984) the polymerization in inverse microemulsions of acrylamide, where the microemulsions are formulated with Aerosol-OT and toluene. Microlatexes are the product of this polymerization; these latexes have nominal diameters of 400 Å.

Durand et al. (Ger. Offen. 3520507 A1) disclose the preparation of latexes of poly(meth)acrylamide and other acrylic components in water-in-hydrocarbon microemulsions. Candau et al. (U.S. Pat. No. 4,521,317) disclose a process for making latexes by polymerizing water-in-oil microemulsions. Turner et al. (U.S. Pat. No. 4,521,580) disclose a microemulsion process for producing acrylamide-alkyl-acrylamide copolymers. Chew and Gan disclose (J. Polym. Sci., Polym. Chem., 23, 2225, 1985) the polymerization of methylmethacrylate, acrylic acid, and sodium acylamidostearate in water-in-oil microemulsions. The kinetics of acrylamide polymerization in inverse microemulsions, and the effects of potassium persulfate and AIBN initiators are discussed by Candau et al. (J. Polym. Sci.: Polym. Chem., 23, 193, 1985).

Durand et al. disclose (Great Britain Pat. No. 2161492) the production of stable latexes by microemulsion polymerization of water-in-oil microemulsions of alkali metal carboxylates and nonionic surfactants with HLB numbers in the range of 8 to 11. Altunina et al. disclose (Soviet Union Pat. No. 1237673) the synthesis of polyacrylamides by microemulsion polymerization. Gratzel et al. disclose (Langmuir, 2, 292, 1986) the photoredox-initiation of microemulsion polymerization of styrene, divinylbenzene, acrylamide, methylmethacrylate, and acrolein microemulsions. Candau et al. disclose (J. Colloid Interface Sci., 114, 398, 1986) the copolymerization of water-soluble monomers in nonionic bicontinuous microemulsions.

DeFazio discloses (U.S. Pat. No. 4,656,222) the preparation of high molecular weight polyacrylates in inverse (water in hydrocarbon) microemulsions. Durand et al. (U.S. Pat. No. 4,681,912) disclose a new process for making inverse microlatexes of water-soluble copolymers and the use of such latexes in oil recovery. Holtzscherer et al. disclose (Colloid Polym. Sci., 265, 1067, 1987) the polymerization of acrylamide in water-in-oil (isoparaffinic oil and Isopar M) microemulsions stabilized by nonionic emulsifiers. Murtagh et al. (ACS Polym. Preprints, 28, 441, 1987) and more recently Perez-Luna et al. (Langmuir, 6, 1040, 1990) disclose the preparation of polystyrene latexes by microemulsion polymerization in three-component microemulsions. Kuo et al. (Macromolecules, 20, 1216, 1987) disclose the photoinitiation of microemulsion polymerization in styrene microemulsions using dibenzyl ketone as initiator. Candau et al. disclose (Progr. Colloid Polymer Sci., 73, 33, 1987) the copolymerization of acrylamide and sodium acrylate in nonionic microemulsions.

Giannetti and Visca disclose (European Pat. Application 250767 A1) a process for polymerizing fluorinated monomers in aqueous dispersions containing a perfluoropolyether microemulsion to obtain enhanced polymerization rates and uniformity of conversion. Ricoh assignors (Japanese Pat. No. 63068602) disclose the production of ultrafine latex-particles by polymerization in water-in-oil microemulsions of water-soluble monomers. Kitahara and Konno (German Offen. No. 3534528 and U.S. Pat. No. 4,749,506) disclose microgel dispersions of magnetic particles and titania particles created by precipitation in water-in-oil microemulsions. Haque and Qutubuddin disclose (J. Polm. Sci.: Part C: Polym. Letters, 26, 429, 1988) the preparation of porous solids using microemulsion polymerization.

Glover and Graiver (U.S. Pat. No. 4,824,890) disclose a method of producing elastomeric films of silicones using curable microemulsions. Beckman et al. (WO Pat. No. 8904844; U.S. Pat. No. 4,933,404) disclose polymerization of monomers in microemulsions of supercritical polar fluids. Candau has comprehensively reviewed (Polymerization in Inverse Microemulsions, In *Comprehensive Polymer Science. The Synthesis, Characterization, Reactions and Applications of Polymers*, Vol. 4, Chain Polymerization II, Eastmond, Ledwith, Russo, and Sigwalt, Editors, Pergamon, 1989, pp. 225–229) microemulsion polymerization in inverse (water-in-oil) microemulsions. The kinetics of acrylamide photopolymerization in Aerosol-OT inverse microemulsions and the effects of solution components on the termination mechanism in acrylamide microemulison polymerization have been disclosed by Carver et al. (J. Polym. Sc.: Part A: Polym. Chem., 27, 2161, 1989; 27, 2179, 1989).

Vinson (Thesis, University of Minnesota, 1990) and Vinson et al. (J. Colloid Interface Sci., 142, 74, 1991) disclose the preparation of ultrafine polystyrene latexes by microemulsion polymerization. Puig et al. (J. Colloid Interface Sci., 137, 308, 1990) disclose the microemulsion copolymerization of styrene and acrylic acid in a dodecyltrimethylammonium bromide stabilized microemulsion. Perez-Luna et al. (Langmuir, 6, 1040, 1990) disclose the microemulsion polymerization of styrene in a three-component microemulsion stabilized with dodecylrimethylammonium bromide.

There is no teaching that shows the incorporation of photographically useful components using microemulsion polymerization, or the creation of useful polymers of photographically useful components using microemulsion polymerization.

DISCLOSURE OF INVENTION

The object of the invention is to overcome shortcomings of the above prior art processes.

Another object of this invention is to provide a process for preparing latex polymer compositions in which a larger quantity of a photographically useful component is loaded in the dispersed latex particles. Another object of this invention is to provide polymeric photographic compositions that are not degraded by the heat generated in conventional emulsification procedures. Yet another object of this invention is to provide more efficient processes for dispersing photographically useful components in the form of polymers and polymeric latexes.

The objects of this invention are generally accomplished by providing a free radical microemulsion polymerization process for the formation of a polymer or a copolymer of photographically useful components which comprises the steps of:

(a) forming an isotropic microemulsion, with droplet diameters predominantly in the range of 30 to 900 Å, by mixing surfactant, water, and at least one ethenic monomer according to structure (I)

$$CH_2{=}C(X)Y \qquad (I)$$

where

X is selected from the group consisting of hydrogen, methyl, ethyl, propyl, butyl, fluorine, chlorine, bromine, iodine;

Y is selected from the group consisting essentially of ultraviolet (UV) absorbers and visible filter dyes, optical brighteners, oxidized developer scavangers, couplers, couplers that release photographically useful groups (PUG) upon coupling with oxidized developer including development inhibitor releasing couplers, development inhibitor anchimerically releasing couplers, bleach accelerator releasing couplers, developer releasing couplers, reducing agent releasing couplers of any type, electron transfer agent releasing couplers, silver halide solvents releasing couplers, silver halide developers, sensitizing dyes for silver halides, photographically useful groups as described above that are attached to the polymer through timing switches of any sort, so as to release UV absorber dyes, visible filter dyes, reducing agents and electron transfer agents of any sort, silver halide solvents, bleach accelerators, development accelerators, couplers or other color image precursors, antifoggants, silver salt stabilizers, image stabilizers, materials to control radiation sensitivity;

(b) deaerating the microemulsion by passage of an inert gas therethrough or using an excess of initiator;

(c) initiating polymerization by addition of free radical initiator or by irradiating with ultraviolet light;

(d) continuing the polymerization reaction for a sufficient time at a sufficient temperature to form said polymer, copolymer, or latex.

MODES FOR CARRYING OUT THE INVENTION

Figure 1:
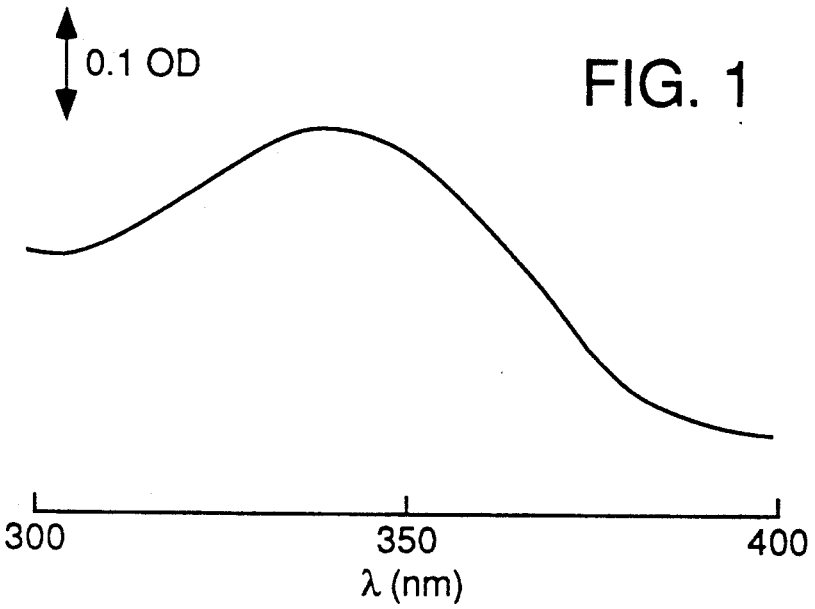
FIG. 1: Ultraviolet absorption spectrum of an aqueous suspension of the ultraviolet-absorber-modified latex prepared according to this invention as described in the Example. The ordinate is optical absorbance, and the scale bar indicates 0.1 optical density units. The abscissa is wavelength in nanometers.

The process of the present invention offers certain advantages over conventional polymerization processes described above and over other methods of incorporating photographically useful components in photographic elements.

The photographically useful components of this invention span the range of organic compounds useful in photographic imaging chemistry. Such components include, but are not restricted to, ultraviolet (UV) absorbers and visible filter dyes, optical brighteners, oxidized developer scavangers, couplers, couplers that release photographically useful groups (PUG) upon coupling with oxidized developer (development inhibitor releasing couplers, development inhibitor anchimerically releasing couplers, bleach accelerating releasing couplers, developer releasing couplers, reducing agent releasing couplers of any type, electron transfer agent releasing couplers, alcohol releasing couplers, silver halide solvents, etc.), silver halide developers, sensitizing dyes for silver halides, monomers (that after polymerization) that solubilize photographically useful components in latex particles, monomers (that after polymerization) that provide antistatic protection during photographic processing, monomers (that after polymerization) that provide complexing association with photographically useful components coated in photographic elements or generated in photographic elements during processing, components that are attached to the polymer through timing switches of any sort, so as to release mordant groups such as quaternary salts (the release of which reduces dye retention and stain), solubilizing groups such as sulfonic acids, carboxylic acids, alkyl amino phenols which modify the diffusion and washout of the polymer, UV absorbers, visible filter dyes, reducing agents and electron transfer agents of any sort, silver halide solvents, silver complexing agents, fogging agents, anti-fogging agents, bleach accelerators, bleach inhibitors, development accelerators, color image precursors other than couplers, antistats, thickeners, flocculating agents, antifoggants, silver salt stabilizers, hardeners, image stabilizers, materials to control radiation sensitivity, halide releasers, oxidized scavangers, etc.

The free radical microemulsion polymerization and copolymerization of photographically useful vinyl monomers has been found to be a useful process for making photographically useful polymers and latexes. Such microemulsions are made by dissolving photographically useful monomers and comonomers in an isotropic oil-in-water microemulsion comprising monomers or comonomers, surfactant, surfactants, and/or cosurfactants, water, and electrolytes, or alternatively in an isotropic water-in-oil microemulsion comprising monomers or comonomers, surfactant, surfactants, and/or cosurfactants, water, and a fluid that is immiscible with water (e.g., ethylacetate, supercritical pentane). Such microemulsions are transparent or nearly transparent to the eye at 1% (w/w) or greater monomer, ultrafine in particle (droplet) size (typically in the range of 30 to 900 Å in diameter), and spontaneously form upon combining all the components with moderate stirring. Stirring is accomplished by any mechanical means commonly known in the art and appropriate for the volume of reactants. Said means include, but are not restricted to, magnetic stirring bars and impellers of any type and means for magnetically coupling them to a rotating drive, marine propellers of any type and size and means for rotating said propellers in the reactant solution or suspension, rotating disk cylinder, and turbine stirrers of any type and means for mechanically rotating them, convective stirring achieved by circulating the reagent solution or suspension at any suitable volume flow rate and means for achieving said circulation which include pumping of any sort, convective stirring achieved by shaking or tumbling the reactor by any means, convective stirring achieved by passing the reaction solution or suspension through any mechanical milling device such as a colloid mill or homogenizer of any sort. Preferred means of stirring are those that expend minimal mechanical energy such as magnetic bar and impeller, marine propeller, and rotating disk and turbine stirrers. The microemulsion so formed is deaerated during and subsequent to the mixing of its components, prior to initiation, or in the case that the microemulsion is not deaerated, an excess of initiator is used to consume any dissolved oxygen present in the microemulsion. Deaeration may be achieved by any of the methods commonly known in the art. A preferred method of deaeration comprises passing a stream of inert gas through the reaction mixture at a sufficient flow rate and for a sufficient time to expel a sufficient amount of dissolved oxygen from the reaction mixture, where nitrogen is a preferred inert gas. Other inert gases such as argon may be used with equal efficacy. The polymerization process is subsequently initiated with free radical initiators or with ultraviolet light. Free radical initiators of any sort may be used. Preferred initiators include acyl peroxides such as acetyl and benzoyl peroxides, alkyl peroxides such as cumyl and t-butyl peroxides, hydroperoxides such as t-butyl and cumyl hydroperoxides, peresters such as t-butyl perbenzoate, azo compounds such as 2,2'-azobisisobutyronitrile and related azo compounds such as those disclosed by Nuyken and Kerber (*Makromol. Chem.*, 179, 2845, 1978) which are incorporated herein by reference, disulfides such as those disclosed by Sato, Abe, and Otsu (*Makromol. Chem.*, 180, 1165, 1979) which are incorporated herein by reference, tetrazenes such as those disclosed by Oda, Maeshima, and Sugiyama (*Makromol. Chem.*, 179, 2331, 1978), $N_2O_4$, persulfate, peroxides in combination with a reducing agent such as hydrogen peroxide in combination with ferrous ion, various organic peroxides in combination with ferrous ion as disclosed by Huyser (in Chapter 10 and pp. 314–330 of *Free Radical Chain Reactions*, Wiley, New York, 1970) which combinations are incorporated herein by reference, peroxides in combination with other reducing ions, such as $Cr^{2+}$, $V^{2+}$, $Ti^{3+}$, $Co^{2+}$, and $Cu^{+}$, combinations of acyl peroxides and reducing amines such as benzoyl peroxide and N,N-dialkylaniline and other combinations as disclosed by O'Driscoll, Lyons, and Patsiga (*J. Polym. Sci.*, A3, 1567, 1965) and by Morsi, Zaki, and El-Khyami (*Eur. Polym. J.*, 13, 851, 1977) which combinations are incorporated herein by reference, combinations of amines and acyl halides such as those disclosed by Gaha and Chaudhuri (*J. Polym. Sic. Polym. Lett. Ed.*, 16, 625, 1978) which combinations are incorporated herein by reference, combinations of peroxides and transition metal complexes such as cupric acetylacetonate and ammonium salts such as those disclosed by Ghosh and Maity (*Eur. Polym. J.*, 14, 855, 1978) and by Shahani and Indictor (*J. Polym. Sci. Polym. Chem. Ed.*, 16, 2683, 1978; *J. Polym. Sci. Polym. Chem. Ed.*, 16, 2997, 1978) which combinations are incorporated herein by reference, the combination of zinc chloride and azo compounds such as 2,2'-azoisobisbutyronitrile, the combination of inorganic reductants and inorganic oxidants such as $S_2O_8^{-2}$ in combination with $Fe^{+2}$, $S_2O_8^{-2}$ in combination with $S_2O_3^{-2}$, and other combinations such as those disclosed by Huyser (in Chapter 10 and pp. 314–330 of *Free Radical Chain Reactions*, Wiley, New York, 1970) and by Manickam, Singh, Venkatarao, and Subbaratnam (*Polymer*, 20, 917, 1979) which combinations are disclosed herein by reference, combinations of reductants such as $HSO_3^-$, $SO_3^{-2}$, $S_2O_3^{-2}$, and $S_2O_5^{-2}$ with oxidants such as $Ag^+$, $Cu^{+2}$, $Fe^{+3}$, $ClO_3^-$, and hydrogen peroxide, the combination of $Ce^{+4}$ with alcohols such as combinations disclosed by Mohantz, Pradhan, and Mahanta (*Eur. Polym. J.*, 16, 451, 1980) which are incorporated herein by reference, combinations of $V^{5+}$, $Cr^{6+}$, or $Mn^{2+}$ with organic components such as combinations disclosed by Nayak and Lenka (*J. Macromol. Sci. Rev. Macromol. Chem.*, C19, 83, 1980) which are incorporated herein by reference, the combination of thiol compounds such as thiourea, thioglycollic acid, and 2-mercaptoethanol with $Fe^{+3}$, $Ce^{+4}$, $BrO_3^-$, and $S_2O_8^{-2}$ such as disclosed by Pramanick and Chatterjee (*J. Polym. Sci. Polym. Chem. Ed.*, 18, 311, 1980) and by Misra and Dubey (*J. Polym. Sci. Polym. Chem. Ed.*, 17, 1393, 1979) which combinations are herein incorporated by reference, combinations of $Ce^{4+}$ and $V^{5+}$ with aldehydes and ketones as disclosed by Ahmed, Natarajan, and Anivaruddin (*Makromol. Chem.*, 179, 1193, 1978) which are incorporated herein by reference, combinations of $Mn^{+3}$ and permanganate with oxalic, malonic, and citric acids as disclosed by Kaliyamurthy, Elayaperumol, Balakrishnan, and Santappa (*Makromol. Chem.*, 180, 1575, 1979) which are incorporated herein by reference, and combinations or organometallic derivatives of transition metals with organic halides as disclosed by Bamford (in Chapter 3 of *Reactivity, Mechanism and Structure in Polymer Chemistry*, Jenkins and Ledwith, Editors, Wiley-Interscience, New York, 1974) and by Ouchi, Taguchi, and Imoto (*J. Macromol. Sci. Chem.*, A12, 719, 1978) which are incorporated herein by reference. The components are chosen so that photographically useful polymers or photographically useful latexes are obtained. Said polymers and latexes may be used as obtained or they may be further treated to achieve some desirable effect. For example, said polymers and latexes may be washed to remove unwanted soluble material, such as salt or unreacted monomer, using methods well known in the art such as dialysis and constant volume membrane filtration methods. Said polymers and latexes may be concentrated to facilitate their storage, transportation, and use by methods well known in the art such as membrane dialysis, rotoevaporation, and other well known solvent stripping methods. Said polymers may be precipitated and recovered as solids to facilitate their storage, transportation, and use by methods well known in the art. Such methods include, but are not restricted to, pH shifting, solvent shifting (flooding with a poor or non-solvent), spray drying, and freeze drying.

The present invention provides a means of making and incorporating photographically useful components (polymerizable monomers) whereby the incorporated components, due to their being polymerized, cannot, without directed chemical activation, diffuse away from the composing polymer and form deleterious crystals of the useful component in the same or some other layer of the coated silver halide containing photographic element or in the latex suspension during storage.

Surface active agents (surfactants, cosurfactants) are standard components in the formulation of microemulsions. Examples of preferred surfactants are given in Table S, below. This list is not meant to limit the scope of surfactants which fall within the spirit of this invention.

TABLE S

| | | |
|---|---|---|
| S-1 | $CH_3-(CH_2)_{11}-SO_4^-Na^+$ | Sodium Dodecyl Sulfate |
| S-2 | 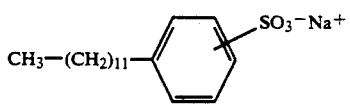 | Sodium Dodecyl Benzene Sulfonate |
| S-3 | 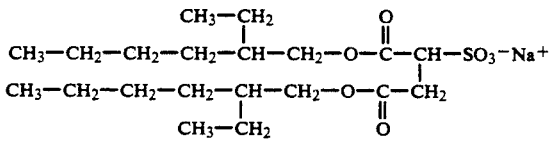 | Aerosol OT (Cyanamid) |
| S-4 | 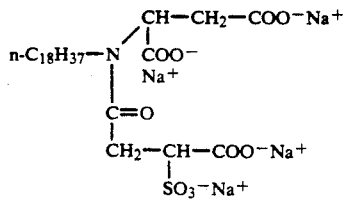 | Aerosol 22 (Cyanamid) |

TABLE S-continued
| | | |
|---|---|---|
| S-5 | 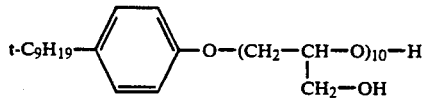 | Olin 10G (Dixie) |
| S-6 | $n\text{-}C_{12}H_{25}-O-(CH_2-CH_2-O)_{12}-SO_3^-Na^+$ | Polystep B-23 (Stepan) |
| S-7 | 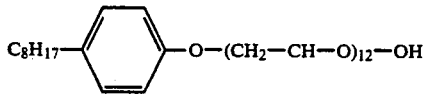 | Triton TX-102 (Rohm & Haas) |
| S-8 | 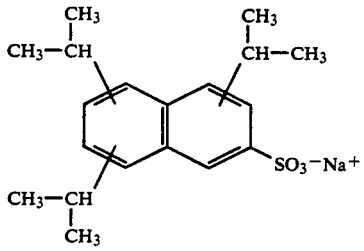 | Alkanol-XC (Du Pont) |
| S-9 | 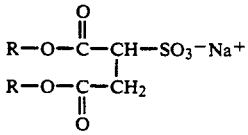 <br>where R = $CH(CH_3)C_4H_9$ | Aerosol MA (Cyanamid) |
| S-10 | 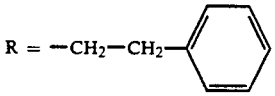 | |
| S-11 | 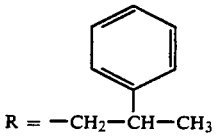 | |
| S-12 | $R = -CH_2-CH(CH_2CH_3)C_3H_7$ | |
| S-13 | $R = -(CH_2)_nCH_3$ (n = 2, 3 & 5) | |
| S-14 | 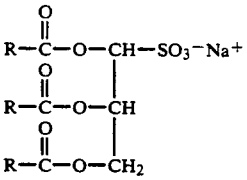 <br> 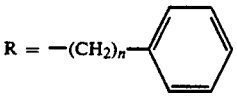 (n = 2 to 5) | |
| S-15 | $n\text{-}C_{12}H_{25}-O-(CH_2-CH_2-O)_{23}-OH$ | Tricol LAL-23 (Emery) |
| S-16 | $C_{12}H_{25}-O-(CH_2-CH_2-O)_{15}-CH_2-CH_2-SO_3^-Na^+$ | Avanel S-150 (PPG) |
| S-17 | $n\text{-}C_{12}H_{25}-O-(CH_2-CH_2-O)_n-C(=O)-CH(CH_2-COO^-Na^+)-SO_3^-Na^+$<br>n = 3–5 | Aerosol A102 (Cyanamid) |

TABLE S-continued
S-18
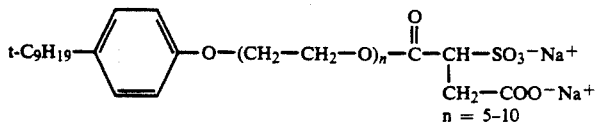
n = 5-10
Aerosol A103 (Cyanamid)
S-19
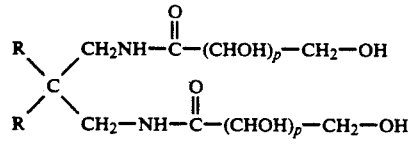
where, R = n-$CH_3$—$(CH_2)_x$— (where x = 3 to 10)
S-20
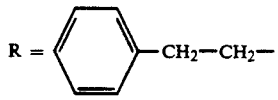
p = 3 to 10
S-21
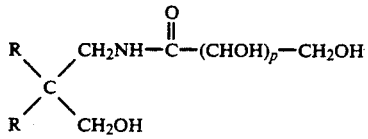
where, R = n-$CH_3$—$(CH_2)_x$— (where x = 3 to 10)
S-22
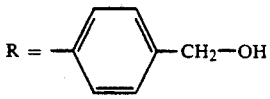
p = 3 to 15
S-23
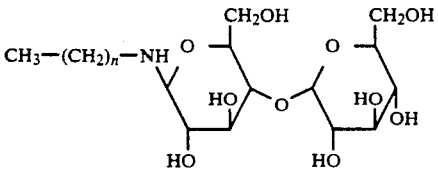
where, n = 3 to 15
S-24
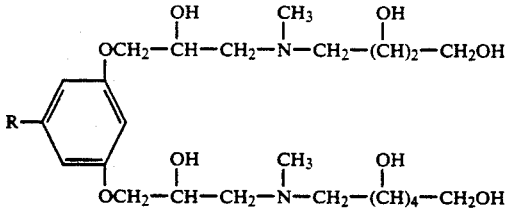
where, R = n-$CH_3$—$(CH_2)_x$— (where x = 1 to 15)
S-25
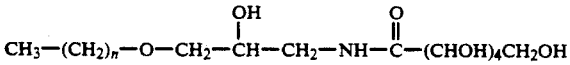
where, n = 3 to 15
S-26
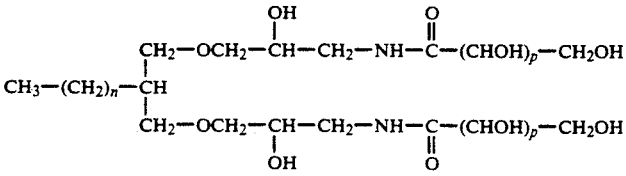
where, n = 2 to 12

TABLE S-continued p = 3 to 10

S-27

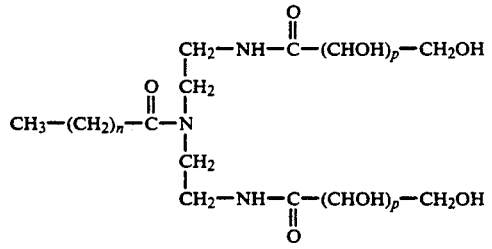

where, n = 2 to 18
p = 3 to 10

S-28

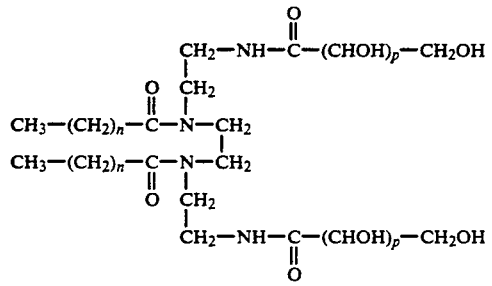

where, n = 2 to 18
p = 3 to 10

| | | | Molecular Weight Range |
|---|---|---|---|
| S-29 | Pluronic TM Polyols (BASF) | $HO-(CH_2CH_2-O)_a-(CH(CH_3)-CH_2-O)_b-H-(OCH_2-CH_2)_c-$ | 1,100 to 14,000 |
| S-30 | Pluronic TM-R Polyols (BASF) | $HO(CH(CH_3)-CH_2-O)_a-(CH(CH_3)-CH_2-O)_b-H-(O-CH_2-CH(CH_3)-CH_2)_c-$ | 1,100 to 14,000 |
| S-31 | Plurodot TM Polyols (BASF) | Liquid Polyethers Based on Alkoxylated Triols | 3,200 to 7,500 |
| S-32 | Tetronic TM Polyols (BASF) | $HO-(CH_2CH_2-O)_y-(CH(CH_3)-CH_2-O)_x$ (×4) bonded to $N-CH_2-CH_2-N$ | 3,200 to 27,000 |
| S-33 | (TX200) | $t\text{-}C_4H_9-CH_2C(CH_3)_2-C_6H_4-OCH_2CH_2OCH_2CH_2SO_3^-Na^+$ | |
| S-34 | (OMT) | $CH_3(CH_2)_7CH=CH(CH_2)_7C(=O)-N(CH_3)(CH_2CH_2SO_3^-Na^+)$ | |

Monomers that fall within the scope of this invention have the general structure (I):

$$CH_2{=}C(X)Y \qquad (I)$$

where

X is H, alkyl (of one to six carbon atoms), F, Cl, Br, I;

Y is any group that is photographically useful or optionally yields, upon polymerization, a photographically useful polymer or latex.

Preferred examples of monomers of photographically useful components which may be used in the present invention include those represented by structure II:

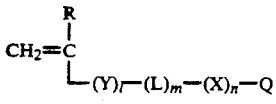

$$CH_2{=}C(R)\text{—}(Y)_l\text{—}(L)_m\text{—}(X)_n\text{—}Q \qquad (II)$$

wherein

R is hydrogen or an alkyl group having from 1 to 6 carbon atoms;

Y is

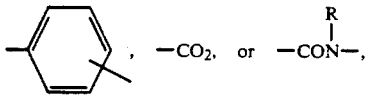

$$\text{—}C_6H_4\text{—},\ \text{—}CO_2,\ \text{or}\ \text{—}CON(R)\text{—},$$

wherein

R has the same meaning as above;

L is a divalent bonding group having from 1 to 12 carbon atoms;

X is $$\text{—}O\text{—},\ \text{—}CO\text{—},\ \text{—}CO_2\text{—},\ \text{—}SO_2\text{—},$$

$$\text{—}CON(R)\text{—},\ \text{—}SO_2N(R)\text{—},\ \text{—}N(R)CON(R)\text{—},\ \text{—}N(R)COO\text{—},$$

$$\text{—}COCH_2CH_2\text{—},\ \text{—}OCOCH_2CH_2\text{—},$$

$$\text{—}N(R)COCH_2CH_2\text{—},\ \text{—}OSO_2CH_2CH_2\text{—},\ \text{or}$$

$$\text{—}SO_2CH_2CH_2\text{—},$$

wherein

R has the same meaning as above;

Q is a photographically useful group, and l, m, and n are each independently 0 or 1.

Preferred embodiments of the photographically useful component containing monomers of formula (II) are explained in greater detail in the following description.

R represents hydrogen atom or an alkyl group having from 1 to 6 carbon atoms such as methyl group, ethyl group, n-propyl group, iso-propyl group, sec-butyl group, tert-butyl group, tert-amyl group, or n-hexyl group. R preferably is a hydrogen atom, a methyl group, or an ethyl group.

Y represents

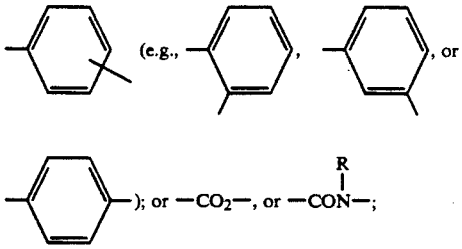

$$\text{—}C_6H_4\text{—}\ (\text{e.g., } \text{—}C_6H_4\text{—},\ \text{—}C_6H_4\text{—},\ \text{or}\ \text{—}C_6H_4\text{—});\ \text{or}\ \text{—}CO_2\text{—},\ \text{or}\ \text{—}CON(R)\text{—};$$

and is preferably

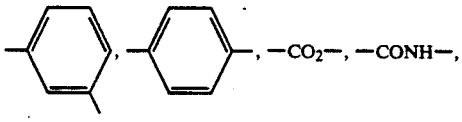

$$\text{—}C_6H_4\text{—},\ \text{—}C_6H_4\text{—},\ \text{—}CO_2\text{—},\ \text{—}CONH\text{—},$$

where R is selected from the group as mentioned above; for example, $$\text{—}CONH\text{—},\ \text{—}CON(CH_3)\text{—},\ \text{—}CON(C_2H_5)\text{—},$$

$$\text{—}CON(C_3H_{7\text{-}n})\text{—},\ \text{—}CON(C_4H_{9\text{-}n})\text{—},\ \text{or}\ \text{—}CON(C_6H_{13\text{-}n})\text{—},$$

and is preferably:

$$\text{—}CON(CH_3)\text{—}\ \text{or}\ \text{—}CON(C_2H_5)\text{—}.$$

L represents a divalent bonding group having from 1 to 12 carbon atoms, for example, an alkylene group such as methylene group, ethylene group, methylmethylene group, dimethylmethylene group, trimethylene group, tetramethylene group, pentamethylene group, hexamethylene group, octamethylene group, or decamethylene group; or an arylene group such as o-phenylene group, m-phenylene group, p-phenylene group, or naphthylene group; or $$\text{—}A\text{—}N(R)CO\text{—}B\text{—}$$

(in which R has the same meaning as above, and A and B represent an alkylene group having from 1 to 10 carbon atoms or an arylene group having from 6 to 10 carbon atoms), such as $$\text{—}CH_2NHCOCH_2\text{—},$$

$$\text{—}CH_2NHCOCH_2CH_2\text{—},$$

$$\text{—}CH_2CH_2NHCOCH_2\text{—},$$

$$\text{—}CH_2CH_2NHCOCH_2CH_2\text{—},$$

$$CH_2CH_2CH_2NHCOCH_2CH_2\text{—},$$

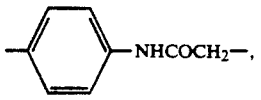

$$\text{—}C_6H_4\text{—}NHCOCH_2\text{—},$$

-continued

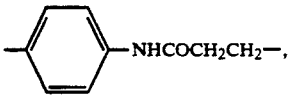

$-CH_2\overset{CH_3}{\overset{|}{N}}COCH_2CH_2-$, or $-A-CO_2-B-$ (in which R, A, and B have the same meaning as above), such as:

$-CH_2OCOCH_2-$, $-CH_2OCOCH_2CH_2-$, $-CH_2CH_2OCOCH_2-$, $-CH_2CH_2OCOCH_2CH_2-$, $-CH_2CH_2CH_2OCOCH_2CH_2-$,

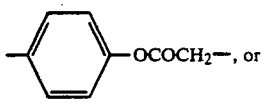

or

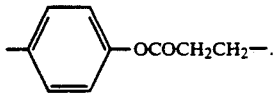

A part of the hydrogen atoms in said alkylene group and arylene group may, optionally, be substituted by an aryl group (such as phenyl or tolyl), nitro, hydroxyl, cyano, alkoxy (such as methoxy), an aryloxy (such as phenoxy), an alkylcarbonyloxy (such as acetoxy), an arylcarbonyloxy (such as benzoyloxy), an alkylcarbonylamino (such as acetylamino), an arylcarbonylamino (such as benzoylamino), a carbamoyl group, an alkylcarbamoyl group (such as a methylcarbamoyl or ethylcarbamoyl), a dialkylcarbamoyl group (such as dimethylcarbamoyl), an arylcarbamoyl group (such as phenylcarbamoyl), an alkylsulfonyl group (such as methylsulfonyl), an arylsulfonyl group (such as phenylsulfonyl), an alkylsulfonamido group (such as methanesulfonamido), an arylsulfonamido group (such as phenylsufonamido), a sulfamoyl group, an alkylsulfamoyl group (such as ethylsulfamoyl), a dialkylsulfamoyl group (such as dimethylsufamoyl), an arylsulfamoyl group, carboxyl, alkoxycarbonyl group (such as methoxycarbonyl), a halogen atom (such as fluorine, chlorine, bromine, iodine), etc.

L is preferably a methylene group, ethylene group, methylmethylene group, dimethylmethylene group, trimethylene group, tetramethylene group, pentamethylene group, m-phenylene group, p-pheneylene group, $-CH_2NHCOCH_2-$, $-CH_2NHCOCH_2CH_2-$, $-CH_2OCOCH_2CH_2-$, or $-CH_2CH_2OCOCH_2CH_2-$.

X represents —O—, —CO—, $-CO_2-$, $-SO_2-$, $-\overset{R}{\overset{|}{C}}ON-$ (such as $-CONH$, $-\overset{CH_3}{\overset{|}{C}}ON-$), $-\overset{R}{\overset{|}{N}}C\overset{R}{\overset{|}{O}}N-$ (such as $-NHCONH-$, $-\overset{CH_3}{\overset{|}{N}}-CO-\overset{CH_3}{\overset{|}{N}}-$), -continued $-SO_2\overset{R}{\overset{|}{N}}-$ (such as $-SO_2\overset{CH_3}{\overset{|}{N}}-$), $-\overset{R}{\overset{|}{N}}CO_2-$ (such as $-NHCO_2-$, $-\overset{CH_3}{\overset{|}{N}}CO_2-$, $-\overset{C_2H_5}{\overset{|}{N}}CO_2-$), $-COCH_2CH_2-$, $-OCOCH_2CH_2-$, $-\overset{R}{\overset{|}{N}}COCH_2CH_2-$, $-SO_2CH_2CH_2-$, or $-OSO_2CH_2CH_2-$.

where R has the same meaning as above, and preferably is —O—, —CO—, $-CO_2-$, $-SO_2-$, —CONH—, —NHCONH—, $-NHCO_2-$, $-NHCOCH_2CH_2-$, or $-SO_2CH_2CH_2-$.

Q represents a photographically useful group.

Q in formula (II) may represent a residue derived from an ultraviolet absorbent. Examples of such components are described in U.S. Pat. Nos. 4,178,303, 4,207,253, and 4,431,726. Ultra-violet absorbing groups UV-1 to UV-7 are preferred:

UV-1

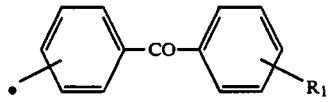

UV-2

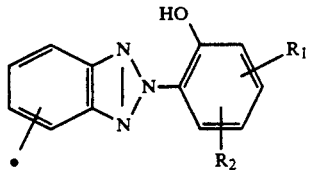

UV-3

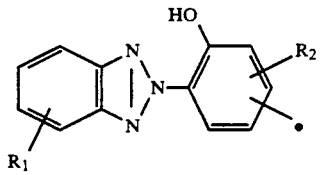

UV-4

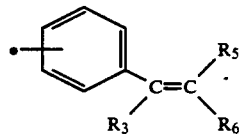

UV-5

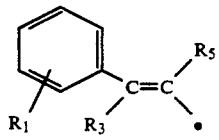

UV-6

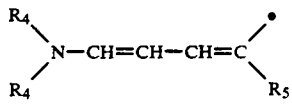

-continued

UV-7

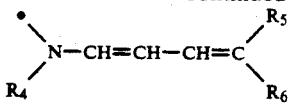

In the above UV structures, $R_1$ and $R_2$ each independently represents a hydrogen atom or a substituent which is conventional and well known in a yellow coupler group, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, or thiocyano group. $R_3$ represents an aryl group, a substituted aryl group or a heterocyclic group. $R_4$ represents a hydrogen atom, an alkyl group containing 1 to 4 carbon atoms, a hydroxyalkyl group containing from 1 to 4 carbon atoms (such as hydroxymethyl group or hydroxyethyl group), or a sulfoalkyl group containing from 1 to 4 carbon atoms. $R_5$ and $R_6$ each independently represents a cyano group, an aryl group (such as phenyl or tolyl), an alkyl group (such as methyl, ethyl, butyl, or hexyl), an alkoxycarbonyl group (such as an ethoxycarbonyl or propoxycarbonyl), an arylsulfonyl group (such as phenylsulfonyl), or an alkylsulfonyl group (such as methylsulfonyl).

Preferred examples of photographically useful components that are UV filter dyes are illustrated in Table I:

TABLE I

I-1

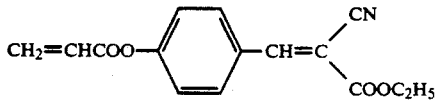

I-2

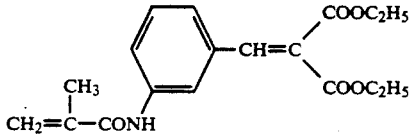

I-3

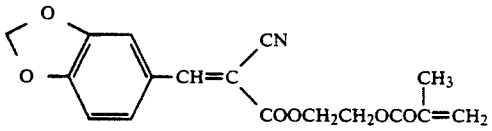

I-4

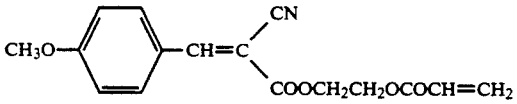

I-5

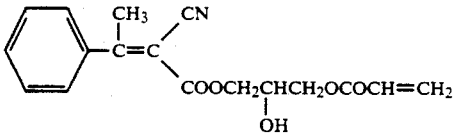

I-6

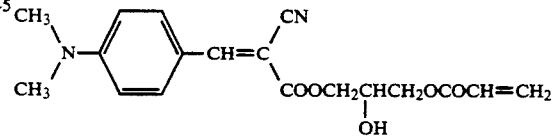

I-7

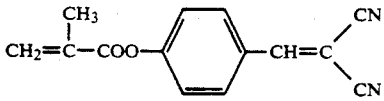

I-8

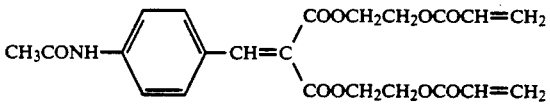

I-9

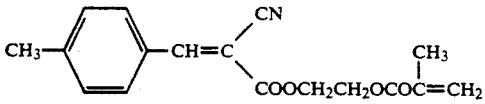

I-10

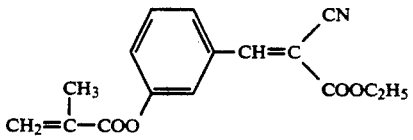

I-11

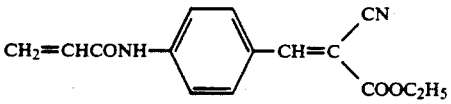

I-12

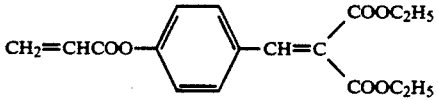

I-13

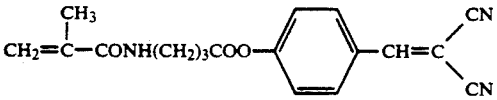

I-14

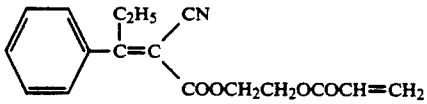

I-15

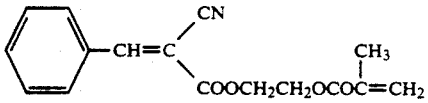

I-16

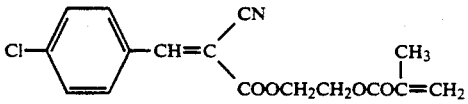

TABLE I-continued
I-17
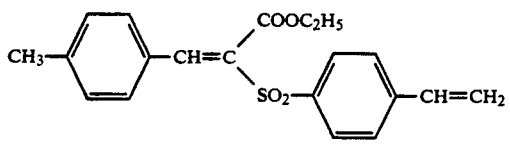
I-18
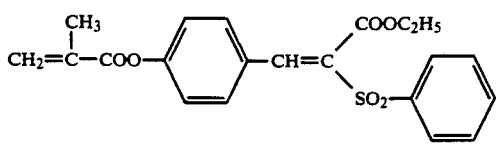
I-19
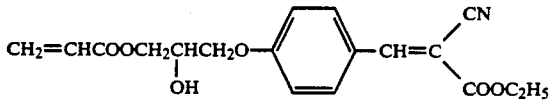
I-20
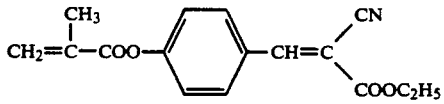
I-21
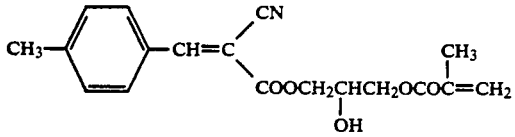
I-22
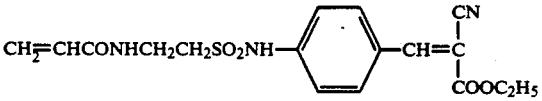
I-23
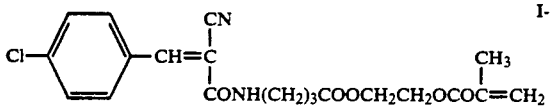
I-24
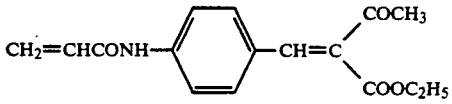
I-25
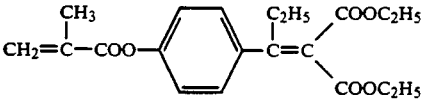
I-26
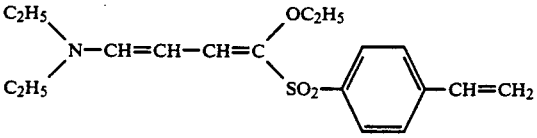
I-27
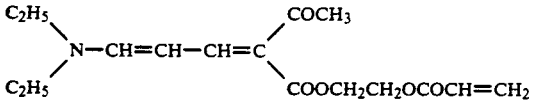
I-28
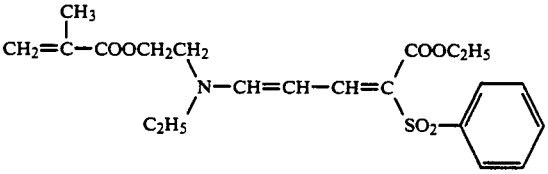
I-29
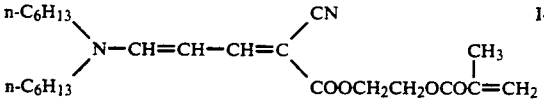
I-30
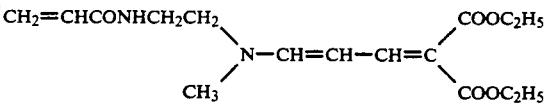
I-31
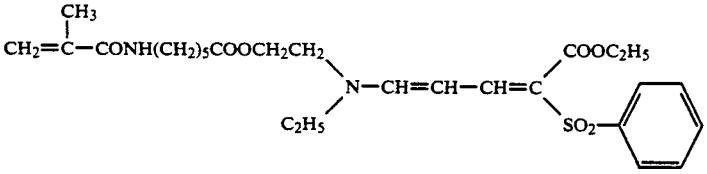
I-32
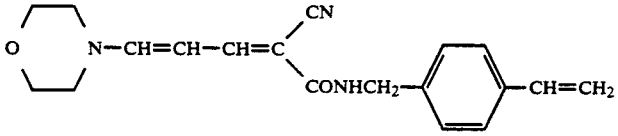
I-33
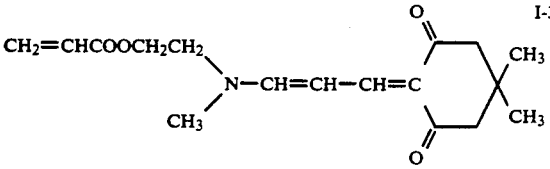
I-34
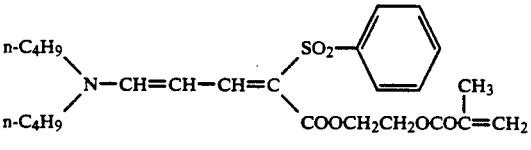
I-35
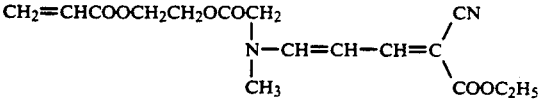
I-36
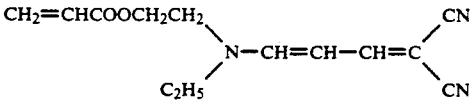

TABLE I-continued
I-37
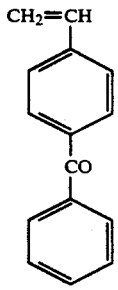
I-38
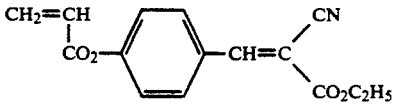
I-39
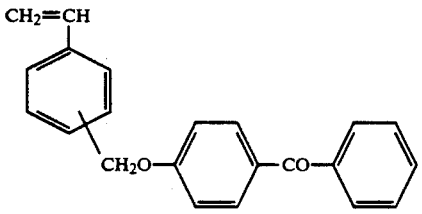
I-40
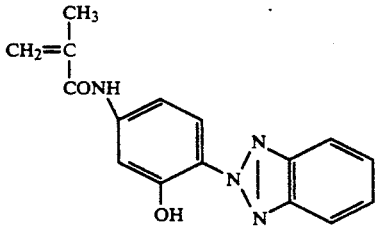
I-41
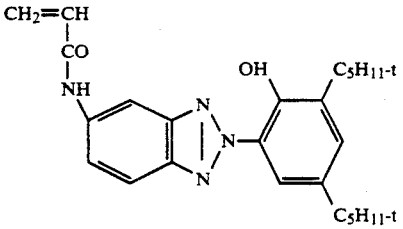
I-42
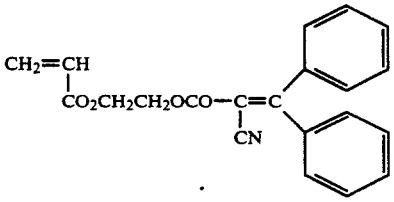
I-43
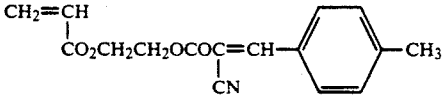
I-44
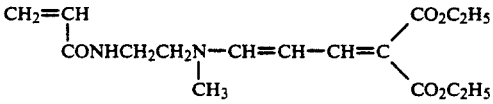
I-45
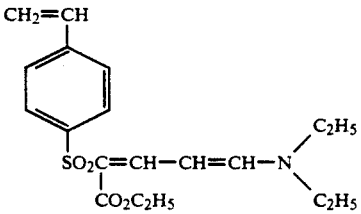
I-46
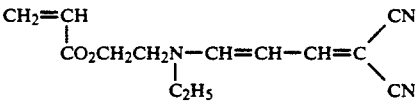
I-47
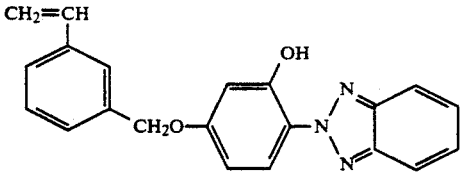
I-48
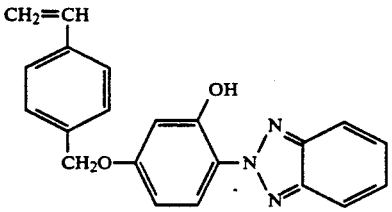
I-49
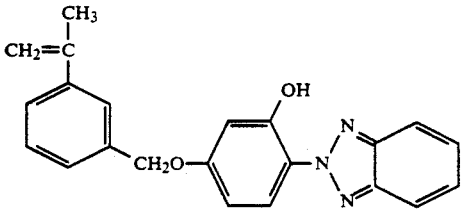
I-50
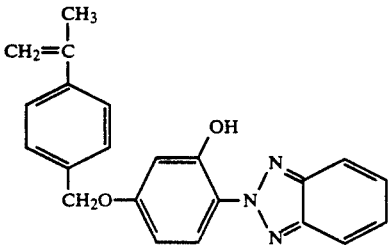

TABLE I-continued

| | |
|---|---|
| I-51 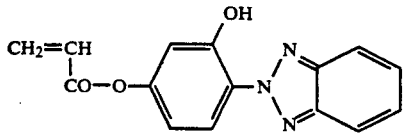 | I-52 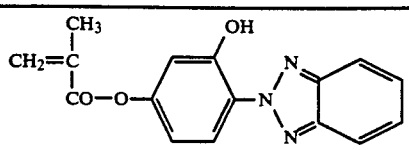 |

Q in formula (II) may represent a residue derived from a visible dye. Preferred dyes are triarylmethane-type, azo-type, anthraquinone-type, merocyanine-type, oxonol-type, arylidene-type, and styryl-type. Preferred examples of photographically useful components that are visible filter dyes are illustrated in Table II:

TABLE II

| | |
|---|---|
| II-1 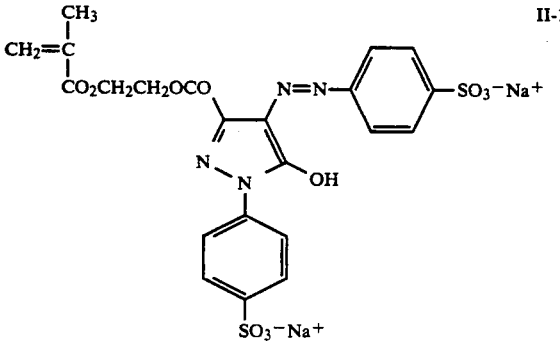 | II-2 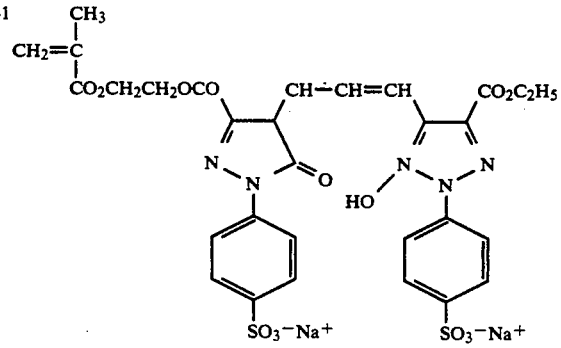 |
| II-3 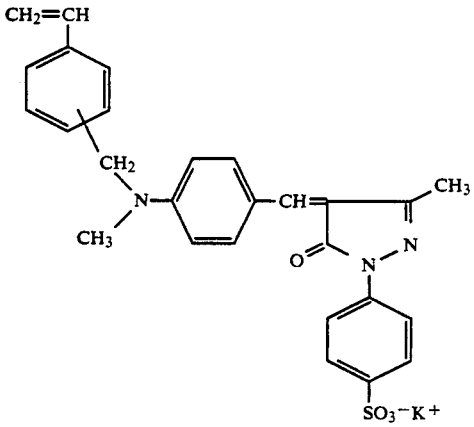 | II-4 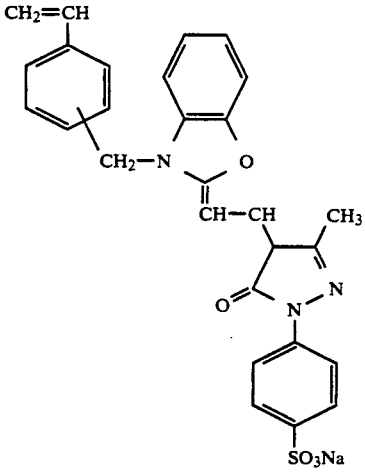 |
| II-5 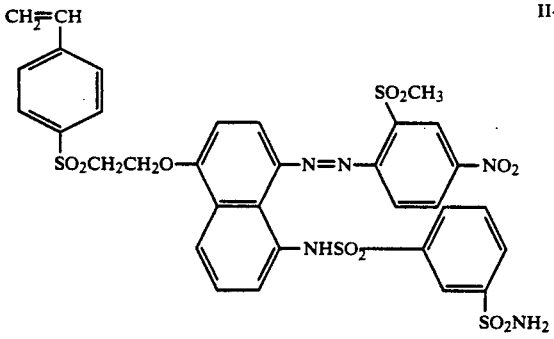 | II-6 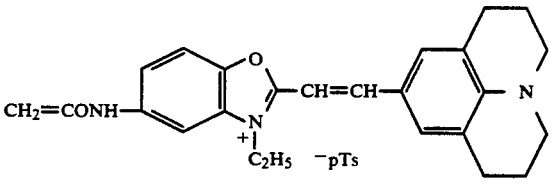 |
| II-7 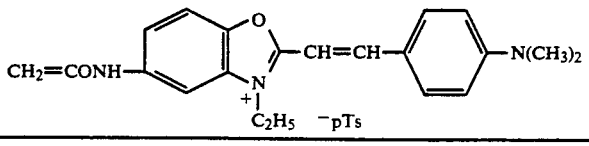 | |

Preferred examples of ethenic monomers for making loadable latexes are described in U.S. Pat. Nos.

4,199,363 (see examples described inclusively from line 25 of column 7 through line 46 of column 12), 4,214,047 (see examples described inclusively from line 3 of column 7 through line 18 of column 12), 4,247,6273 (see examples described inclusively from line 1 of column 7 through line 9 of column 12), and 4,304,769 (see examples described inclusively from line 45 of column 7 through line 2 of column 13). Other preferred ethenic monomer examples are cited in these patents in U.S. Pat. Nos. 2,933,734, 3,024,221, and 3,506,707. All of these cited preferred examples are disclosed and included herein by reference.

Other preferred examples of photographically useful components that are monomers and comonomers for making solubilizing or loadable latexes or for making copolymers or latexes incorporating any of the other photographically useful monomers described in formula (I) include, but are not restricted to, the structures illustrated in Table III:

TABLE III

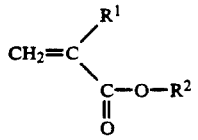

| | $R^1$ | $R^2$ |
|---|---|---|
| III-1 | H | $CH_3$ |
| III-2 | $CH_3$ | $CH_3$ |
| III-3 | H | $CH_3CH_2$ |
| III-4 | $CH_3$ | $CH_3CH_2$ |
| III-5 | H | $C_4H_9$-n |
| III-6 | $CH_3$ | $C_4H_9$-n |
| III-7 | H | $CH_2CH(CH_2CH_3)C_4H_9$-n |
| III-8 | $CH_3$ | $CH_2CH(CH_2CH_3)C_4H_9$-n |
| III-9 | H | $CH_2CH(CH_3)_2$ |
| III-10 | $CH_3$ | $CH_2CH(CH_3)_2$ |
| III-11 | H | $CH(CH_3)_2$ |
| III-12 | $CH_3$ | $CH(CH_3)_2$ |
| III-13 | H | $CH_2CH_2CH_3$ |
| III-14 | $CH_3$ | $CH_2CH_2CH_3$ |

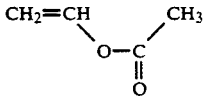

III-15

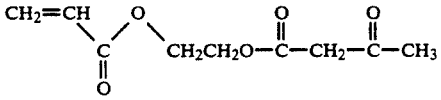

III-16

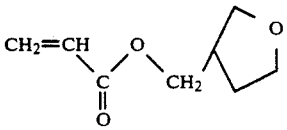

III-17

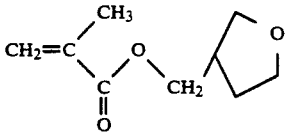

III-18

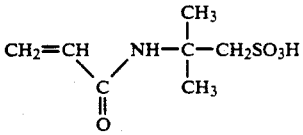

III-19

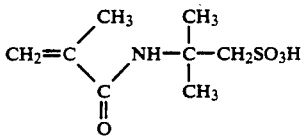

III-20

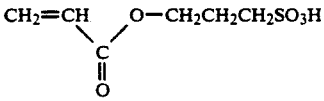

III-21

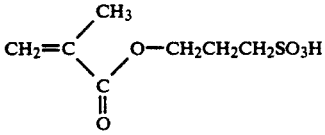

III-22

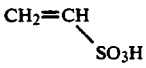

III-23

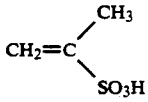

III-24

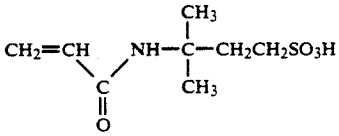

III-25

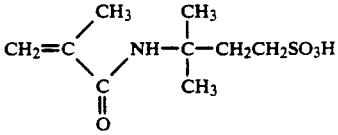

III-26

TABLE III-continued
III-27
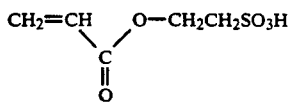
III-28
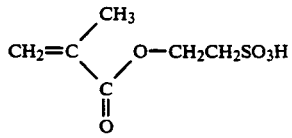
III-29
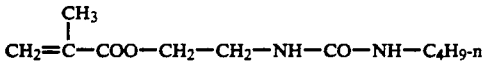
III-30
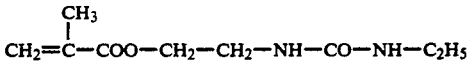
III-31
III-32
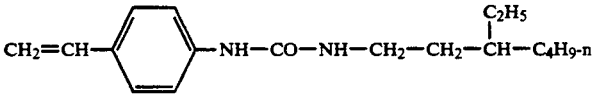
III-33
III-34
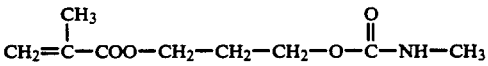
III-35
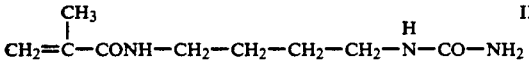
III-36
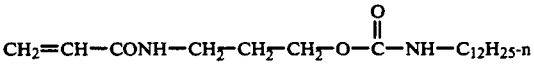
III-37
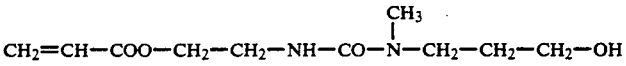
III-38
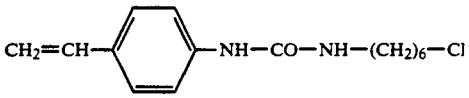
III-39
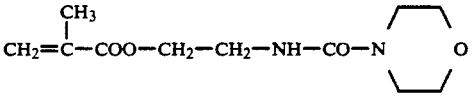
III-40
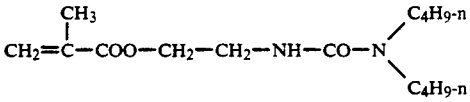
III-41
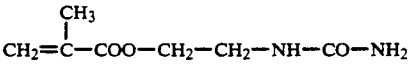
III-42
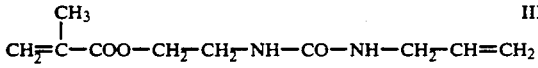
III-43
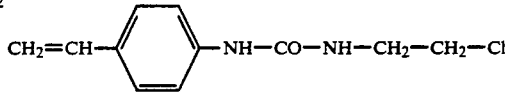
III-44
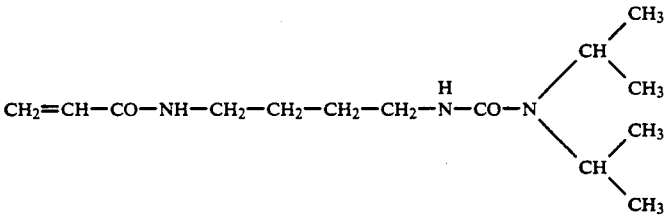
III-45
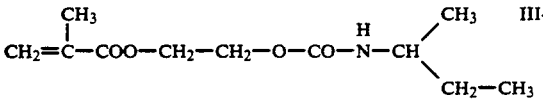
III-46
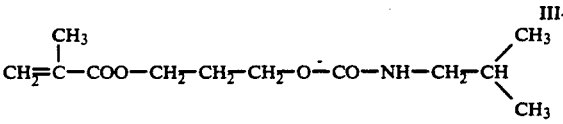
III-47
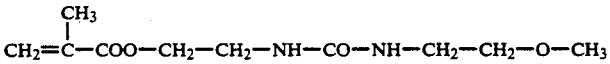
III-48
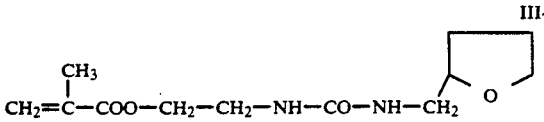
III-49
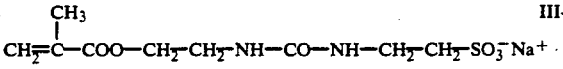
III-50
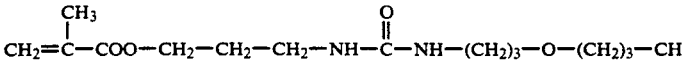

TABLE III-continued
III-51
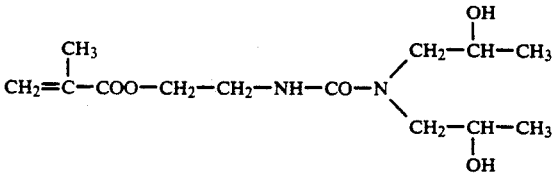
III-52
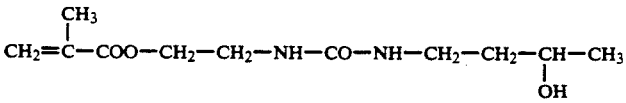
III-53
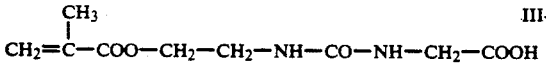
III-54
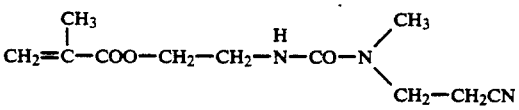
III-55
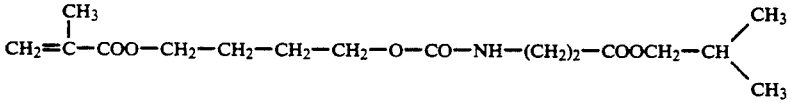
III-56
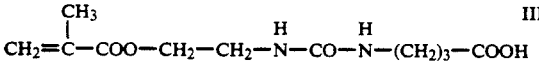
III-57
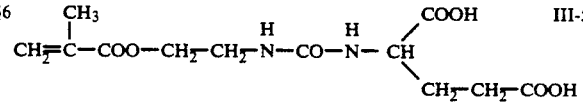
III-58
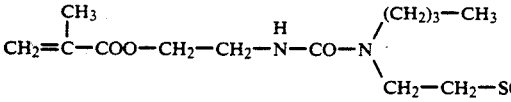
III-59
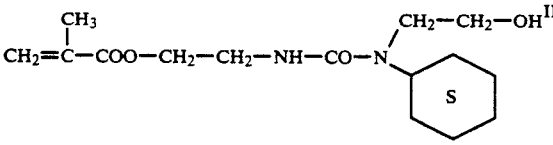
III-60
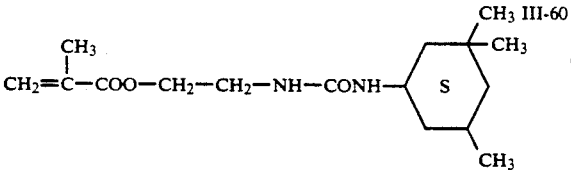
III-61
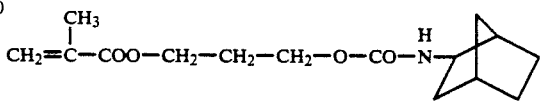
III-62
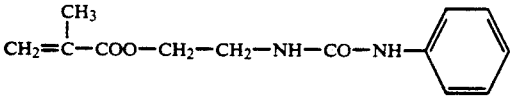
III-63
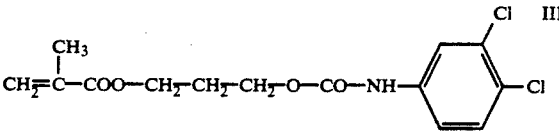
III-64
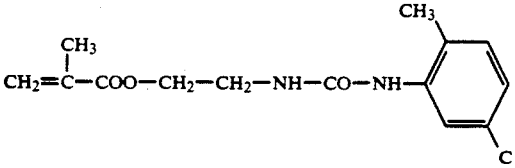
III-65
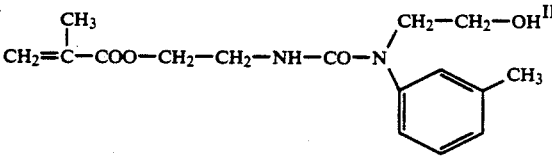
III-66
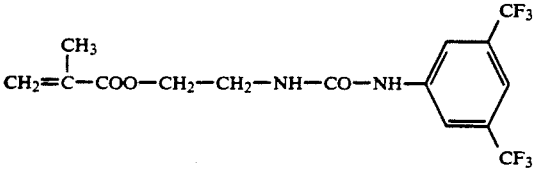
III-67
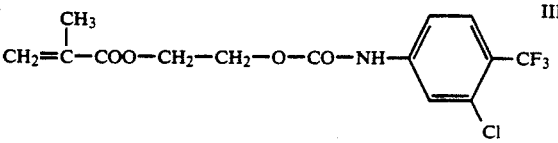

TABLE III-continued
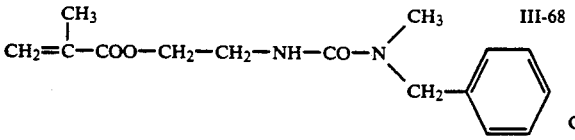
III-68
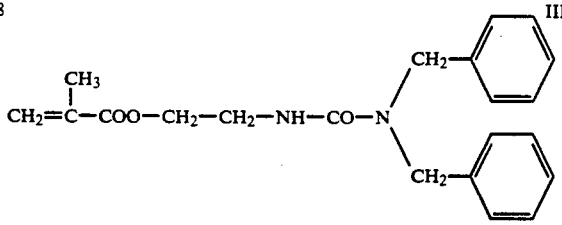
III-69
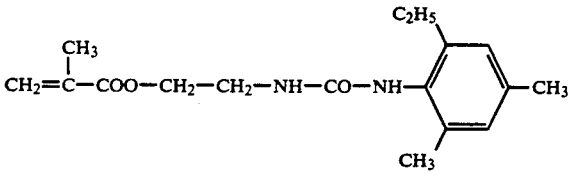
III-70
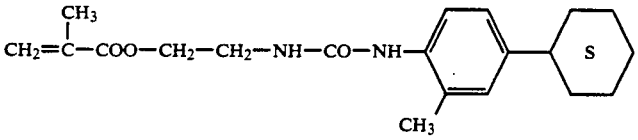
III-71
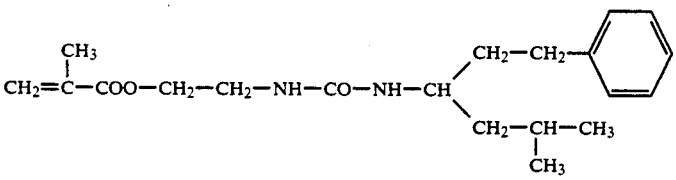
III-72
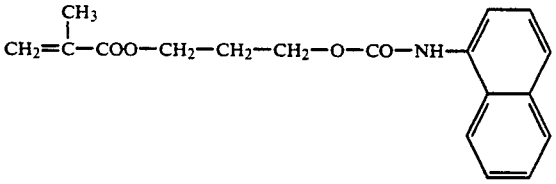
III-73
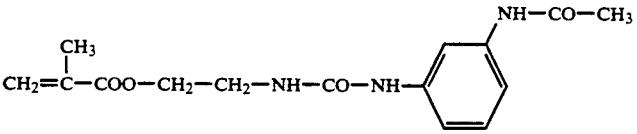
III-74
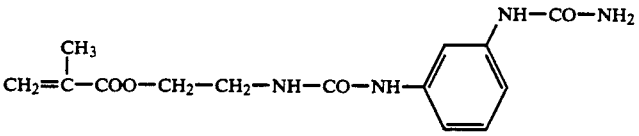
III-75
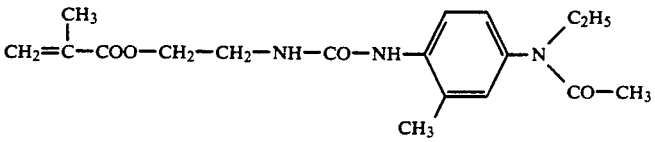
III-76

TABLE III-continued
III-77
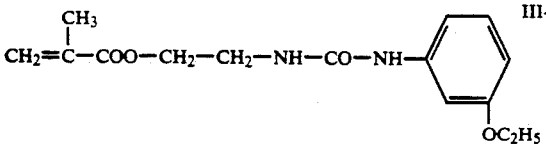
III-78
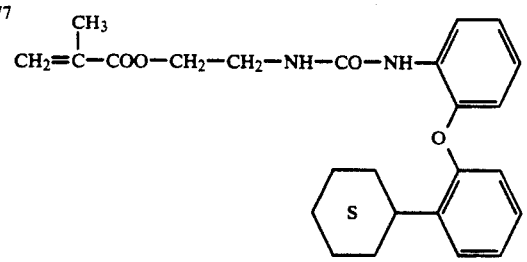
III-79
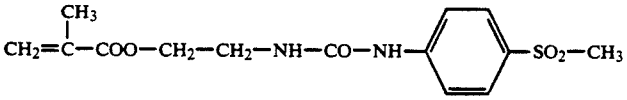
III-80
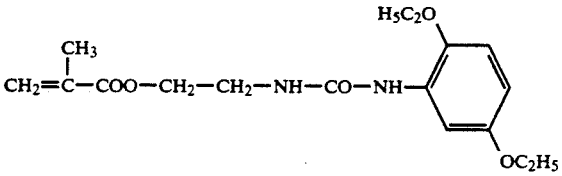
III-81
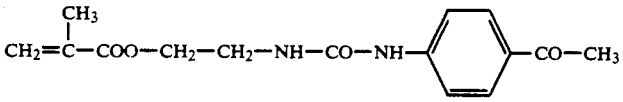
III-82
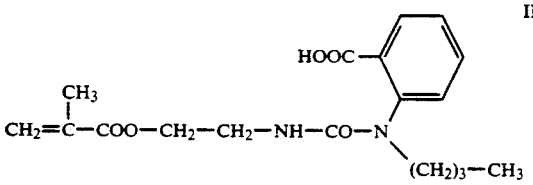
III-83
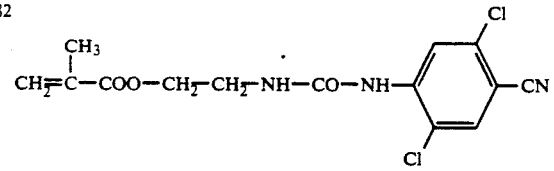
III-84
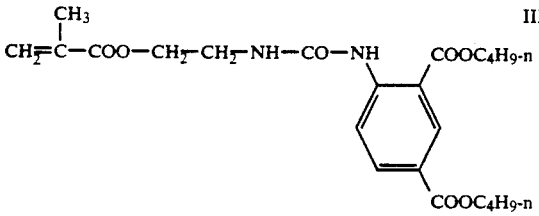
III-85
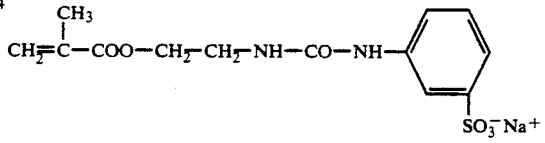
III-86
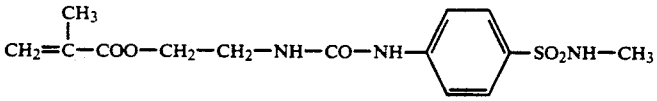
III-87
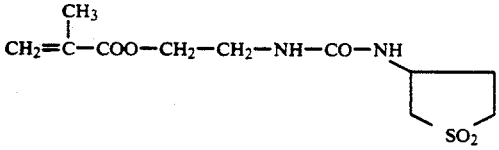
III-88
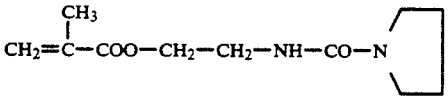
III-89
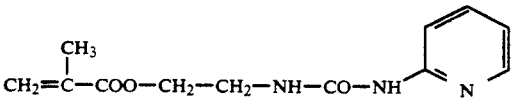
III-90
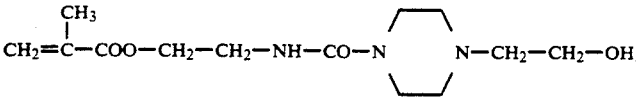

TABLE III-continued
III-91
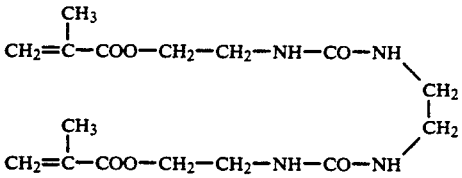
III-92
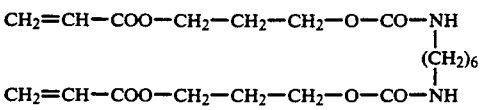
III-93
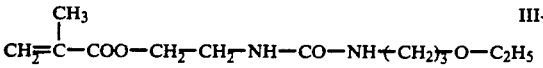
III-94
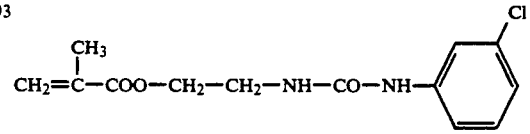
III-95
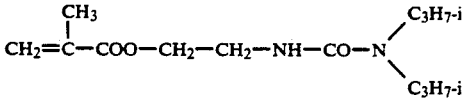
III-96
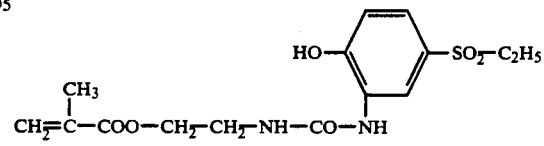
III-97
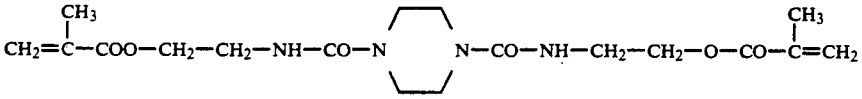
III-98
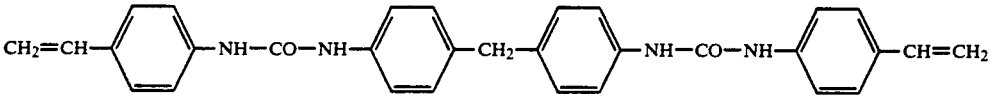
III-99
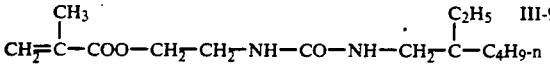
III-100
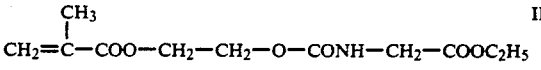
II-101
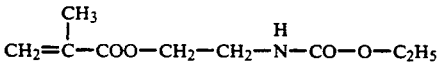
III-102
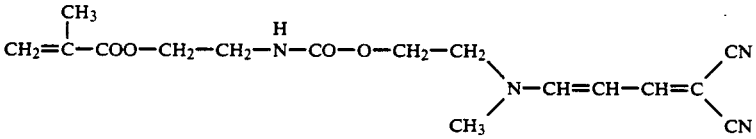
III-103
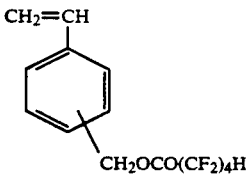
III-104
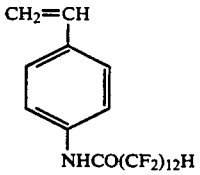
III-105
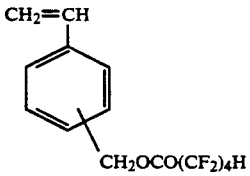
III-106
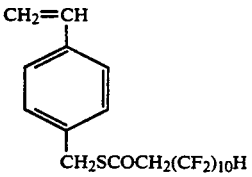
III-107
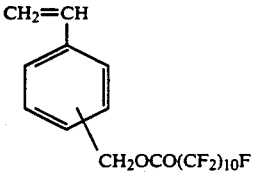
III-108
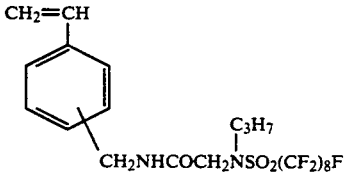

TABLE III-continued
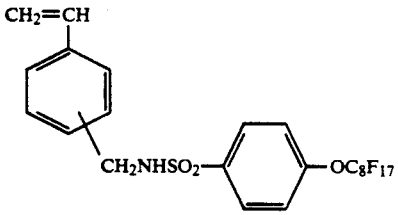
III-109
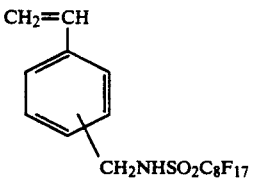
III-110
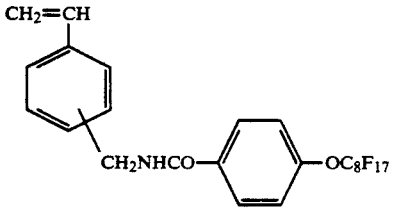
III-111
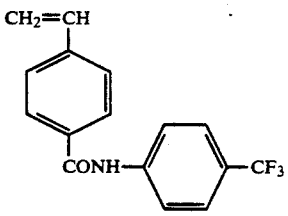
III-112
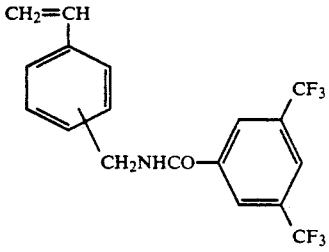
III-113
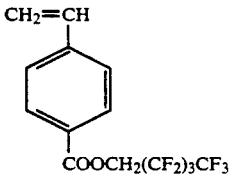
III-114
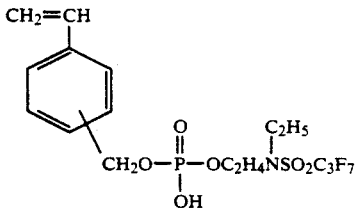
III-115
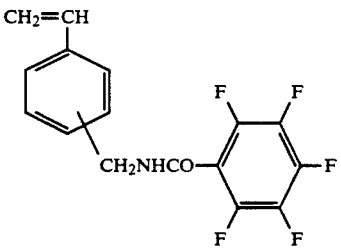
III-116
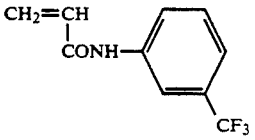
III-117
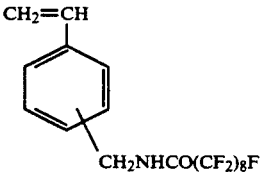
III-118
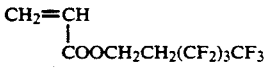
III-119
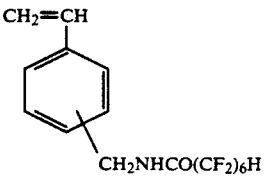
III-120

TABLE III-continued
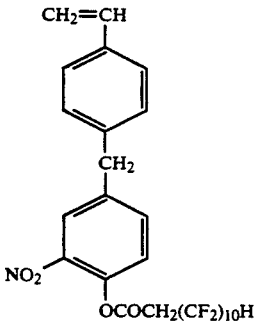
III-121
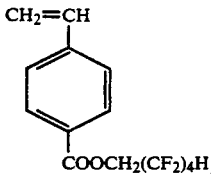
III-122
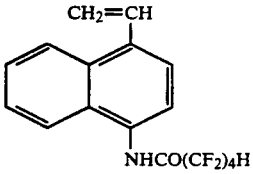
II-123
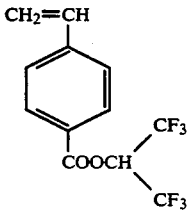
III-124
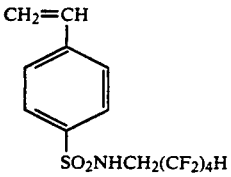
III-125
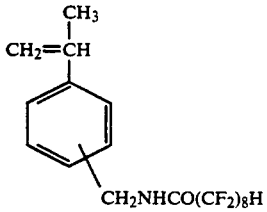
III-126
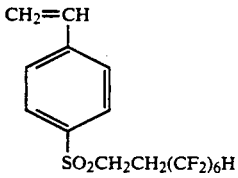
III-127
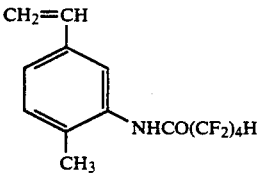
III-128
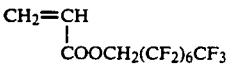
III-129
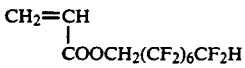
III-130
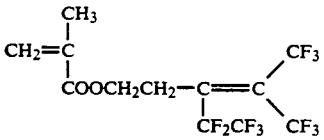
III-131
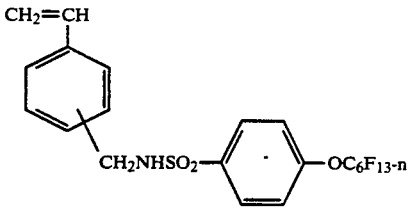
III-132
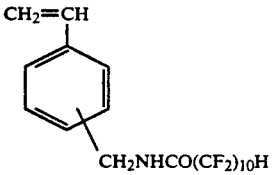
III-133
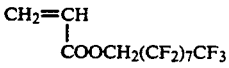
III-134
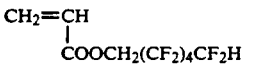
III-135
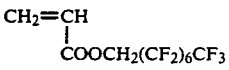
III-136

TABLE III-continued

| | |
|---|---|
| $CH_2{=}C(CH_3)COOCH_2(CF_2)_7CF_3$ | III-137 |
| $CH_2{=}CH\,COOCH_2(CF_2)_6CF_2H$ | III-138 |

Examples of photographically useful components that are monomers and comonomers for making mordants include, but are not restricted to, the structures illustrated in Table IV:

TABLE IV

IV-1

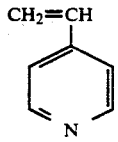

IV-2

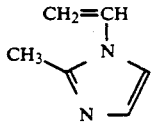

IV-3

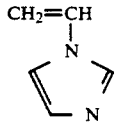

IV-4

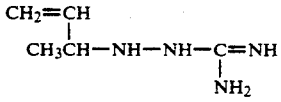

IV-5

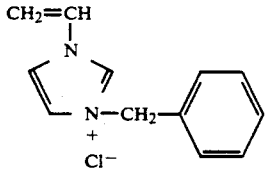

IV-6

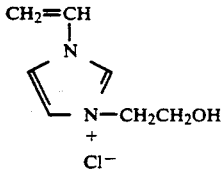

IV-7

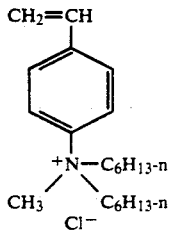

TABLE IV-continued

IV-8

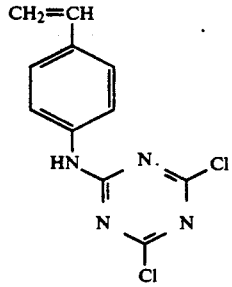

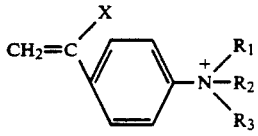

| | X | $R_1$ | $R_2$ | $R_3$ |
|---|---|---|---|---|
| IV-9 | H | $CH_3$ | $CH_3$ | $CH_3$ |
| IV-10 | $CH_3$ | $CH_3$ | $CH_3$ | $CH_3$ |
| IV-11 | H | $CH_3$ | $CH_3$ | benzyl |
| IV-12 | $CH_3$ | $CH_3$ | $CH_3$ | benzyl |
| IV-13 | H | ethyl | ethyl | ethyl |
| IV-14 | $CH_3$ | ethyl | ethyl | ethyl |
| IV-15 | H | n-propyl | n-propyl | n-propyl |
| IV-16 | $CH_3$ | n-propyl | n-propyl | n-propyl |
| IV-17 | H | n-butyl | n-butyl | n-butyl |
| IV-18 | $CH_3$ | n-butyl | n-butyl | n-butyl |
| IV-19 | H | n-pentyl | n-pentyl | n-pentyl |
| IV-20 | $CH_3$ | n-pentyl | n-pentyl | n-pentyl |
| IV-21 | H | n-hexyl | n-hexyl | n-hexyl |
| IV-22 | $CH_3$ | n-hexyl | n-hexyl | n-hexyl |
| IV-23 | H | n-octyl | n-octyl | n-octyl |
| IV-24 | $CH_3$ | n-octyl | n-octyl | n-octyl |
| IV-25 | H | $CH_3$ | $CH_3$ | n-$C_{14}H_{29}$ |
| IV-26 | $CH_3$ | $CH_3$ | $CH_3$ | n-$C_{14}H_{29}$ |
| IV-27 | H | ethyl | ethyl | n-docecyl |
| IV-28 | $CH_3$ | ethyl | ethyl | n-dodecyl |
| IV-29 | H | $CH_3$ | $CH_3$ | n-$C_{18}H_{37}$ |
| IV-30 | $CH_3$ | $CH_3$ | $CH_3$ | n-$C_{18}H_{37}$ |
| IV-31 | H | iso-pentyl | iso-pentyl | iso-pentyl |
| IV-32 | $CH_3$ | iso-pentyl | iso-pentyl | iso-pentyl |
| IV-33 | H | n-heptyl | n-heptyl | n-heptyl |
| IV-34 | $CH_3$ | n-heptyl | n-heptyl | n-heptyl |

Q in formula (II) may represent a residue derived from a development inhibiting agent, and examples of such agents are described in U.S. Pat. Nos. 3,227,554, 3,384,657, 3,615,506, 3,617,291, and 3,733,201. Residues of the following structures (DI-1 to DI-6), which are described, for example, in Japanese Patent Application (OPI) No. 145135/79, are preferred:

DI-1

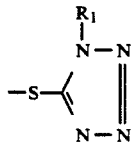

DI-2

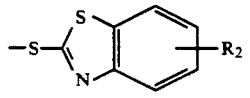

-continued

DI-3

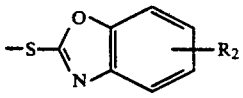

DI-4

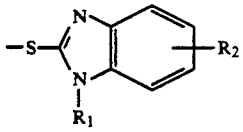

DI-5

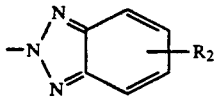

DI-6

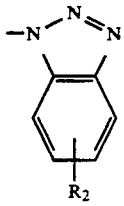

In the above, $R_1$ represents a hydrogen atom, an alkyl group containing 1 to 6 carbon atoms, phenyl group, or a substituted phenyl group; $R_2$ represents a hydrogen atom, a halogen atom, an alkyl group containing from 1 to 4 carbon atoms, or nitro group.

Preferred examples of photographically useful components that are monomers and comonomers for making development inhibiting agents are illustrated in Table V:

TABLE V

V-1

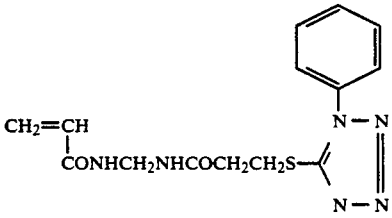

V-2

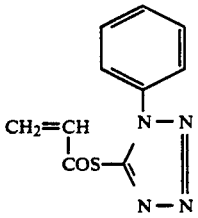

V-3

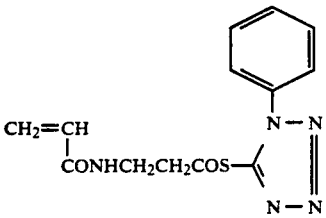

TABLE V-continued

V-4

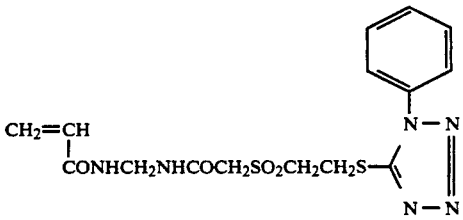

V-5

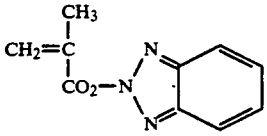

V-6

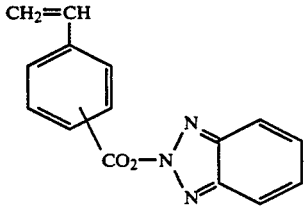

V-7

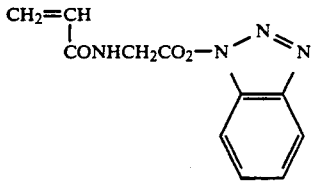

V-8

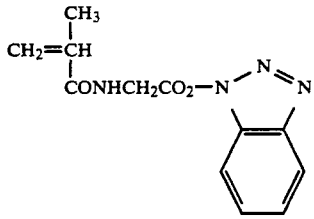

V-9

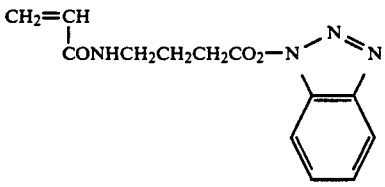

V-10

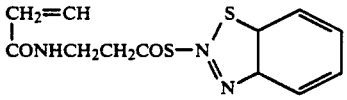

V-11

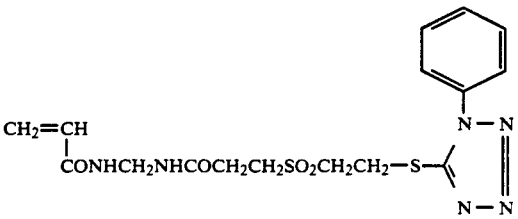

TABLE V-continued

V-12

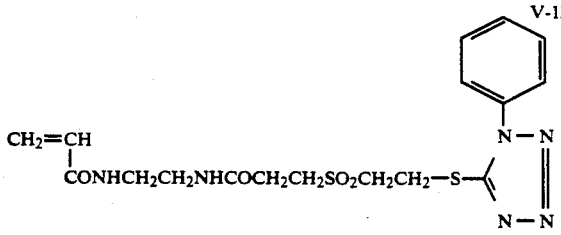

V-13

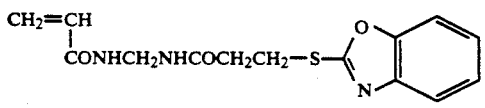

V-14

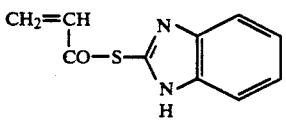

V-15

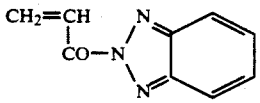

V-16

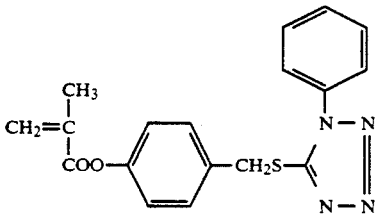

Q in formula (II) may represent a residue derived from a developing agent, and examples of such agents are described in U.S. Pat. Nos. 2,193,015, 2,108,243, 2,289,367, 2,304,953 2,592,364, 2,743,279, 2,751,297, 2,753,265, 2,772,282, 3,656,950, and 3,658,525.

Residues of the following structures (DA-1 to DA-6), which are derived from aminophenols, phenylenediamines, hydroquinones, and pyrazolidones as described, for example, in Japanese Patent Application (OPI) No. 145135/79, are preferred:

DA-1

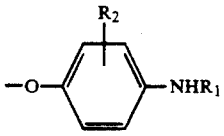

-continued

DA-2

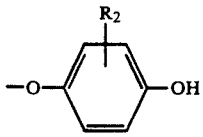

DA-3

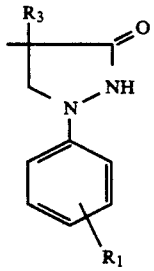

DA-4

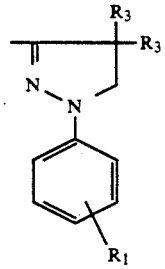

DA-5

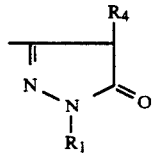

DA-6

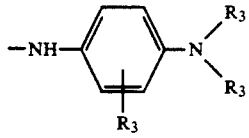

In the above, $R_1$ represents a hydrogen atom, an alkyl group containing 1 to 6 carbon atoms, phenyl group, or a substituted phenyl group; $R_2$ represents a hydrogen atom, a halogen atom, an alkyl group containing from 1 to 4 carbon atoms, or nitro group; $R_3$ represents a hydrogen atom, an alkyl group containing 1 to 4 carbon atoms, a hydroxyalkyl group containing from 1 to 4 carbon atoms (such as hydroxymethyl group or hydroxyethyl group), or a sulfoalkyl group containing from 1 to 4 carbon atoms; $R_4$ represents an alkyl group containing from 1 to 20 carbon atoms or an aryl group containing 6 to 20 carbon atoms.

Preferred examples of photographically useful components that are monomers and comonomers for making developing agents are illustrated in Table VI:

TABLE VI
VI-1
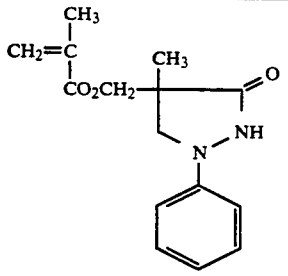
VI-2
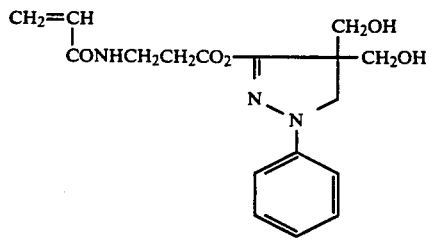
VI-3
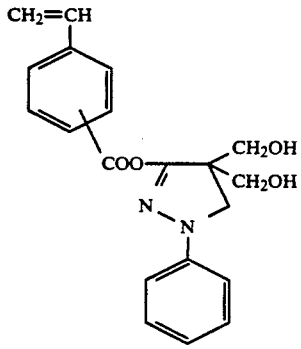
VI-4
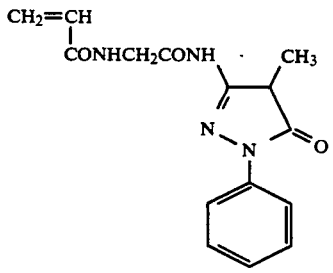
VI-5
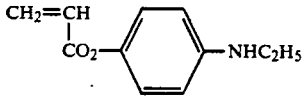
VI-6
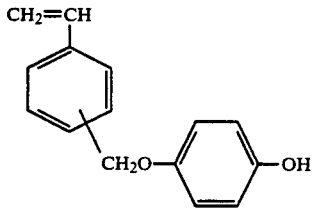
VI-7
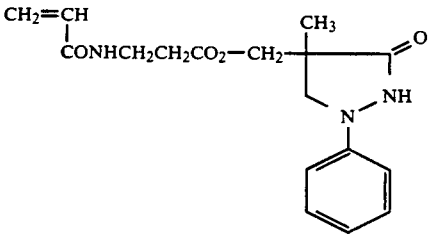
VI-8
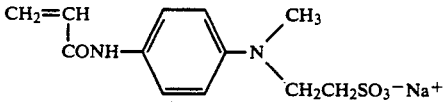
VI-9
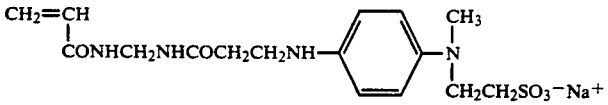
VI-10
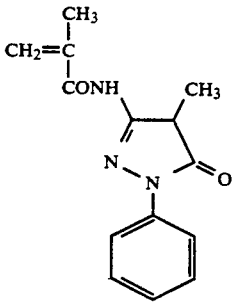
Q in formula (II) may represent a residue derived from a bleach inhibiting group. Groups of the following structures (BI-1 to BI-4), which are derived from bleaching inhibitors are especially preferred (as described in Japanese Patent Application (OPI) No. 145135/79):

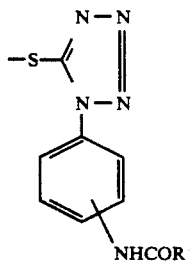

BI-1

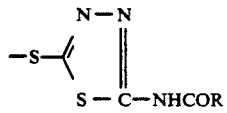

BI-2

-continued

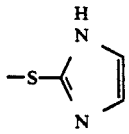

BI-4

In the above, R represents an alkyl group containing 1 to 20 carbon atoms or an aryl group containing 6 to 20 carbon atoms.

Preferred examples of photographically useful components that are monomers and comonomers for making bleach inhibiting agents are illustrated in Table VII:

TABLE VII

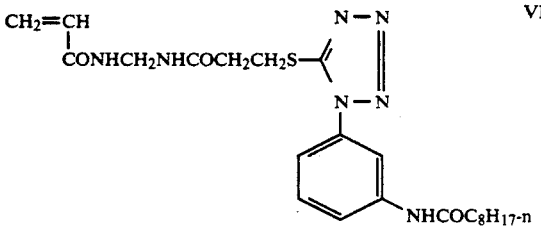

VII-1

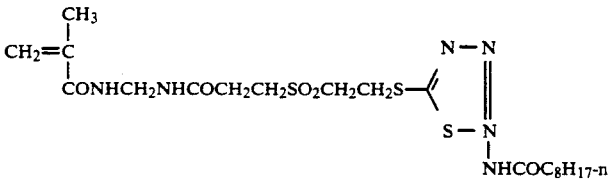

VII-2

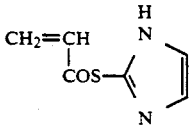

VII-3

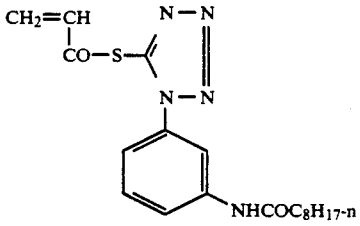

VII-4

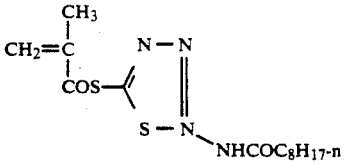

VII-5

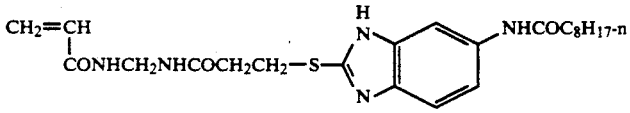

VII-6

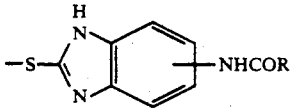

BI-3

Q may represent a coupler group, capable of forming a cyan dye by coupling with an aromatic primary amine developing agent. Preferred cyan coupling groups are of the phenol-type (formula C-1) or the naphthol-type (formulae C-2 and C-3) or of the type C-4; the asterisk mark indicates the position of the bond to X in structure II:

C-1

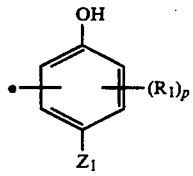

C-2

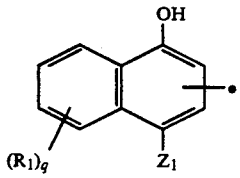

C-3

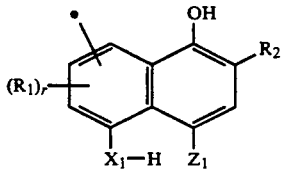

C-4

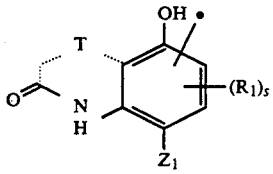

In formulae C-1, C-2, C-3, and C-4:

$R_1$ has 0 to 30 carbon atoms and represents a possible substituent on the phenol ring or naphthol ring. It is an alkyl group, an alkenyl group, an alkoxy group, an alkoxycarbonyl group, a halogen atom, an alkoxycarbamoyl group, an aliphatic amido group, an alkylsulfamoyl group, an alkylsufonamido group, an alkylureido group, an arylcarbamoyl group, an arylamido group, an arylsufamoyl group, an arylsufonamido group, an arylureido group, hydroxyl group, amino group, carboxyl group, sulfo group, heterocyclic group, carbonamido group, sulfonamido group, carbamoyl group, sulfamoyl group, ureido group, acyloxy group, aliphatic oxy group, aliphatic thio group, aliphatic sulfonyl group, aromatic oxy group, aromatic thio group, aromatic sulfonyl group, sulfamoyl amino group, nitro group, or imido group.

$R_2$ represents $—CONR_3R_4$, $—NHCOR_3$, $—NHCOOR_5$, $NHSO_2R_5$, $—NHCONR_3R_4$, or $NHSO_2R_3R_4$, $R_3$ and $R_4$ each represent a hydrogen atom, aliphatic group having 1 to 30 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-tert-amylphenoxypropyl, and 2,4-di-tert-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_5$ represents an aliphatic group having from 1 to 30 carbon atoms (such as methyl, ethyl, butyl, methoxyethyl, n-decyl, n-dodecyl, and n-hexadecyl), aromatic group having from 6 to 30 carbon atoms (such as phenyl, tolyl, 4-chlorophenyl, and naphthyl), or heterocyclic group (such as 2-pyridyl, 4-pyridyl, and 2-furyl). $R_3$ and $R_4$ may join each other to form a heterocyclic ring (such as morpholine ring, piperidine ring, and pyrrolidine ring); p is an integer from 0 to 3; q and r are integers from 0 to 4; s in an integer from 0 to 2.

$X_1$ represents an oxygen atom, sulfur atom, or $R_6N<$-group, where $R_6$ represents a hydrogen atom or monovalent group. When $R_6$ represents a monovalent group, it includes, for example, an aliphatic group having from 1 to 30 carbon atoms (such as methyl, ethyl, butyl, methoxyethyl, and benzyl), aromatic group having from 6 to 30 carbon atoms (such as phenyl and tolyl), heterocyclic group having from 2 to 30 carbon atoms (such as 2-pyridyl and 2-pyrimidyl), carbonamido group having from 1 to 30 carbon atoms (such as formamido, acetamido, N-methylacetamido, toluenesulfonamido, and 4-chlorobenzenesulfonamido), imido group having from 4 to 30 carbon atoms (such as succinimido), $—OR_7$, $—SR_7$, $—COR_7$, $—CONR_7R_8$, $—COCOR_7$, $—COCOR_7R_8$, $—COOR_9$, $—COCOOR_9$, $—SO_2R_9$, $—SO_2OR_9$, $—SO_2NR_7R_8$, or $—NR_7R_8$. $R_7$ and $R_8$, which may be the same or different, each represent a hydrogen atom, aliphatic group having from 1 to 3 carbon atoms (such as methyl, ethyl, butyl, methoxyethyl, n-decyl, n-dodecyl, n-hexadecyl, trifluoromethyl, heptafluoropropyl, dodecyloxypropyl, 2,4-di-tert-amylphenoxypropyl, and 2,4-di-tert-amylphenoxybutyl), aromatic group having from 6 to 30 carbon atoms (such as phenyl, tolyl, 2-tetradecyloxyphenyl, pentafluorophenyl, and 2-chloro-5-dodecyloxycarbonylphenyl), or heterocyclic group having from 2 to 30 carbon atoms (such as 2-pyridyl, 4-pyridyl, 2-furyl, and 2-thienyl). $R_7$ and $R_8$ may join each other to form a heterocyclic ring (such as morpholine group and piperidino group). $R_9$ may include, for example, those substituents (excluding a hydrogen atom) exemplified for $R_7$ and $R_8$.

$Z_1$ represents a hydrogen atom or a group capable of coupling-off upon coupling with the oxidation product of an aromatic primary amine developing agent. Examples of such coupling-off groups (COG) include a halogen atom, aliphatic oxy group having from 1 to 30 carbon atoms (such as methoxy, ethoxy, 2-hydroxyethoxy, carboxymethyloxy, 3-carboxypropyloxy, 2-methoxyethoxycarbamoylmethoxy, 2-methanesulfonylethoxy, 2-carboxymethylthioethoxy, and triazolylmethyloxy), aromatic oxy group having from 6 to 30 carbon atoms (such as 4-pyridyloxy and 1-phenyltetrazol-5-yl-thio), heterocyclic thio group having from 2 to 30 carbon atoms (such as acetoxy, benzoyloxy, and lauroyloxy), carbaonamido group having from 1 to 30 carbon atoms (such as dichloroacetylamido, trifluoroacetamido, heptafluorobutanamido, and pentafluorobenzamido), sulfonamido group having from 1 to 30 carbon atoms (such as methanesulfonamido and toluenesulfonamido), aromatic azo group having from 6 to 30 carbon atoms (such as phenylazo, 4-chlorophenylazo, 4-methoxyphenylazo, and 4-pivaloylaminophenylazo), aliphatic oxycarbonyloxy group having from 1 to 30 carbon atoms (such as ethoxycarbonyloxy and dodecyloxycarbonyloxy), aromatic oxycarbonyloxy group having from 6 to 30 carbon atoms (such as phenoxycarbonyloxy), carbamoyloxy group having from 1 to 30 carbon atoms (such as/methylcarbamoyloxy, dodecylcarbamoyloxy, and phenylcarbamoyloxy), and heterocyclic group having from 1 to 30 carbon atoms and connecting to the active site of the coupler through a nitrogen atom (such as succinimido group, phthalimido group, hydantoinyl group, pirazolyl group, and 2-benzotriazolyl group).

T represents a group of atoms required to form a 5-, 6-, or 7-membered ring by connecting with the carbon atoms. It represents, for example

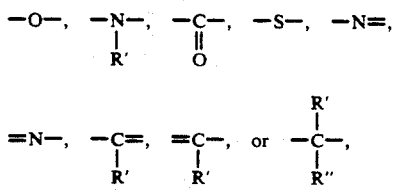

or a combination thereof. In the formulae above, R′ and R″ each represent a hydrogen atom, alkyl group, aryl group, halogen atom, alkyloxy group, alkyloxycarbonyl group, arylcarbonyl group, alkylcarbamoyl group, arylcarbamoyl group or cyano group.

The preferred substituent groups in the present invention are exemplified in the following.

$R_1$ includes a halogen atom (such as fluorine, chlorine, and bromine), aliphatic group (such as methyl, ethyl, and isopropyl), carbonamido group (such as acetamido and benzamido), and sulfonamido (such as methanesulfonamido and toluenesulfonamido).

$R_2$ includes —$CONR_3R_4$ (such as carbamoyl, ethylcarbamoyl, morpholinocarbonyl, dodecylcarbamoyl, hexadecylcarbamoyl, decyloxypropyl, dodecyloxypropyl, 2,4-di-tert-amylphenoxypropyl, and 2,4-d-tert-amylphenoxybutyl).

$X_1$ includes $R_6N<$, wherein $R_6$ is preferably —$COR_7$ (such as formyl, acetyl, trifluoroacetyl, chloroacetyl, benzoyl, pentafluorobenzoyl, and p-chlorobenzoyl), —$COOR_9$ (such as methoxycarbonyl, ethoxycarbonyl, butoxycarbonyl, dodecyloxycarbonyl, methoxyethoxycarbonyl, and phenoxycarbonyl), —$SO_2R_9$ (such as methanesulfonyl, ethanesulfonyl, butanesulfonyl, hexadecanesulfonyl, benzenesulfonyl, toluenesulfonyl, and p-chlorobenzenesulfonyl), —$CONR_7R_8$ (such as N,N-dimethyl carbamoyl, N,N-diethylcarbamoyl, N,N-dimethylcarbamoyl, N,N-diethylcarbamoyl, N,N-dibutylcarbamoyl, morpholinocarbonyl, piperidinocarbonyl, 4-cyanophenylcarbamoyl, 3,4-dichlorophenylcarbamoyl, and 4-methanesulfonylphenylcarbamoyl), and N,N-dibutylcarbamoyl), and —$SO_2NR_7R_8$ (such as N,N-dimethulsulfamoyl, N,N-diethylsulfamoyl, and N,N-dipropylsulfamoyl). Particularly preferred examples of $R_6$ are those groups represented by —$COR_7$, —$COOR_9$, and —$SO_2R_9$.

$Z_1$ includes a hydrogen atom, halogen atom, aliphatic oxy group, aromatic oxy group, heterocyclic thio group, and aromatic azo group.

$R_1$ and $Z_1$ may be substituted. Preferred substituents are aryl groups (such as phenyl), nitro group, hydroxy group, cyano group, sulfo group, an alkoxy group (such as methoxy), an aryloxy group (such as phenoxy), an acyloxy group (such as acetoxy), an acylamino group (such as aetylamino), an alkylsufonamido group (such as methanesulfonamido), an alkylsulfamoyl group, carboxyl group, an alkylcarbamoyl group (such as methylcarbamoyl), an alkoxycarbonyl group (such as methoxycarbonyl), an alkylsulfonyl group (such as methylsulfonyl), an alkylthio group (such as β-carboxyethylthio), etc. In the case that said group is substituted by two or more of said substituents, these substituents may be the same or different.

The coupler represented by the general formulae above (C-1 to C-4) may be a dimer or polymer formed by the union of monomers through a divalent or polyvalent linking group at the substituent group $R_1$, $R_2$, $X_1$, or $Z_1$. In such a case the number of carbon atoms shown for the above mentioned substituent groups is not applicable.

Preferred examples of photographically useful components that are cyan coupler groups are illustrated in Table VIII:

TABLE VIII

VIII-1

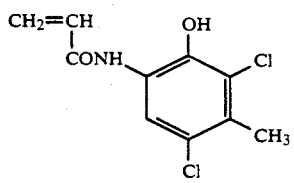

VIII-2

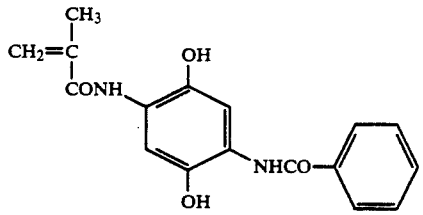

VIII-3

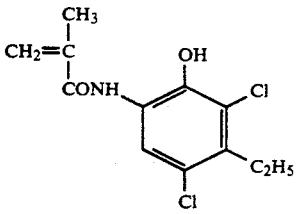

VIII-4

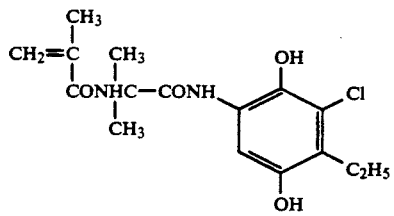

VIII-5

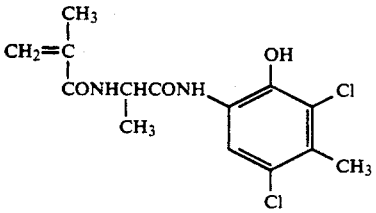

VIII-6

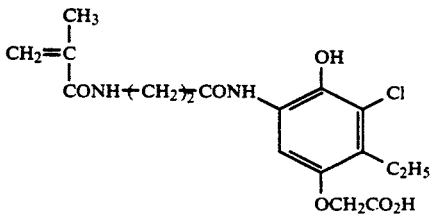

TABLE VIII-continued
VIII-7
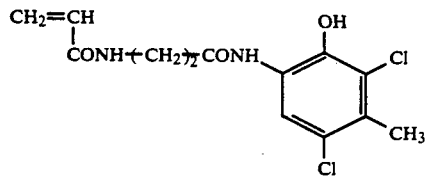
VIII-8
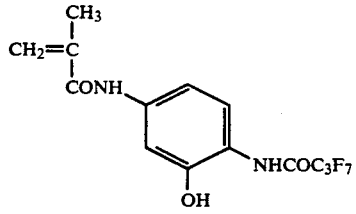
VIII-9
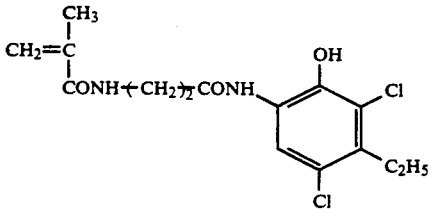
VIII-10
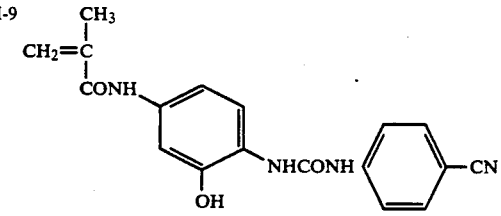
VIII-11
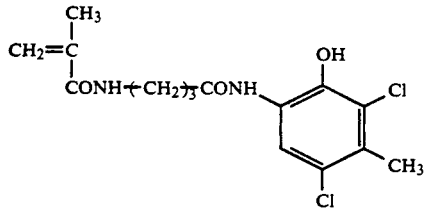
VIII-12
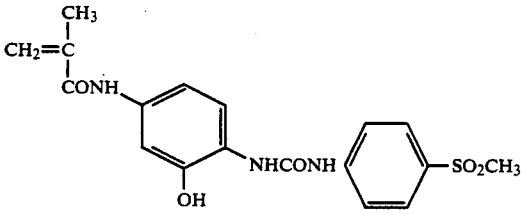
VIII-13
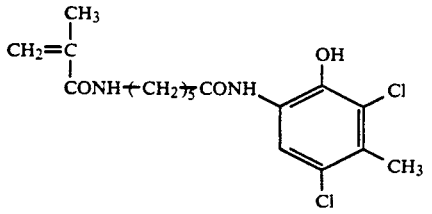
VIII-14
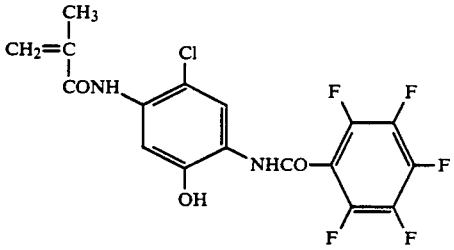
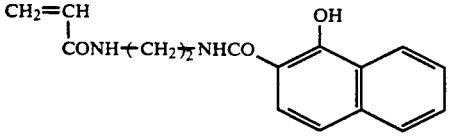
VIII-15
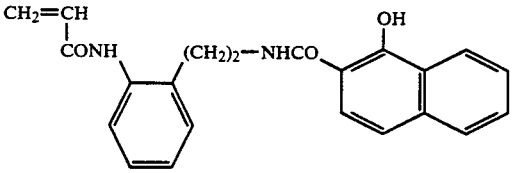
VIII-16
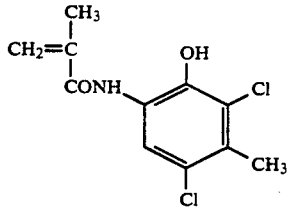
VIII-17
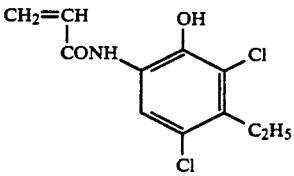
VIII-18
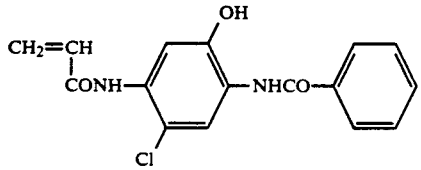
VIII-19
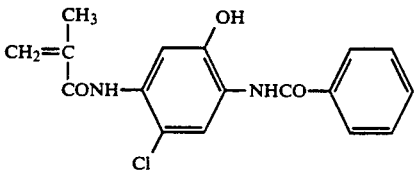
VIII-20

TABLE VIII-continued
VIII-21
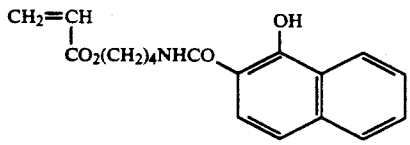
VIII-22
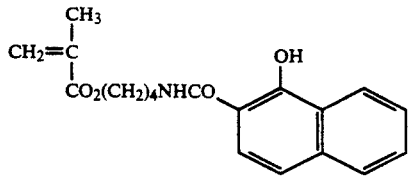
VIII-23
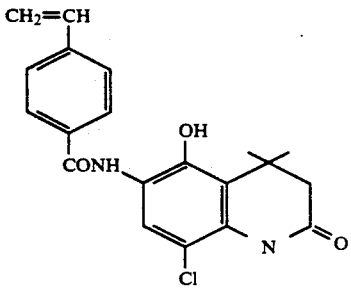
VIII-24
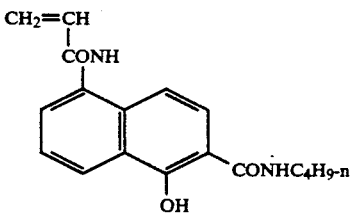
VIII-25
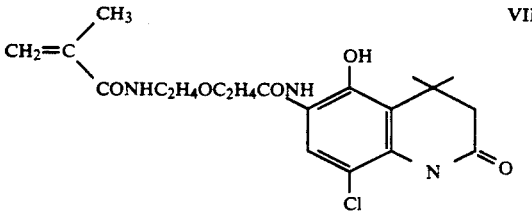
VIII-26
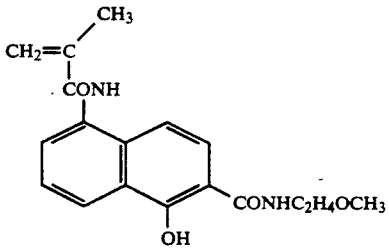
VIII-27
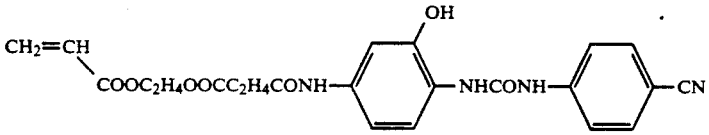
VIII-28
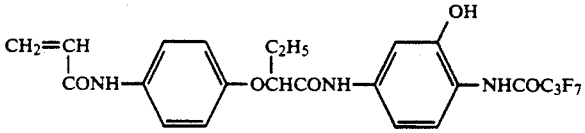
VIII-29
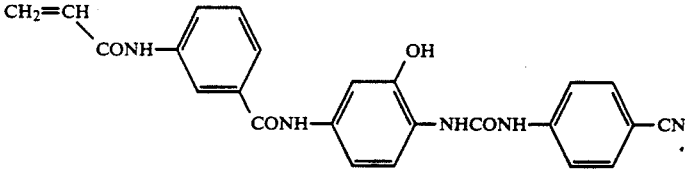
VIII-30
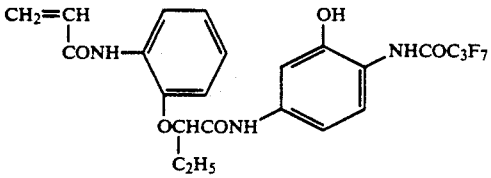
VIII-31
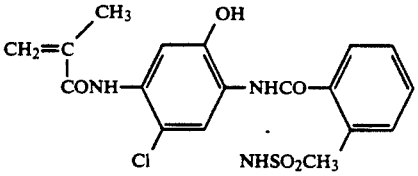
VIII-32
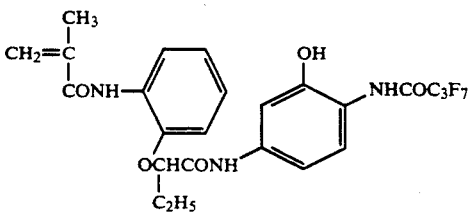

TABLE VIII-continued
VIII-33
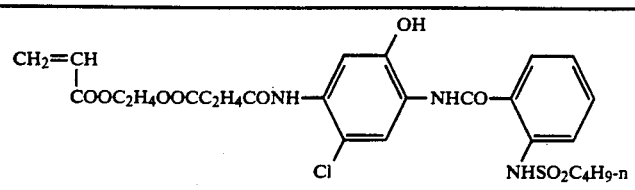
VIII-34
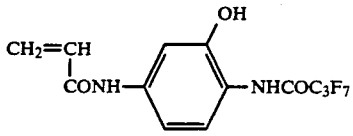
VIII-35
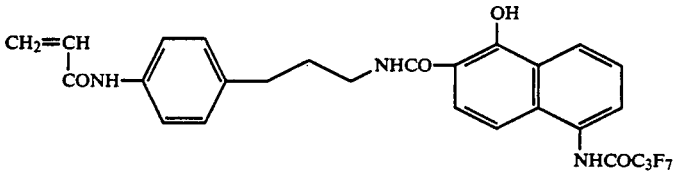
VIII-36
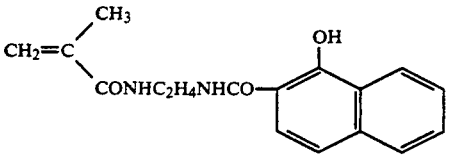
VIII-37
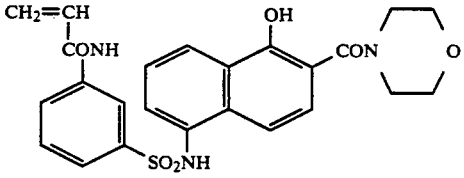
VIII-38
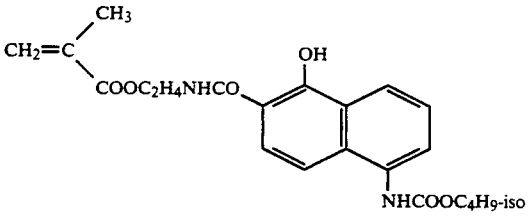
VIII-39
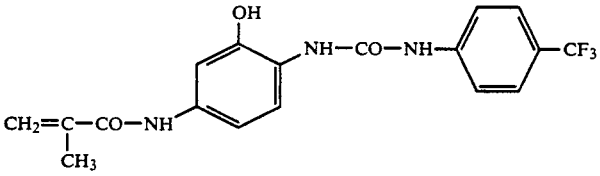
VIII-40
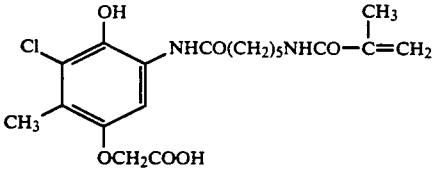
VIII-41
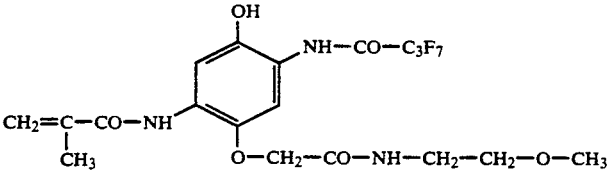
VIII-42
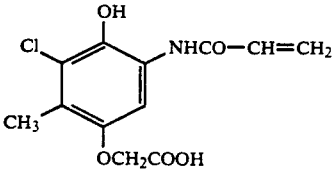

TABLE VIII-continued
VIII-43
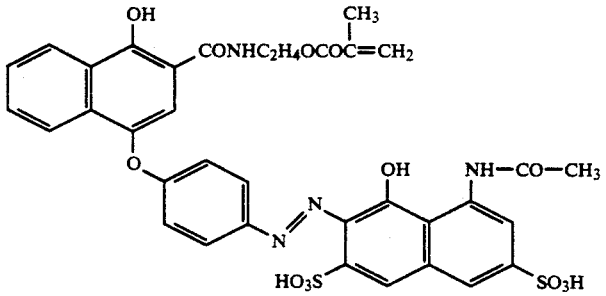
VIII-44
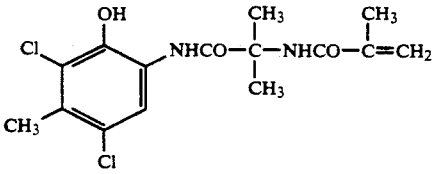
VIII-45
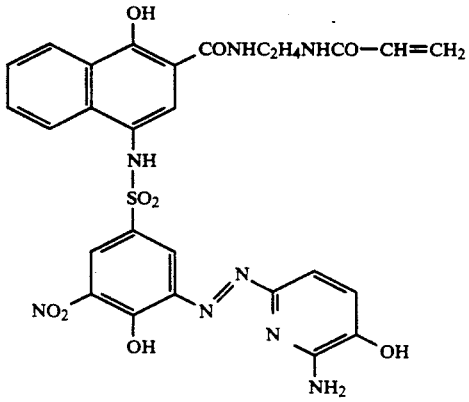
VIII-46
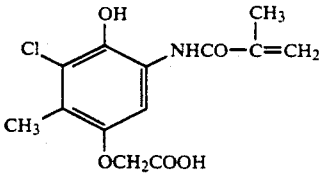
VIII-47
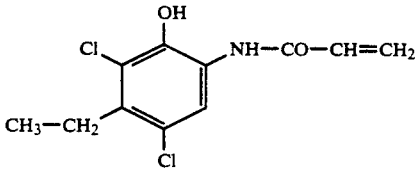
VIII-48
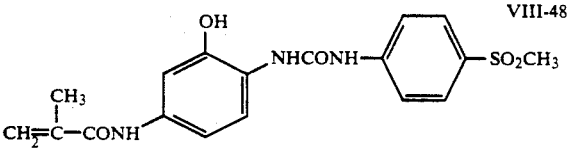
VIII-49
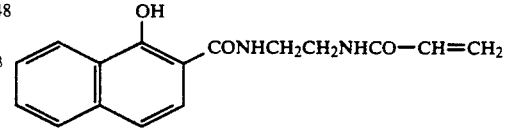
VIII-50
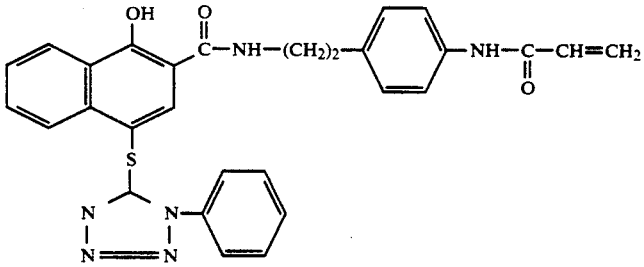
VIII-51
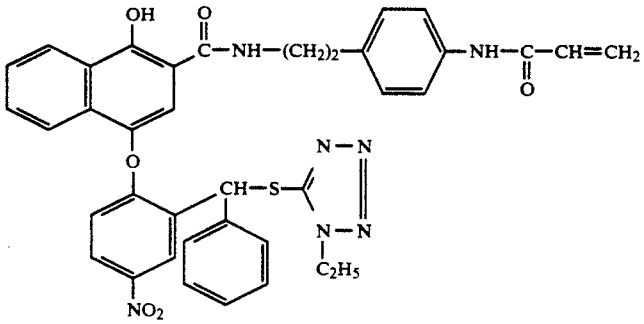

TABLE VIII-continued
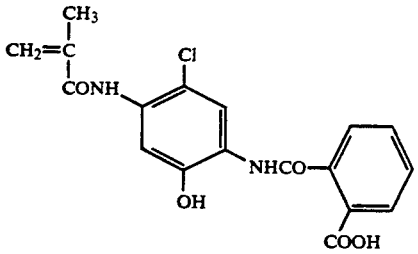
VIII-52
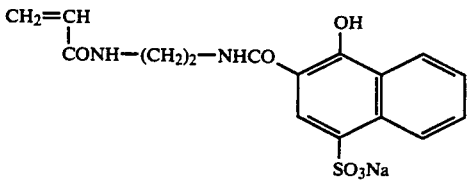
VIII-53
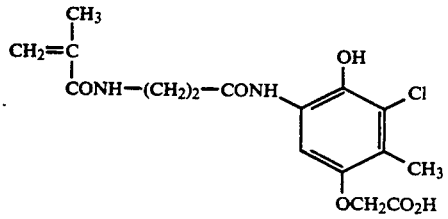
VIII-54
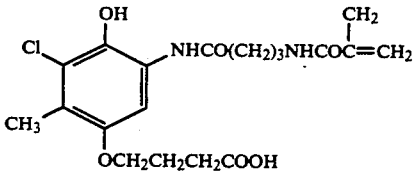
VIII-55
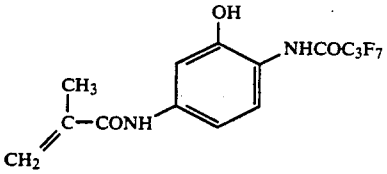
VIII-56
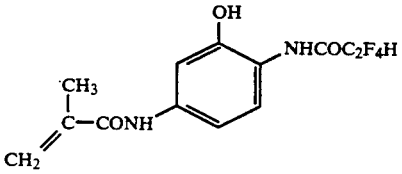
VIII-57
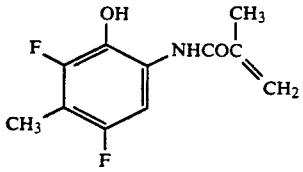
VIII-58
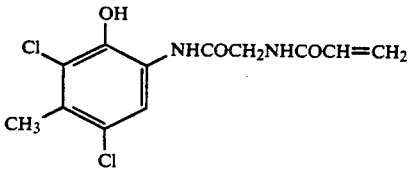
VIII-59
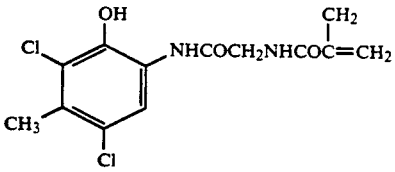
VIII-60
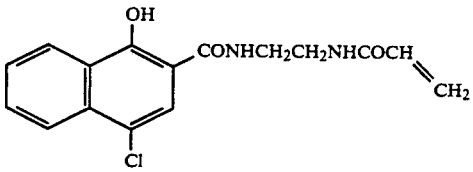
VIII-61
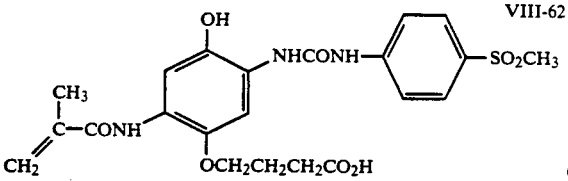
VIII-62
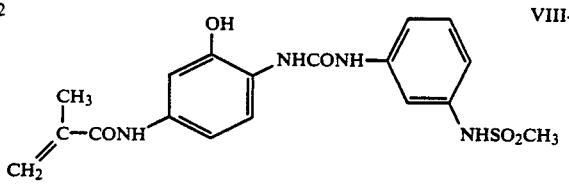
VIII-63
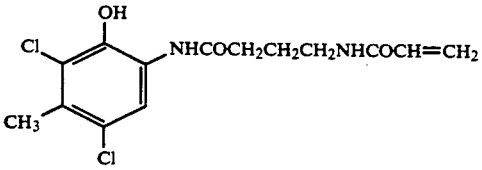
VIII-64
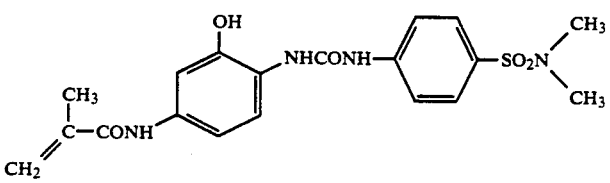
VIII-65
Q may represent a coupler group, capable of forming a magenta dye by coupling with an aromatic primary

M-1

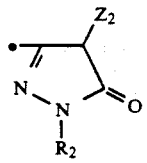

M-2

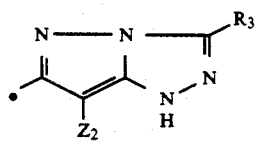

M-3

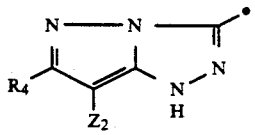

M-4

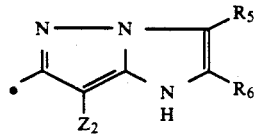

M-5

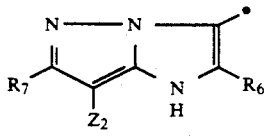

M-6

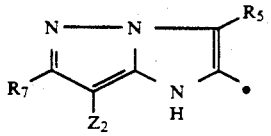

M-7

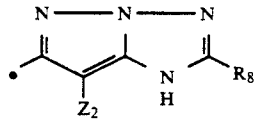

M-8

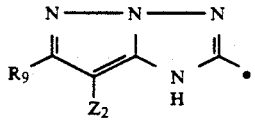

M-9

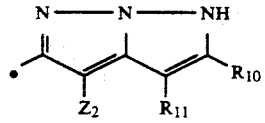

M-10

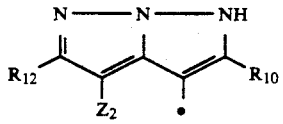

M-11

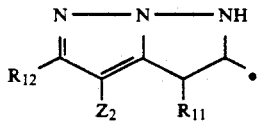

-continued

M-12

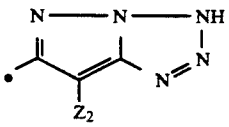

$R_2$ represents a conventional substituent which is well known as a substituent on the 1-position of a 2-pyrazolin-5-one coupler, such as an alkyl group, a substituted alkyl group (such as a haloalkyl group, e.g., fluoroalkyl, or cyanoalkyl, or benzylalkyl), an aryl group or a substituted aryl group (e.g., methyl or ethyl substituted), an alkoxy group (such as methoxy or ethoxy), an aryloxy group (such as phenyloxy), an alkoxycarbonyl group (such as methoxycarbonyl), an acylamino group (such as acetylamino), a carbamoyl group, an alkylcarbamoyl group (such as methylcarbamoyl or ethylcarbamoyl), a dialkylcarbamoyl group (such as dimethylcarbamoyl), an arylcarbamoyl group (such as phenylcarbamoyl), an alkylsulfonyl group (such as methylsulfonyl), an arylsufonyl group (such as phenylsulfonyl), an alkylsulfonamido group (such as methanesulfonamido), an arylsulfonamido group (such as phenylsulfonamido), a sulfamoyl group, an alkylsulfamoyl group (such as ethylsulfamoyl), a dialkylsulfamoyl group (such as dimethylsulfamoyl), an arylsulfamoyl group, an alkylthio group (such as methylthio), an arylthio group (such as phenylthio), cyano group, nitro group, a halogen atom (such as fluorine atom, chlorine atom, bromine atom), etc. In case said group is substituted by two or more of said substituents, these may be the same or different. The most preferred substituents are a halogen atom, an alkyl group, an alkoxy group, an alkoxycarbonyl group, and the cyano group.

$R_3$, $R_4$, $R_5$, $R_6$, $R_7$, $R_8$, $R_9$, $R_{10}$, $R_{11}$, and $R_{12}$ are each independently a hydrogen atom or hydroxyl group, or represent an unsubstituted or substituted alkyl group (preferably having from 1 to 20 carbon atoms, such as methyl, propyl, t-butyl, or trifluoromethyl, tridecyl), an aryl group (preferably having from 6 to 20 carbon atoms, such as phenyl, 4-t-butylphenyl, 2,4-di-t-amylphenyl, or 4-methoxyphenyl), a heterocyclic group (such as 2-furyl, 2-thienyl, 2-pyrimidinyl, or 2-benzthiazolyl), an alkylamino group (preferably having from 1 to 20 carbon atoms, such as methylamino, diethylamino, t-butylamino), an acylamino group (preferably having from 2 to 20 carbon atoms, such as acetylamino, propylamido, benzamido), an anilino group (such as phenylamino, 2-chloroanilino), an alkoxycarbonyl group (preferably having from 2 to 20 carbon atoms, such as methoxycarbonyl, butoxycarbonyl, 2-ethylhexyloxycarbonyl), an alkylcarbonyl group (preferably having from 2 to 20 carbon atoms, such as acetyl, butylcarbonyl, cyclohexylcarbonyl), an arylcarbonyl group (preferably having from 7 to 20 carbon atoms, such as benzoyl, or 4-t-butylbenzoyl), an alkylthio group (preferably having from 1 to 20 carbon atoms, such as methylthio, octylthio, 2-phenoxyethylthio), an arylthio group (preferably having from 6 to 20 carbon atoms, such as phenylthio, 2-butoxy-5-t-octyl-phenylthio), a carbamoyl group (preferably having from 1 to 20 carbon atoms, such as N-ethylcarbamoyl, N,N-dibutylcarbamoyl, N-methyl-N-butylcarbamoyl), a sulfamoyl group (preferably $NH_2SO_2$— and a group having from 1 to 20 carbon atoms, such as N-ethylsulfamoyl, N,N-diethylsulfamoyl, N,N-dipropylsulfamoyl), or an alkylsulfonamido group (preferably having from 6 to 20 carbon atoms, such as benzenesulfonamido, p-toluenesulfonamido).

$Z_2$ represents a hydrogen atom, a halogen atom, or a split-off group which is bonded at a coupling position via an oxygen, nitrogen, or sulfur atom. In the case $Z_2$ is bonded at a coupling position via an oxygen, nitrogen, or sulfur atom, said atom is bonded with an alkyl group, an aryl group, an alkylsulfonyl group, an arylsulfonyl group, an alkylcarbonyl group, an arylcarbonyl group, or a heterocyclic ring residue. Furthermore, in the case $Z_2$ is bonded at a coupling position via a nitrogen atom, this may form, including said nitrogen atom, a 5- or 6-membered ring (such as imidazolyl, pyrazolyl, triazolyl, or tetrazolyl).

Preferred examples of photographically useful components that are magenta coupler groups are illustrated in Table IX:

TABLE IX

IX-1

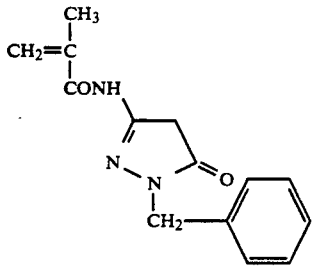

IX-2

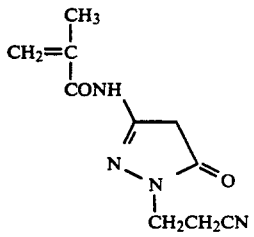

IX-3

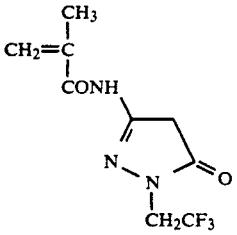

IX-4

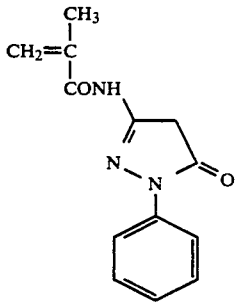

IX-5

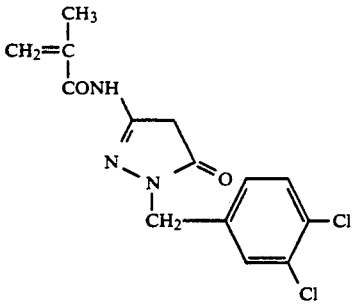

IX-6

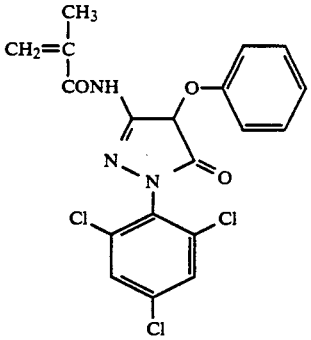

IX-7

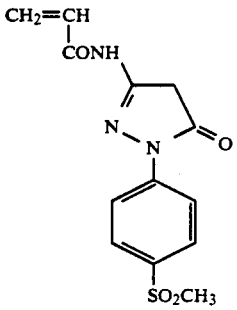

IX-8

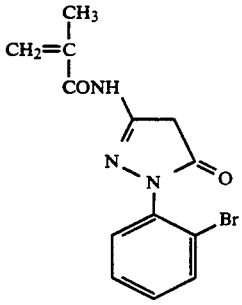

TABLE IX-continued
IX-9
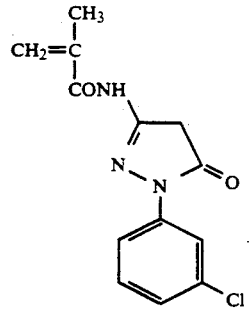
IX-10
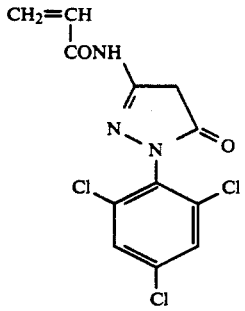
IX-11
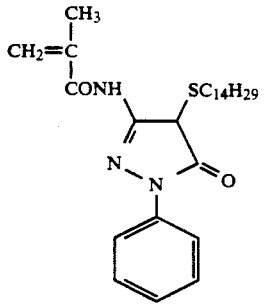
IX-12
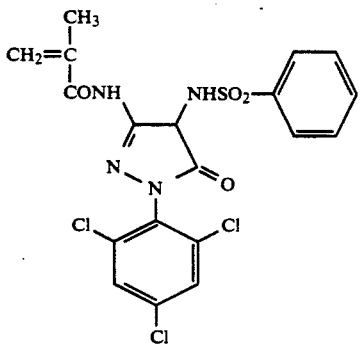
IX-13
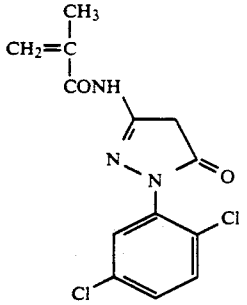
IX-14
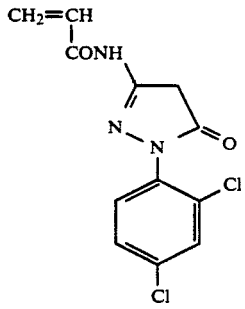
IX-15
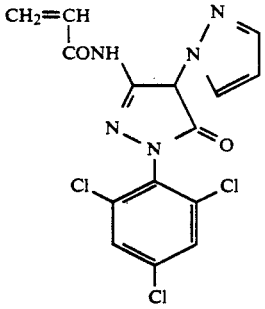
IX-16
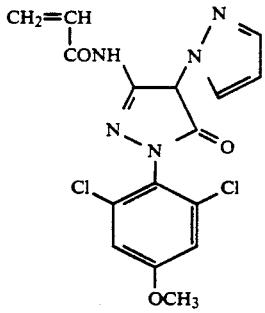
IX-17
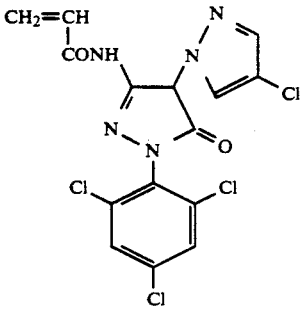
IX-18
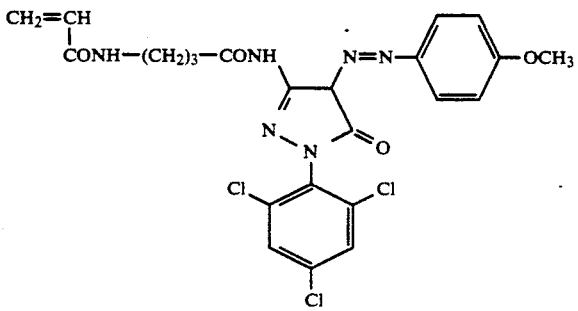

TABLE IX-continued
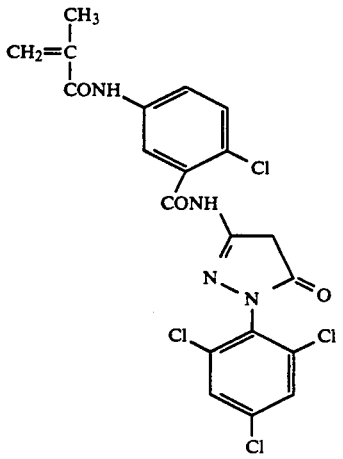
IX-19
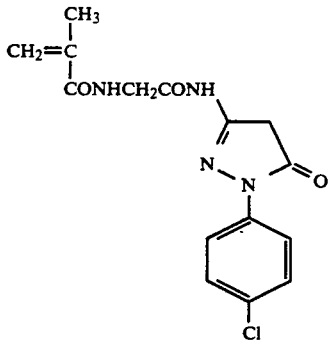
IX-20
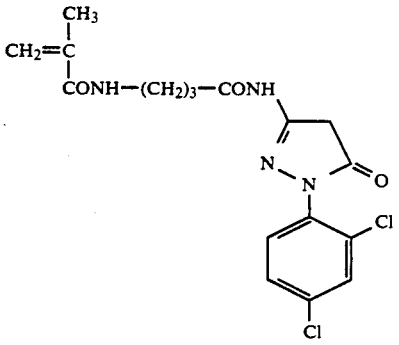
IX-21
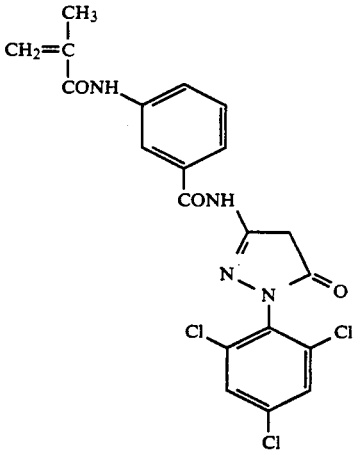
IX-22
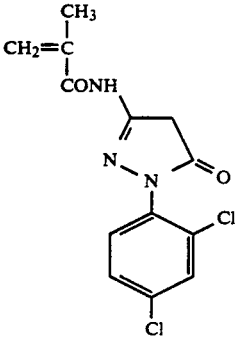
IX-23
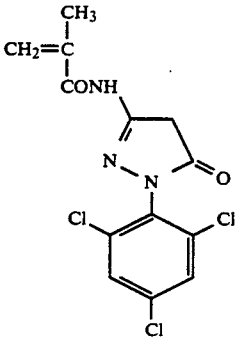
IX-24

TABLE IX-continued
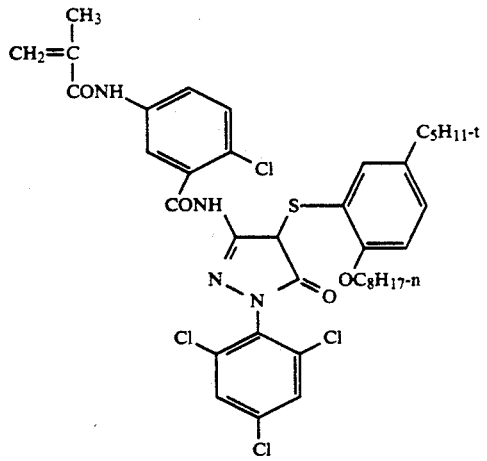
IX-25
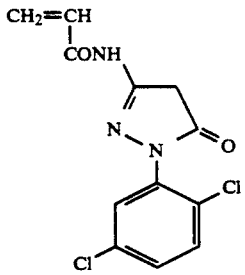
IX-26
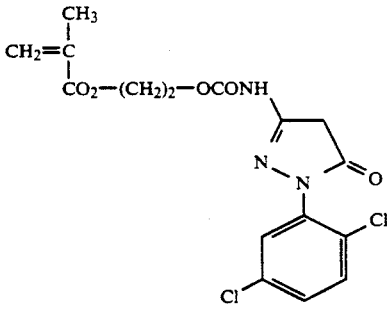
IX-27
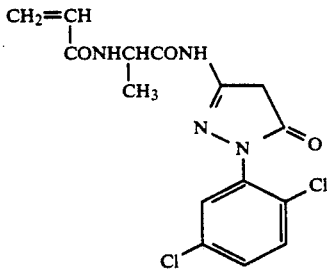
IX-28
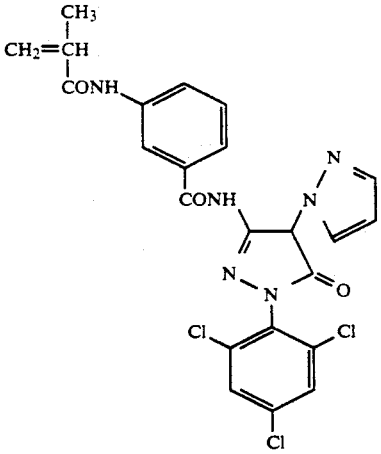
IX-29
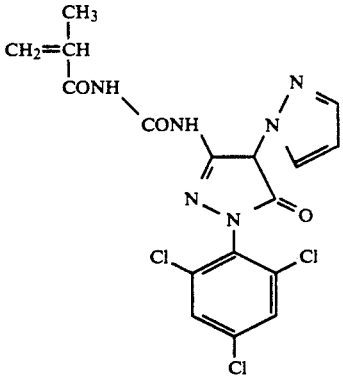
IX-30
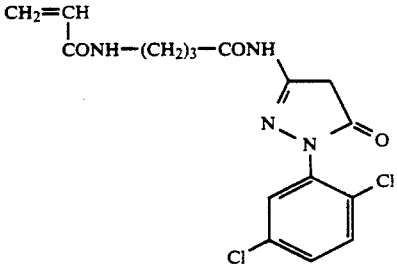
IX-31
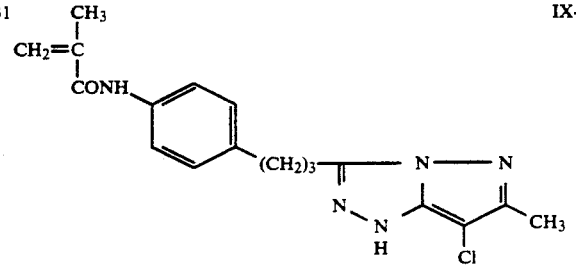
IX-32

TABLE IX-continued
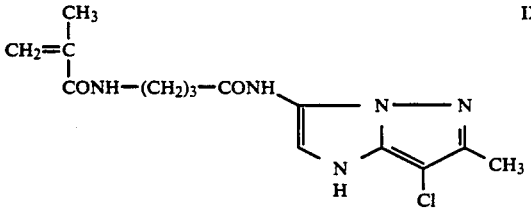
IX-33
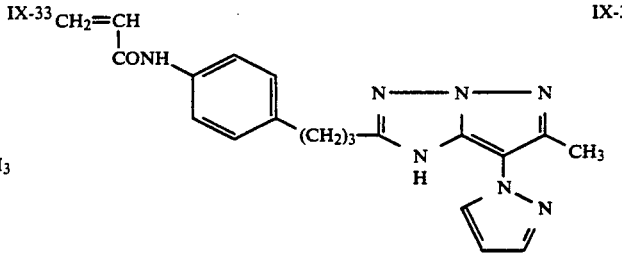
IX-34
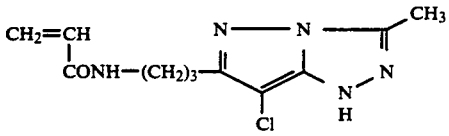
IX-35
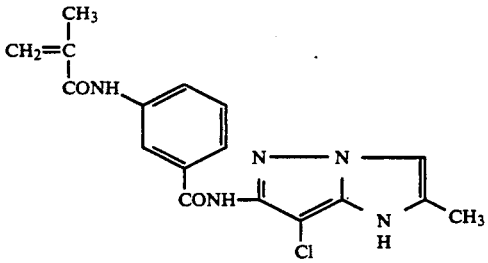
IX-36
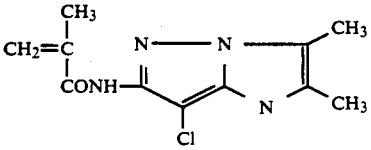
IX-37
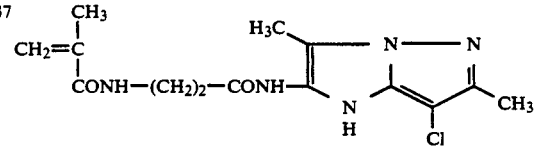
IX-38
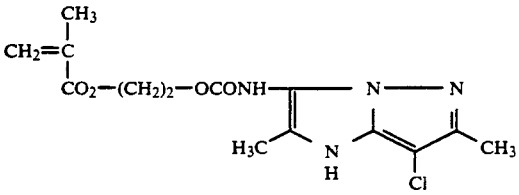
IX-39
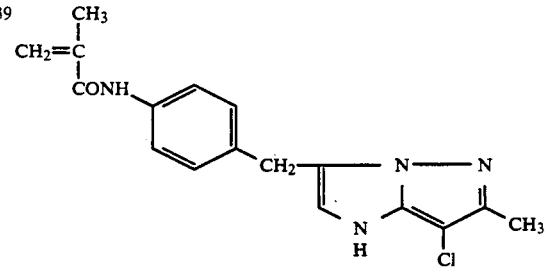
IX-40
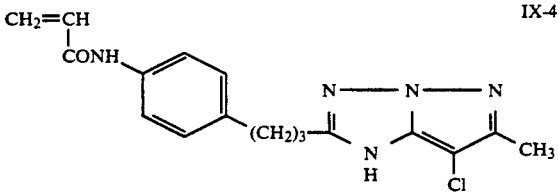
IX-41
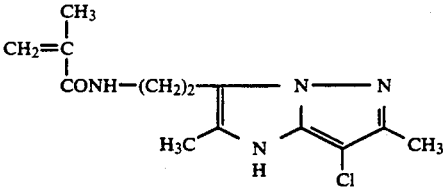
IX-42
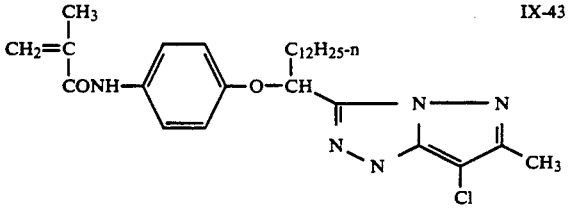
IX-43
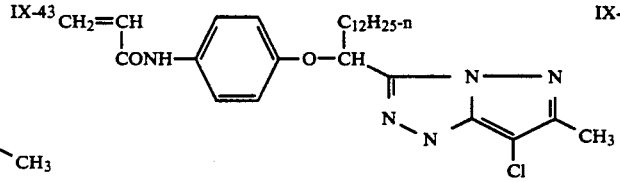
IX-44
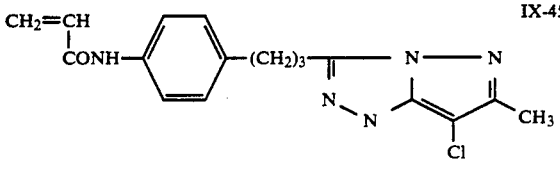
IX-45
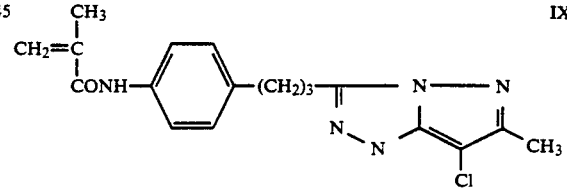
IX-46

TABLE IX-continued
IX-47
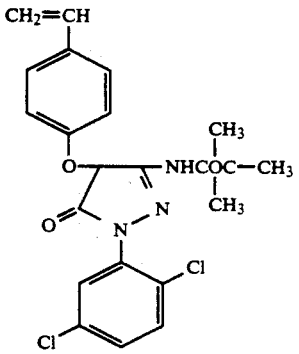
IX-48
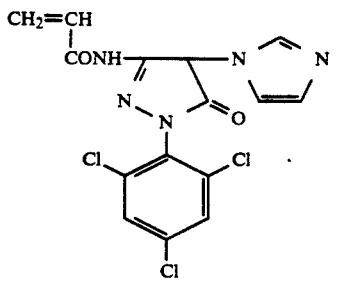
IX-49
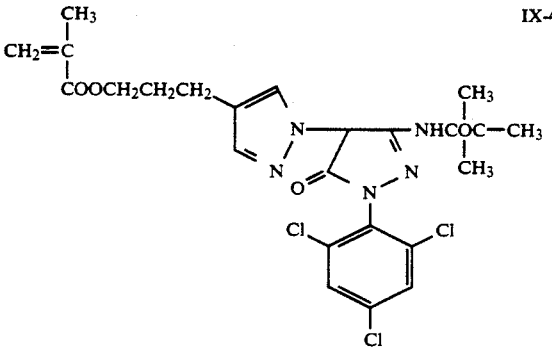
IX-50
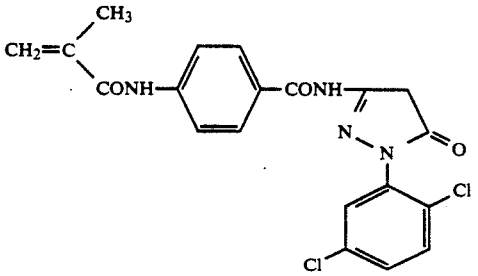
IX-51
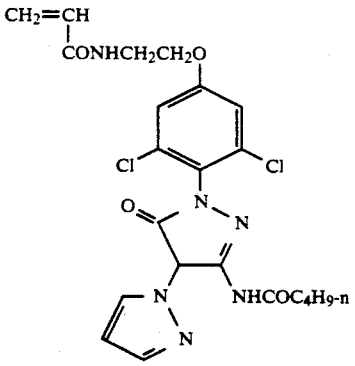
IX-52
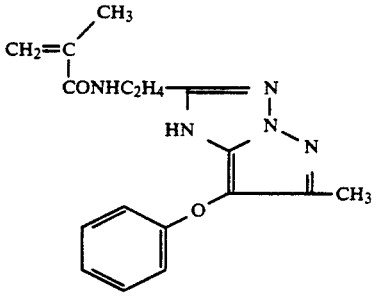
IX-53
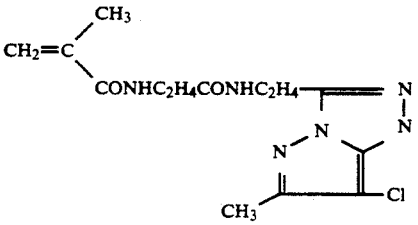
IX-54
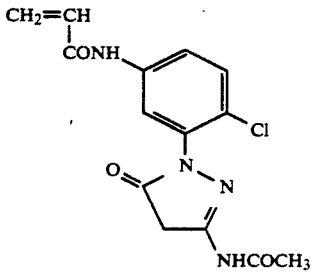

TABLE IX-continued
IX-55
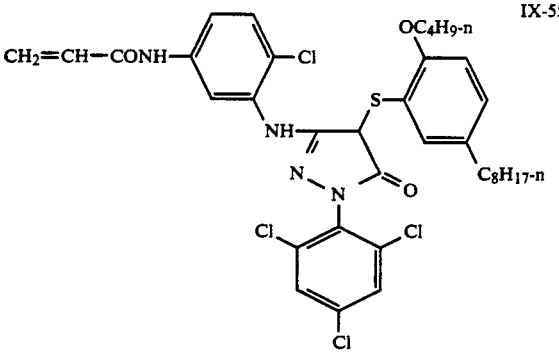
IX-56
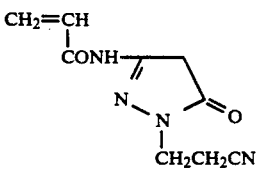
IX-57
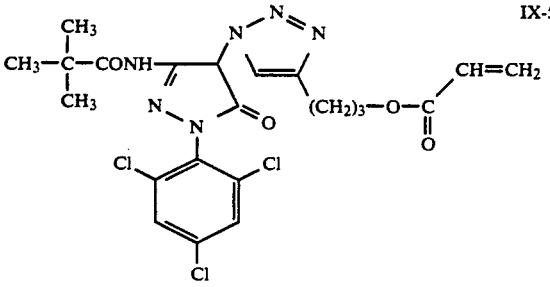
IX-58
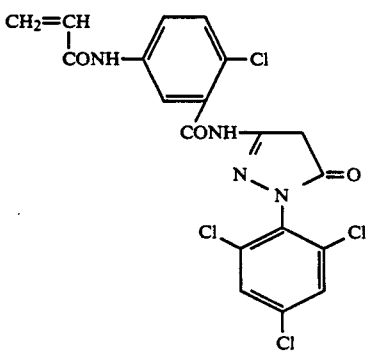
IX-59
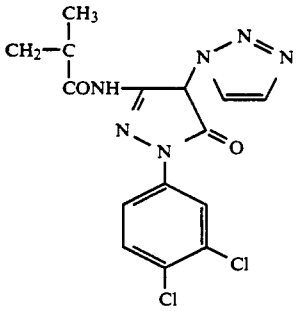
IX-60
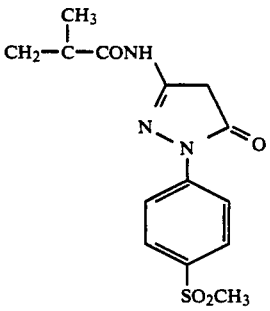
IX-61
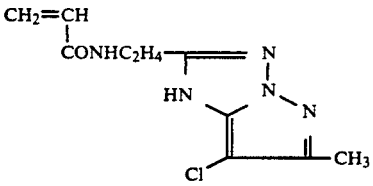
IX-62
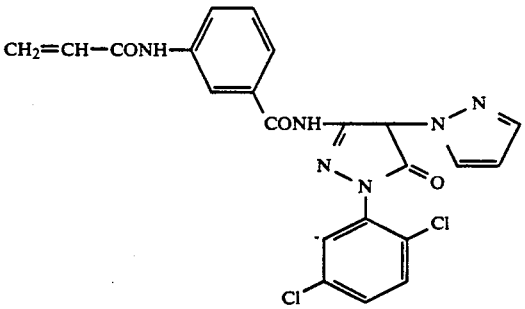
IX-63
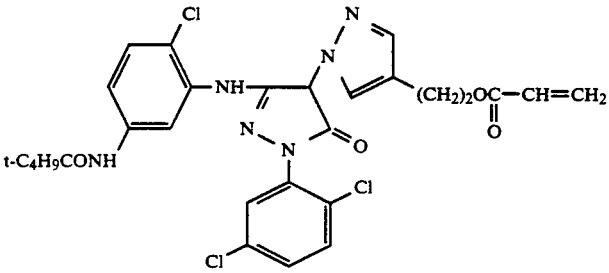

TABLE IX-continued
IX-64
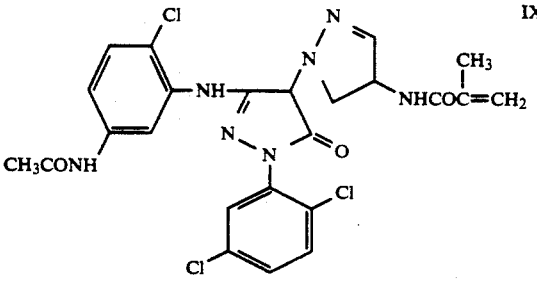
IX-65
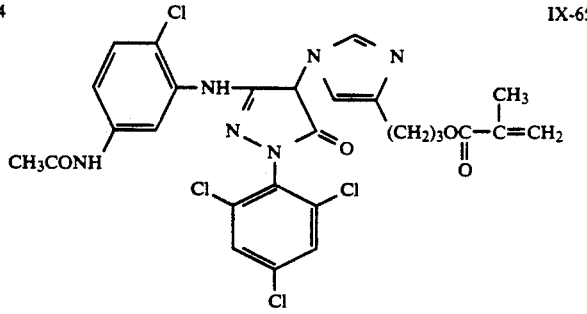
IX-66
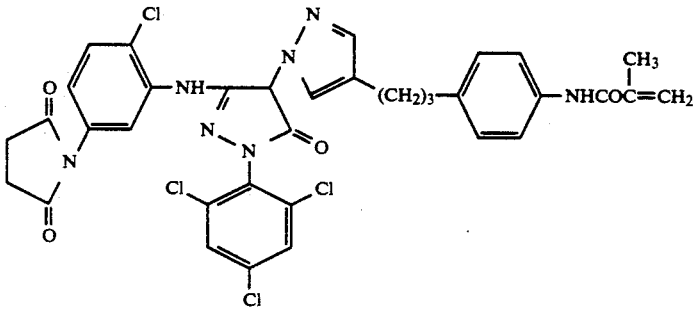
IX-67
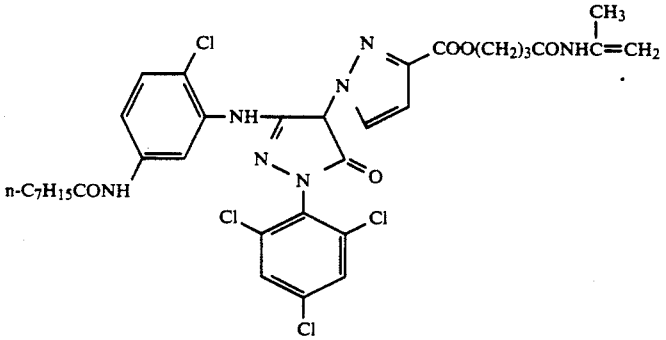
IX-68
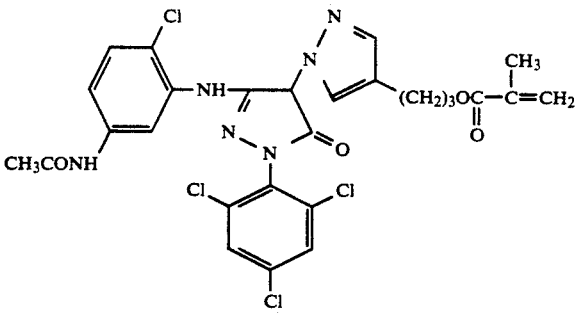
IX-69
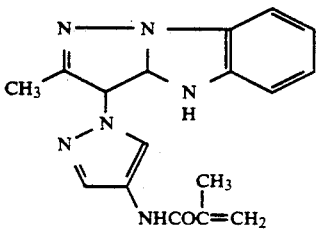
IX-70
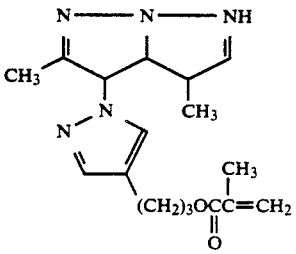

TABLE IX-continued
IX-71
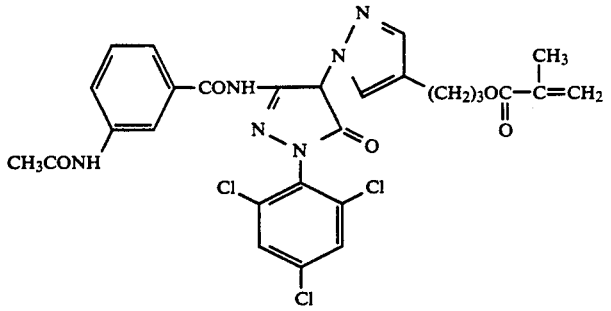
IX-72
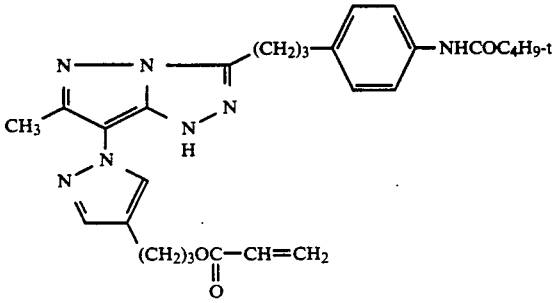
IX-73
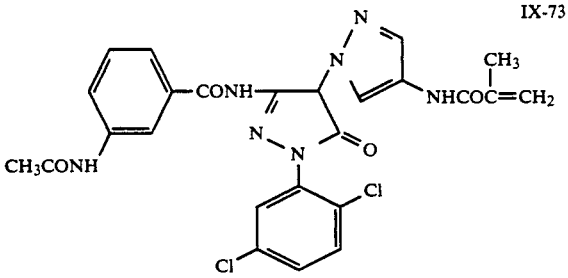
IX-74
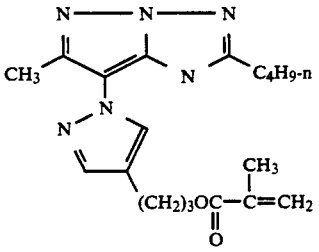
IX-75
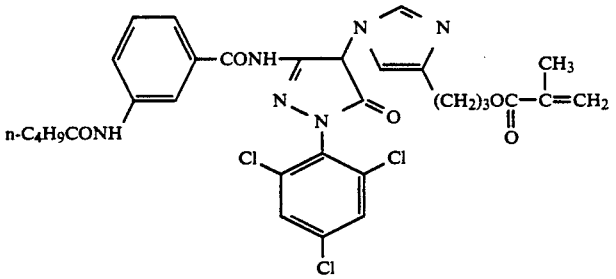
IX-76
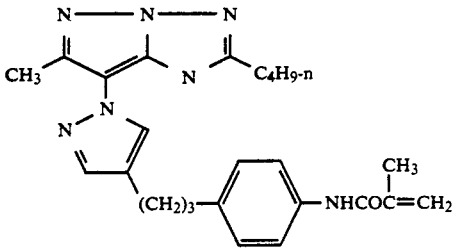
IX-77
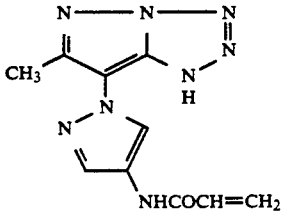

TABLE IX-continued
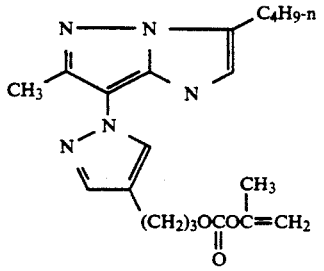
IX-78
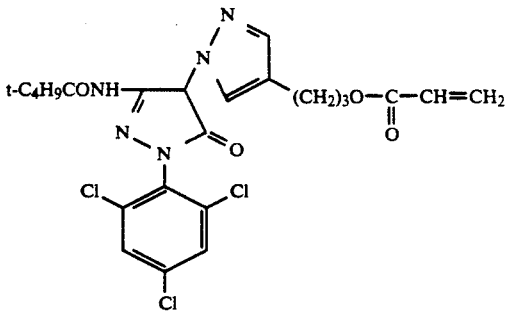
IX-79
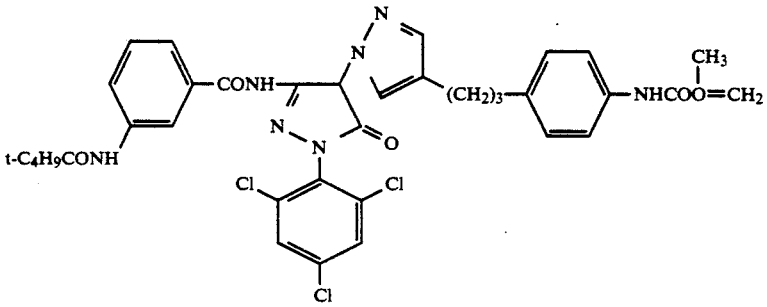
IX-80
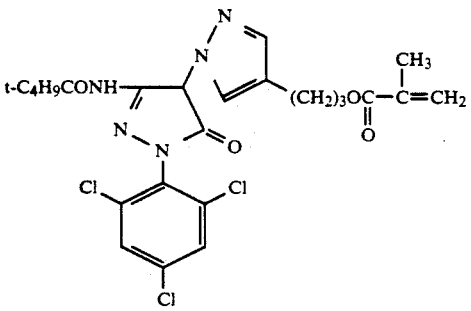
IX-81
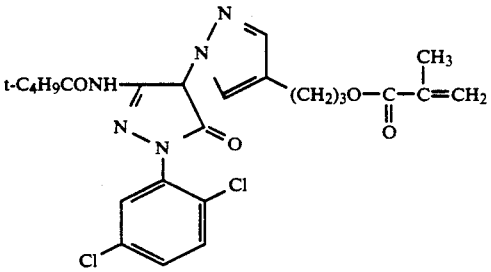
IX-82
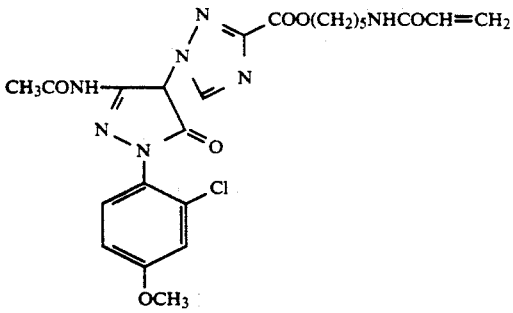
IX-83
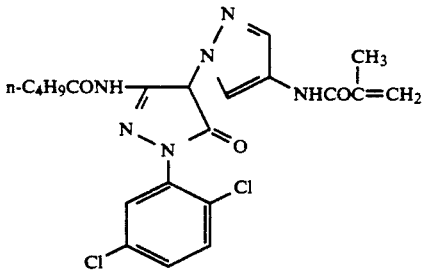
IX-84
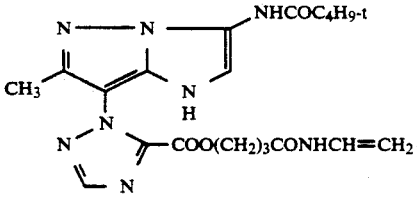
IX-85
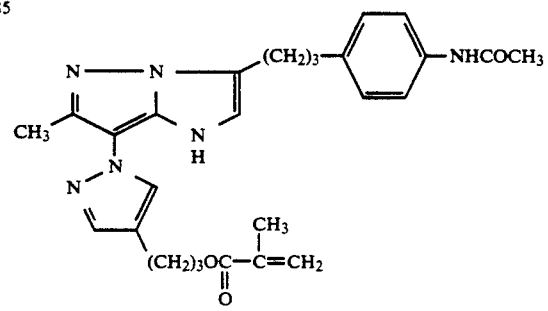
IX-86

TABLE IX-continued
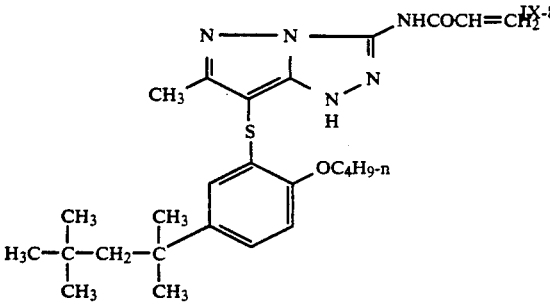
IX-87
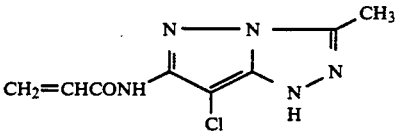
IX-88
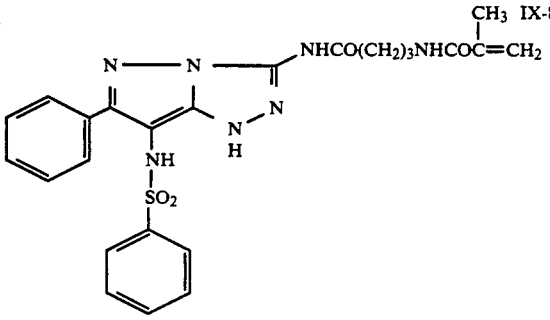
IX-89
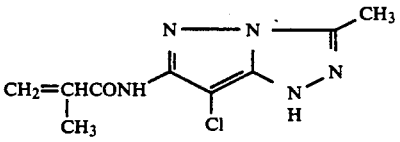
IX-90
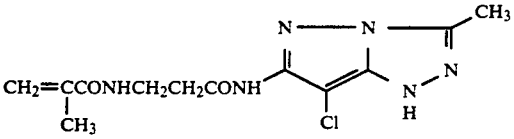
IX-91
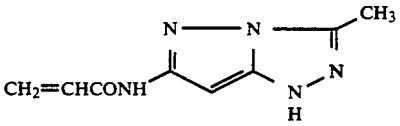
IX-92
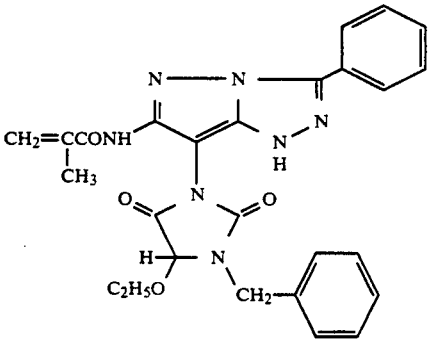
IX-93
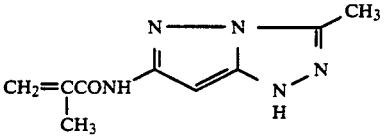
IX-94
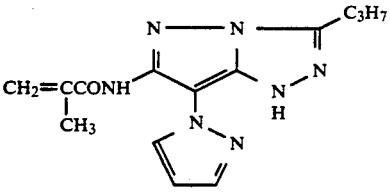
IX-95
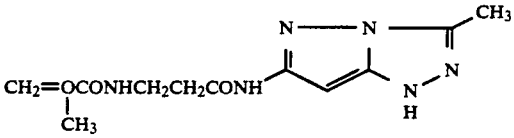
IX-96
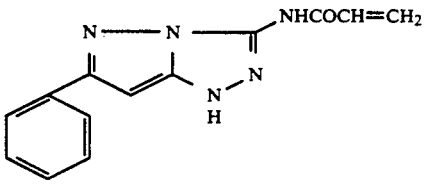
IX-97
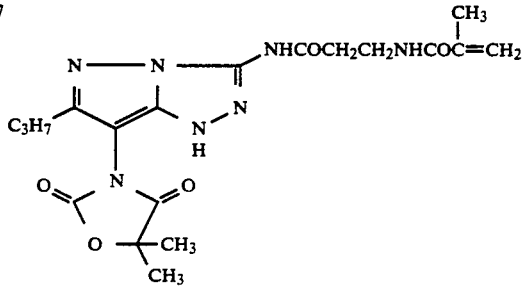
IX-98

TABLE IX-continued
IX-99
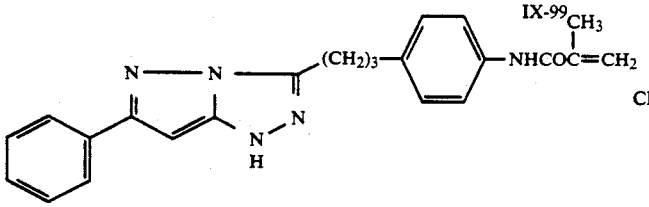
IX-100
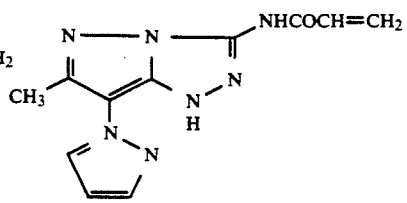
IX-101
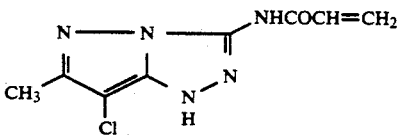
IX-102
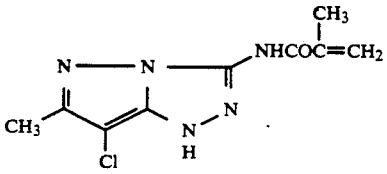
IX-103
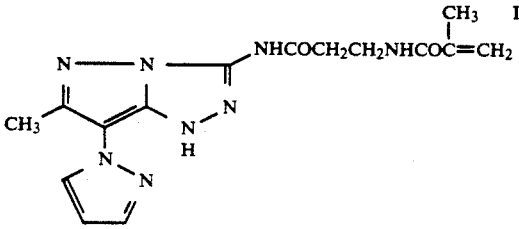
IX-104
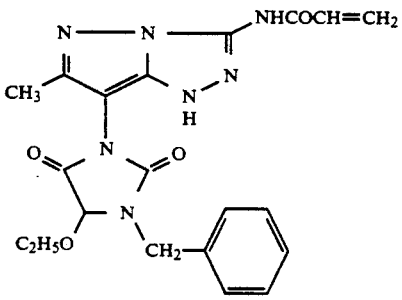
IX-105
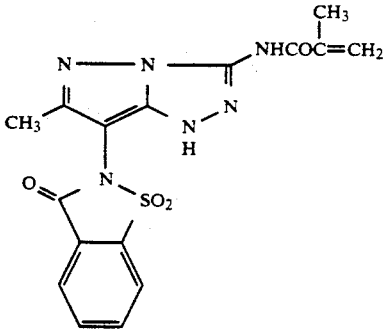
IX-106
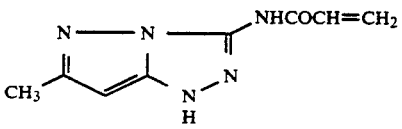
IX-107
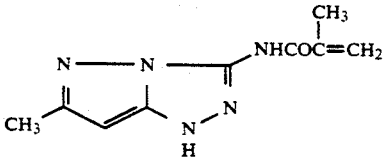
IX-108
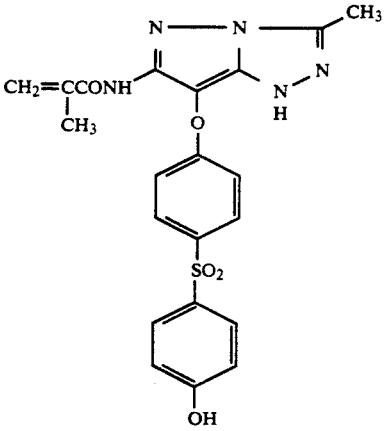
IX-109
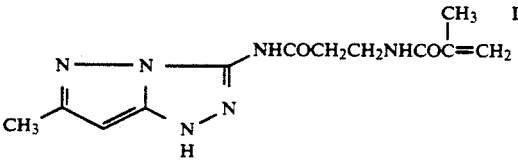
IX-110
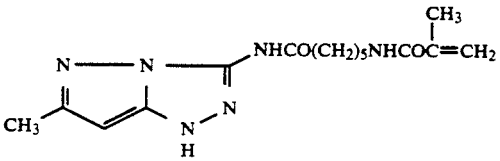

TABLE IX-continued
IX-111
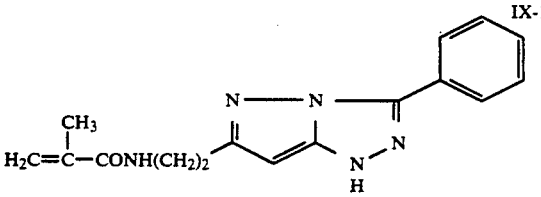
IX-112
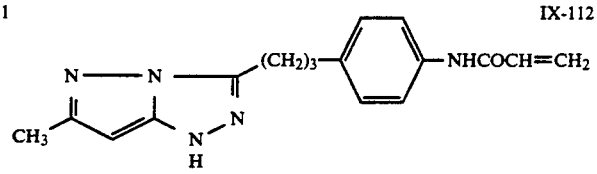
IX-113
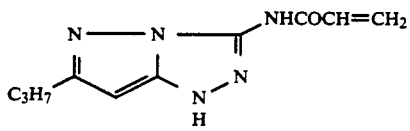
IX-114
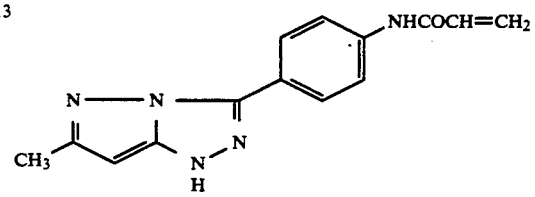
IX-115
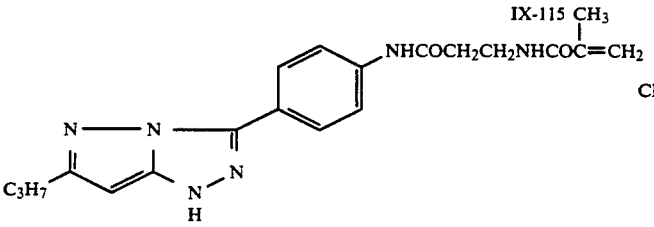
IX-116
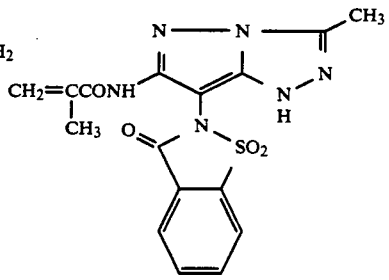
IX-117
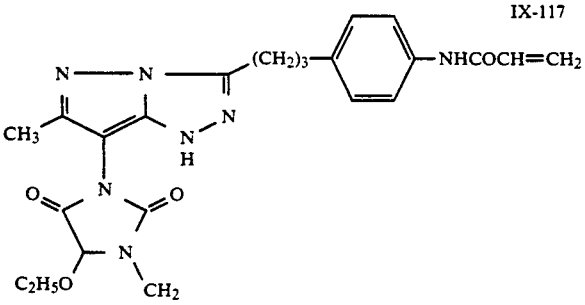
IX-118
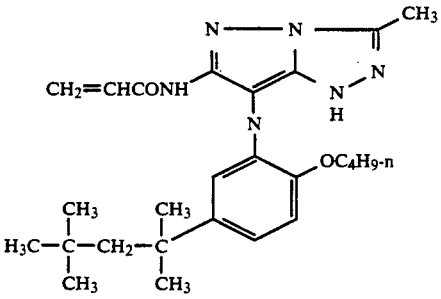
IX-119
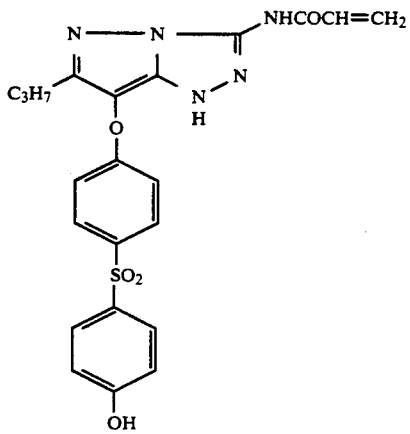
IX-120
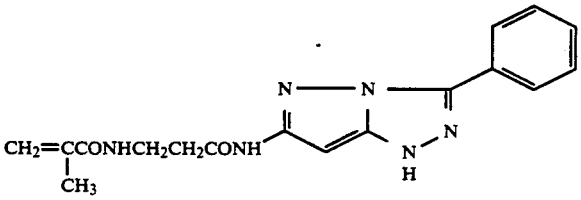

TABLE IX-continued
IX-121
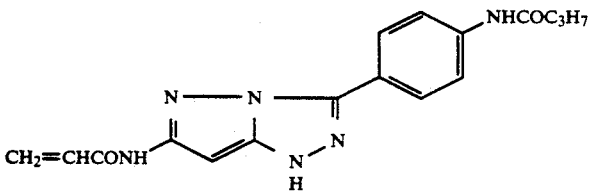
IX-122
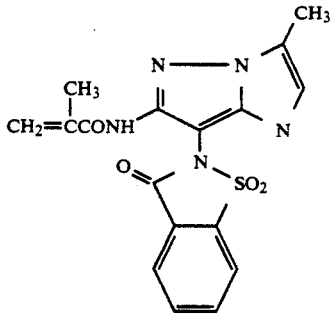
IX-123
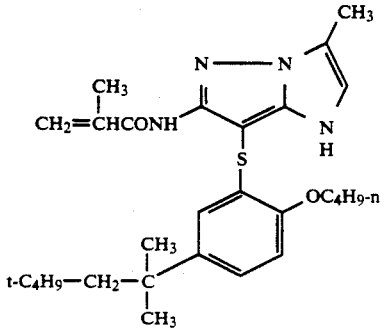
IX-124
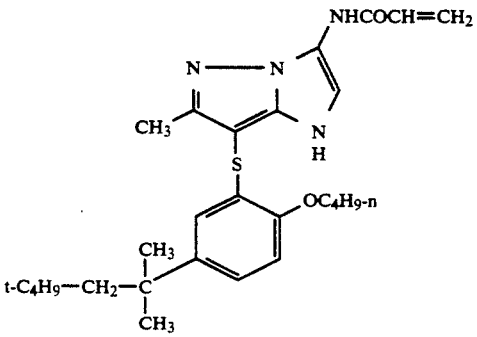
IX-125
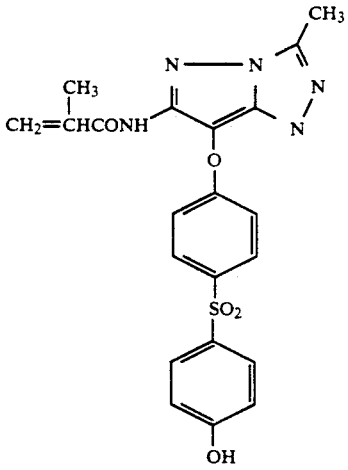
IX-126
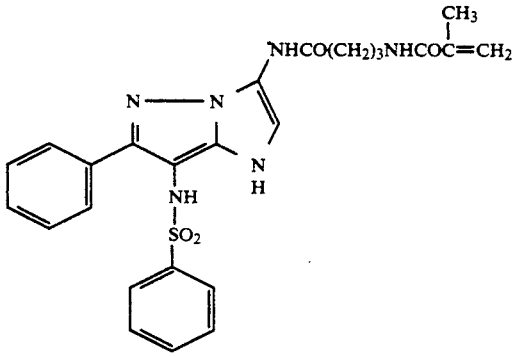
IX-127
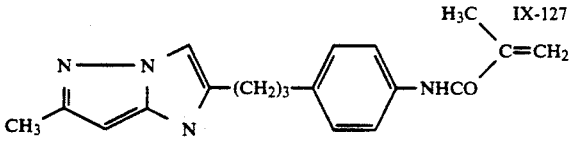
IX-128
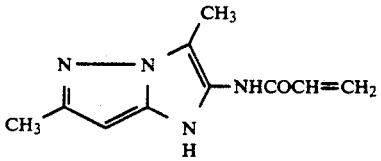
IX-129
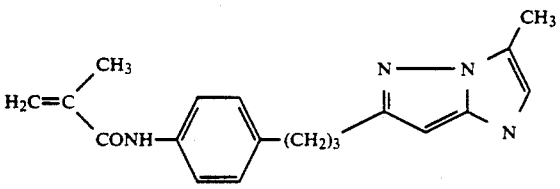
IX-130
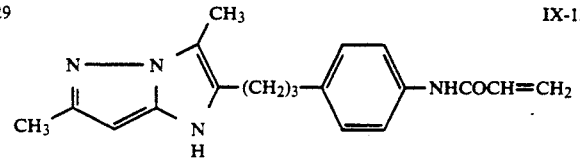

TABLE IX-continued
IX-131
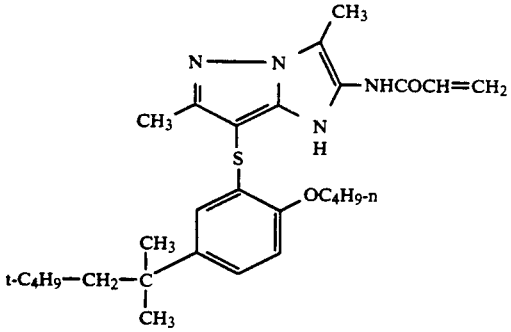
IX-132
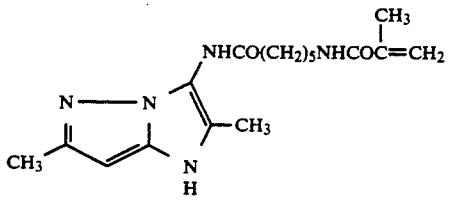
IX-133
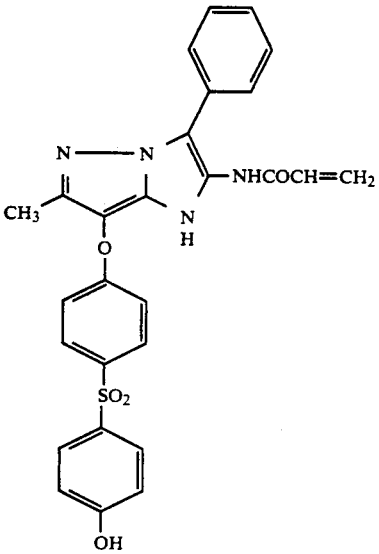
IX-134
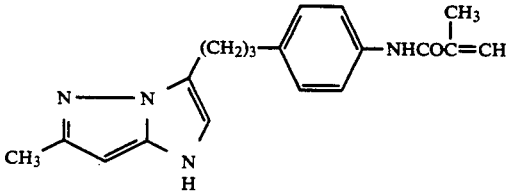
IX-135
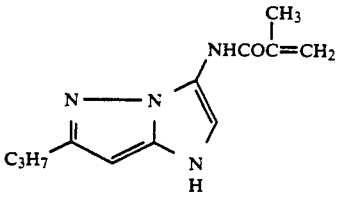
IX-136
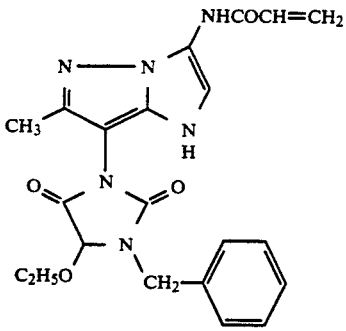
IX-137
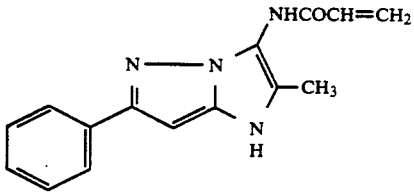
IX-138
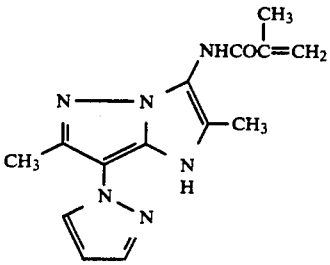

TABLE IX-continued
IX-139
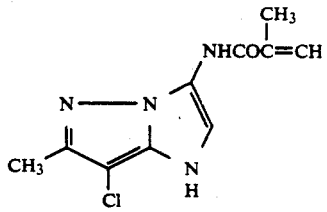
IX-140
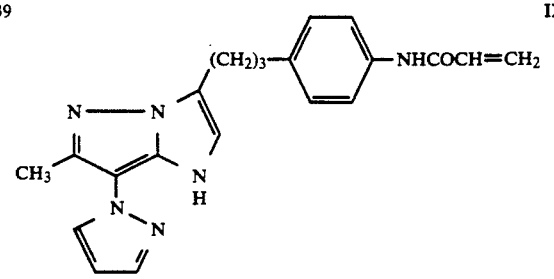
IX-141
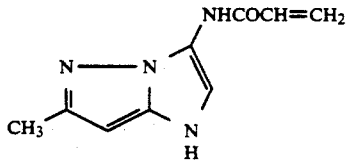
IX-142
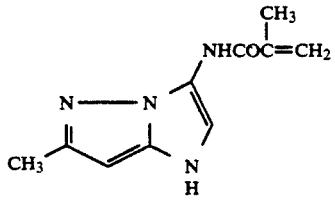
IX-143
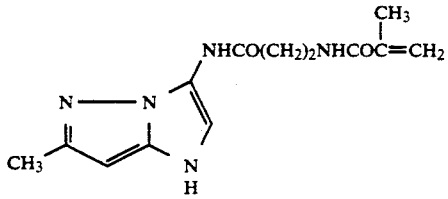
IX-144
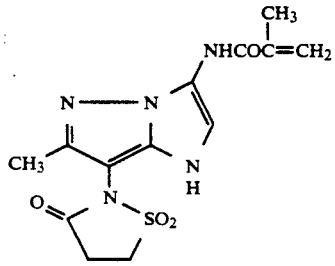
IX-145
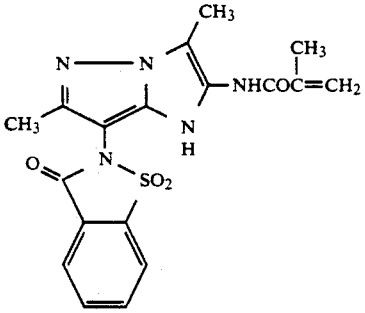
IX-146
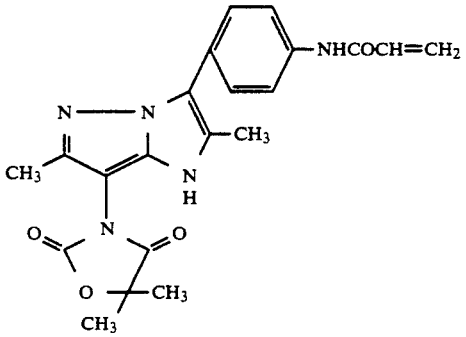
IX-147
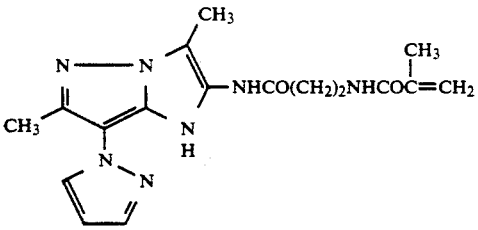
IX-148
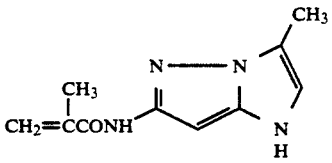
IX-149
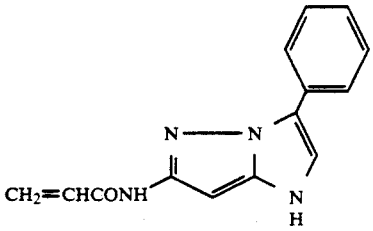
IX-150
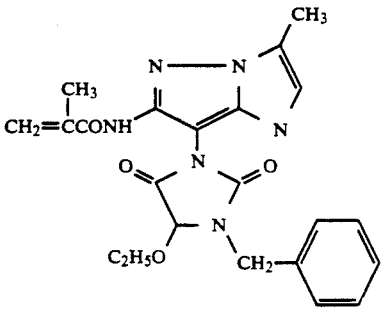

TABLE IX-continued
IX-151
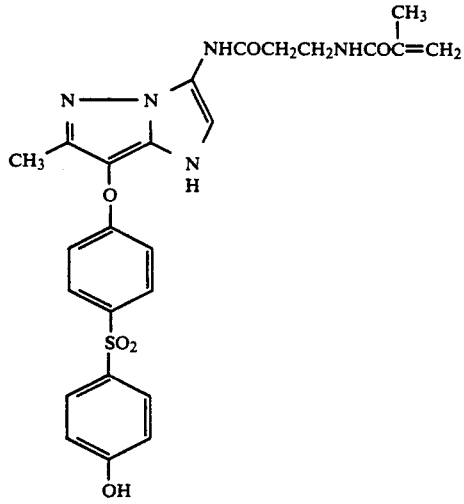
IX-152
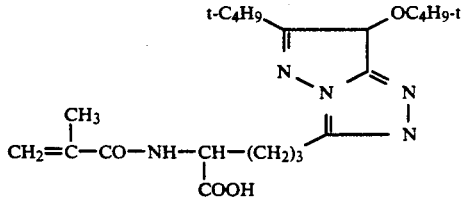
IX-153
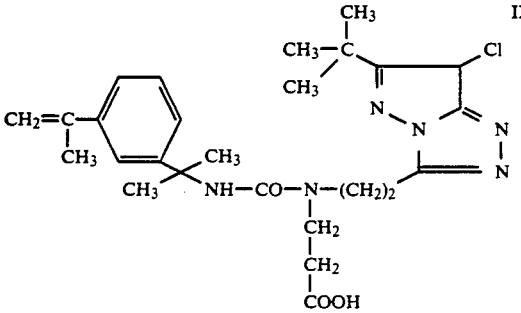
IX-154
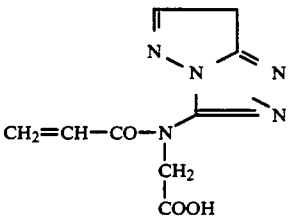
IX-155
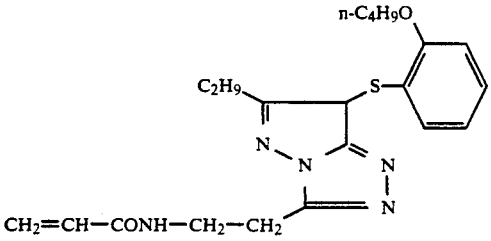
IX-156
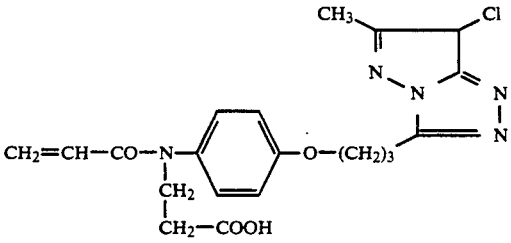
IX-157
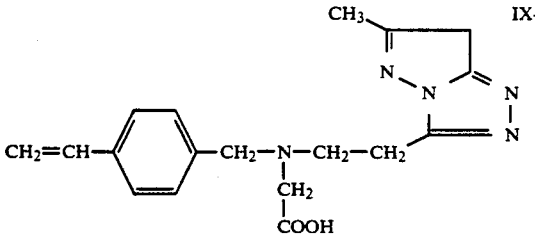
IX-158
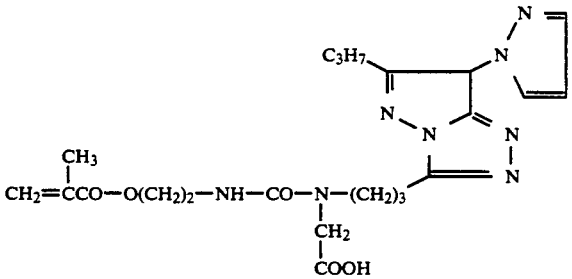
IX-159
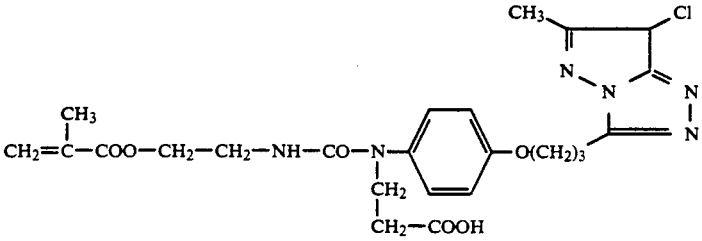

IX-160
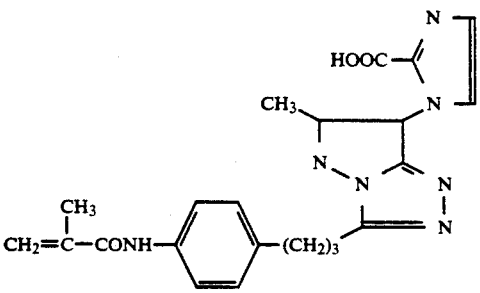
IX-161
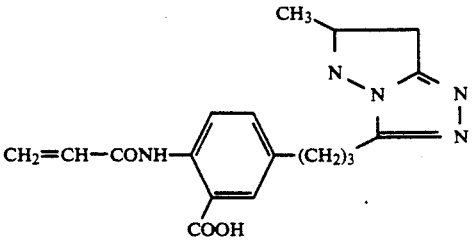
IX-162
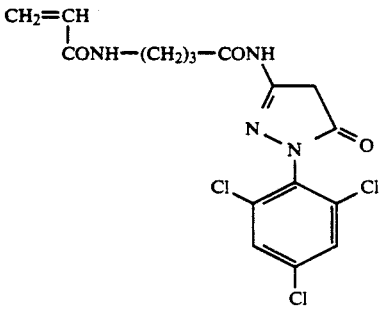
IX-163
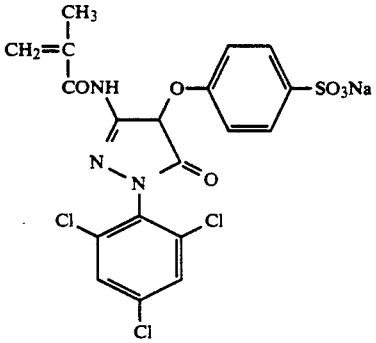
IX-164
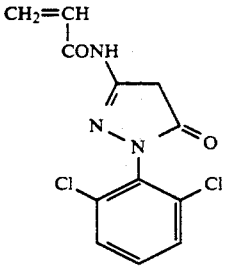
IX-165
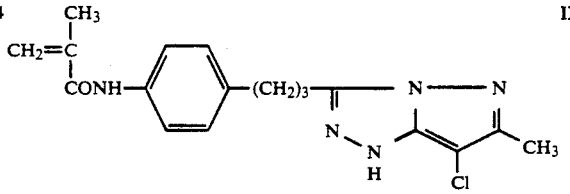
IX-166
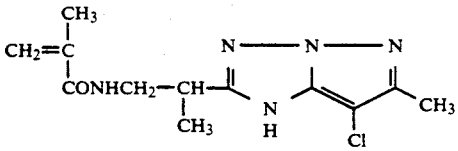
IX-167
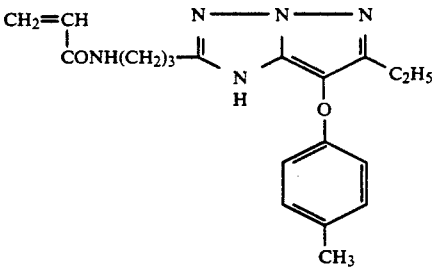
IX-168
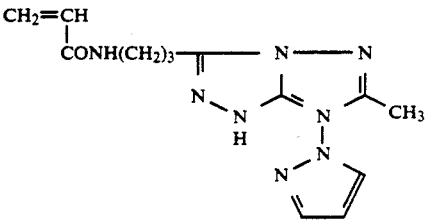
IX-169
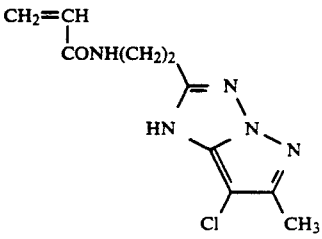

-continued
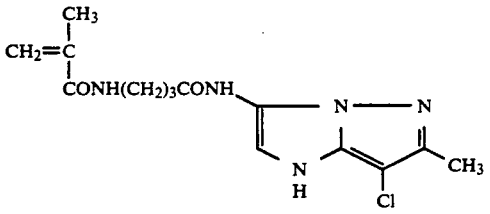
IX-170
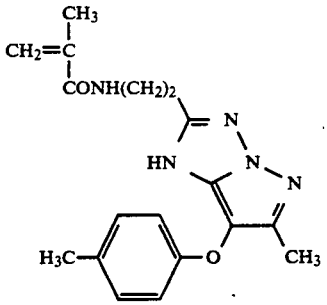
IX-171
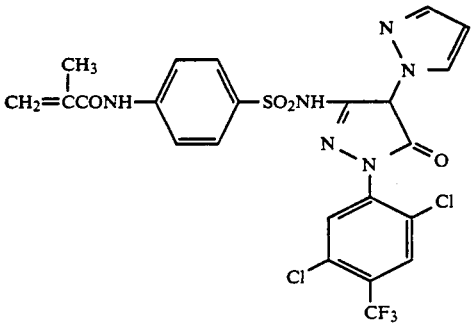
IX-172
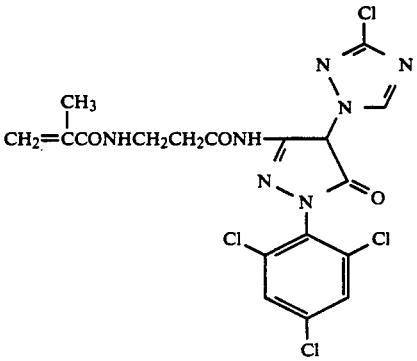
IX-173
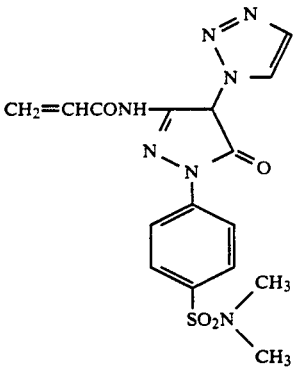
IX-174
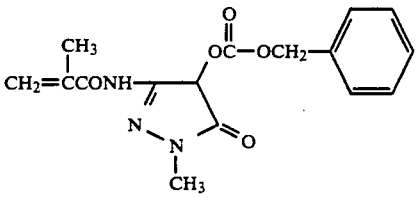
IX-175
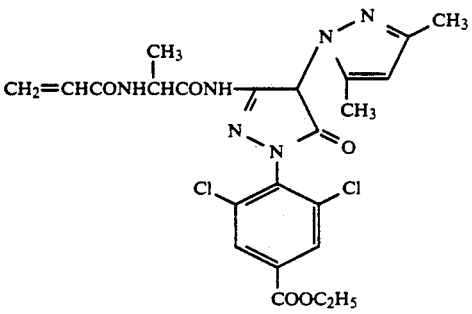
IX-176
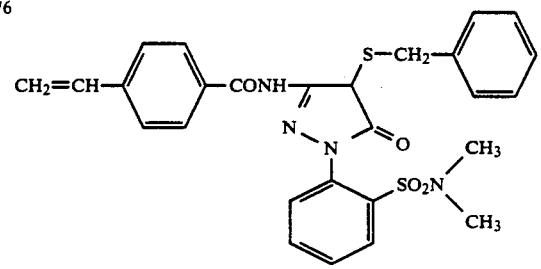
IX-177

-continued
IX-178
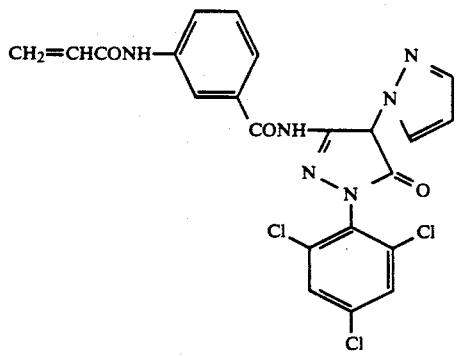
IX-179
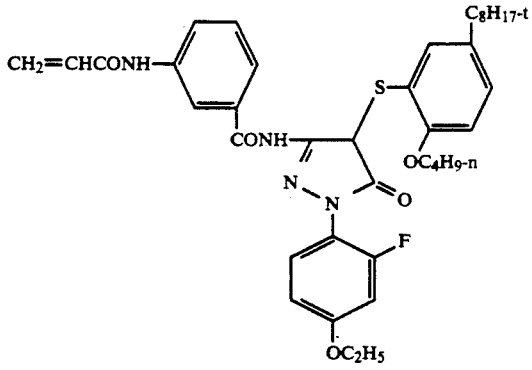
IX-180
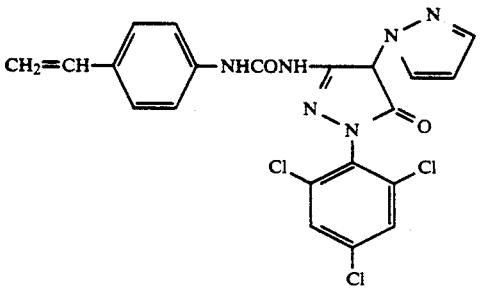
IX-181
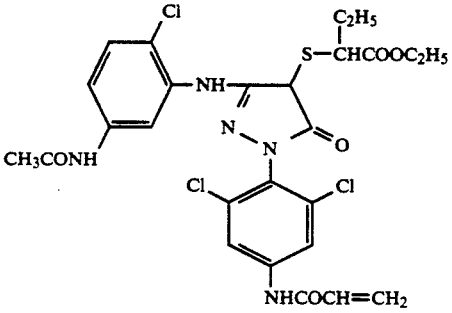
IX-182
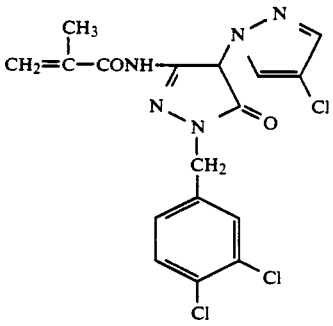
IX-183
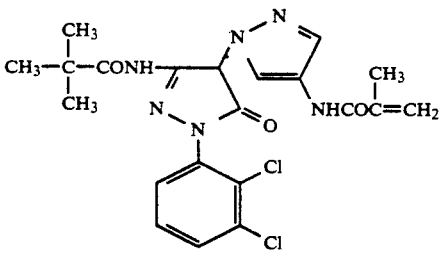
IX-184
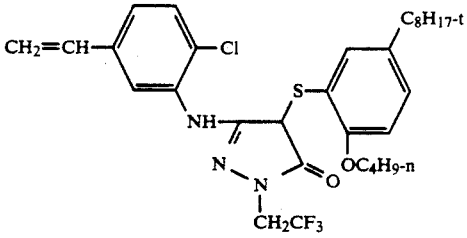
IX-185
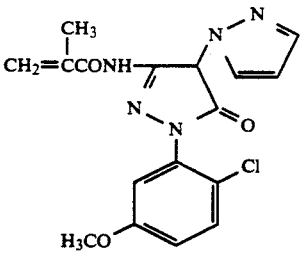
IX-186
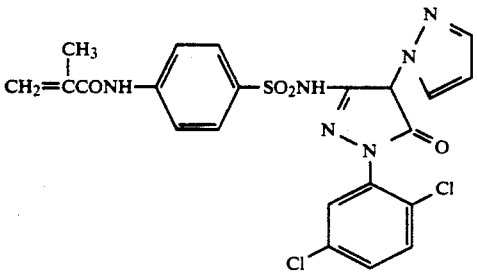
IX-187
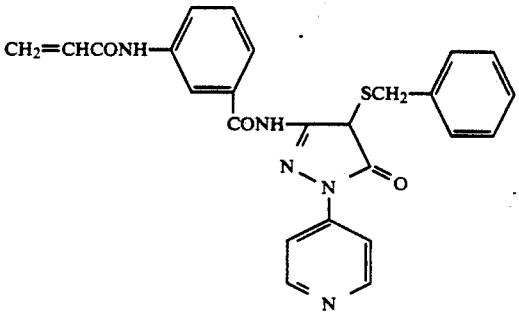

-continued
IX-188
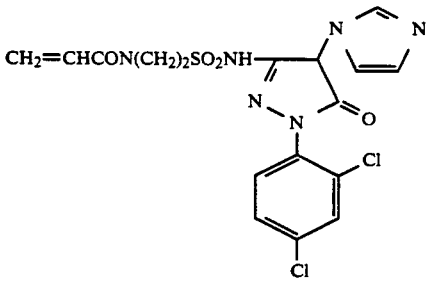
IX-189
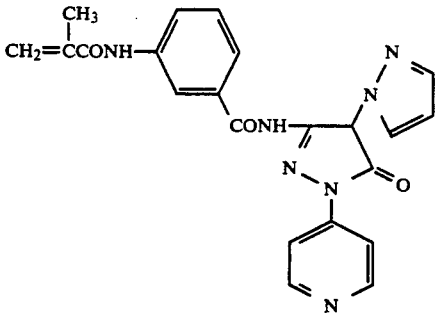
IX-190
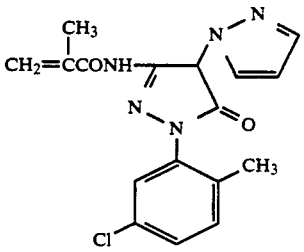
IX-191
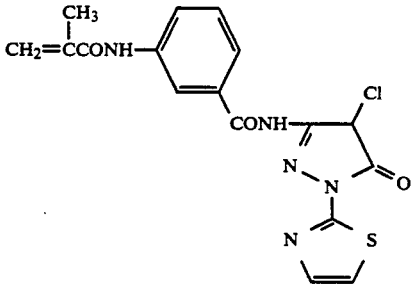
IX-192
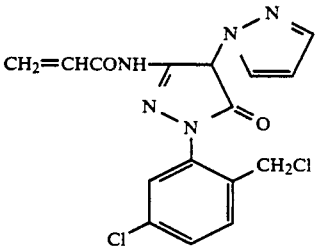
IX-193
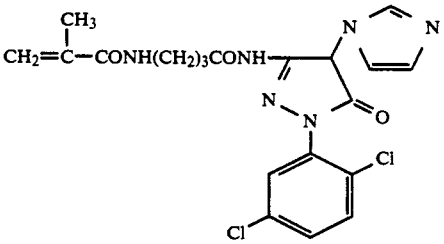
IX-194
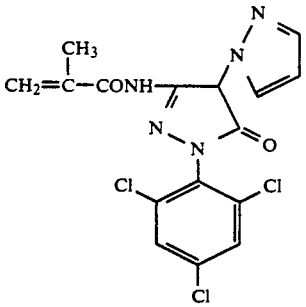
IX-195
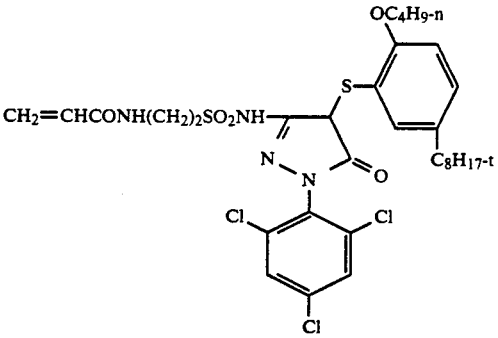
IX-196
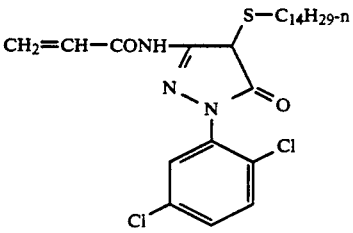
IX-197
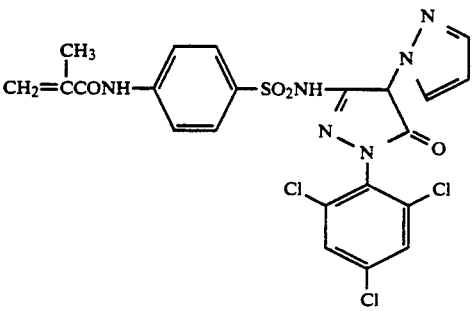

-continued
IX-198
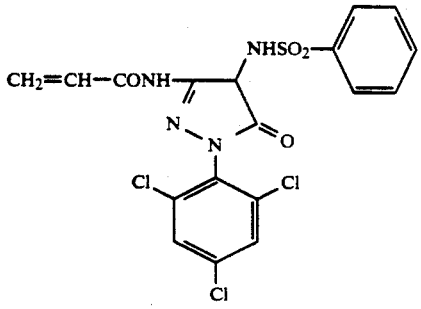
IX-199
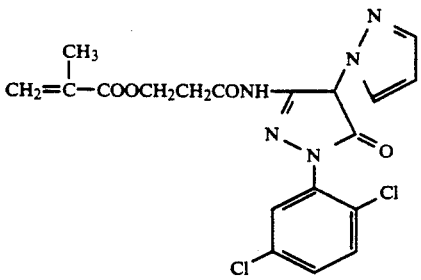
IX-200
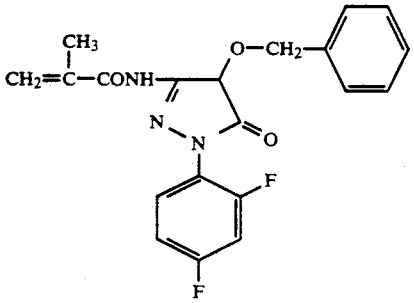
IX-201
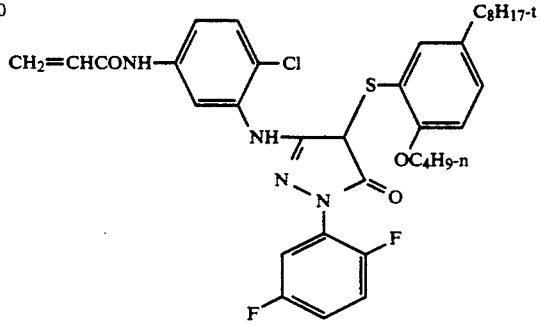
IX-202
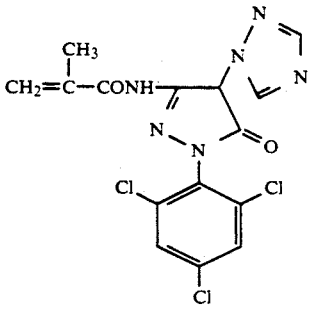
IX-203
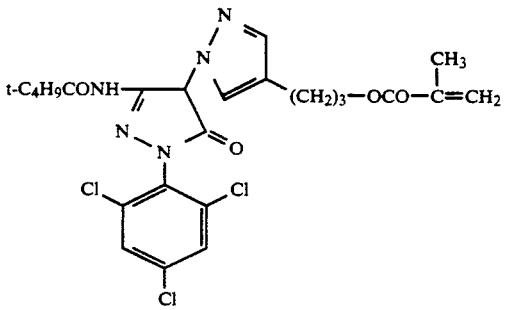
IX-204
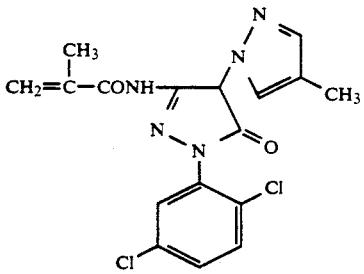
IX-205
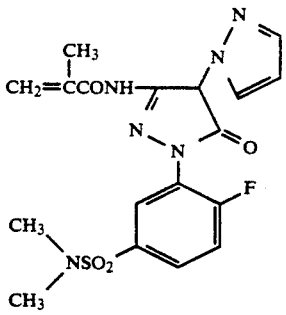
IX-206
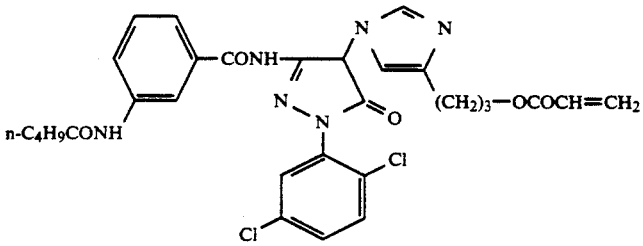

-continued
IX-207
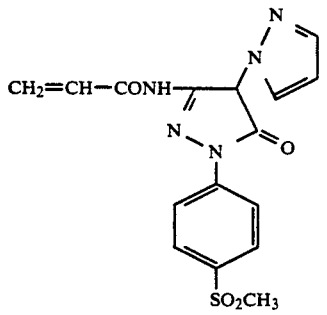
IX-208
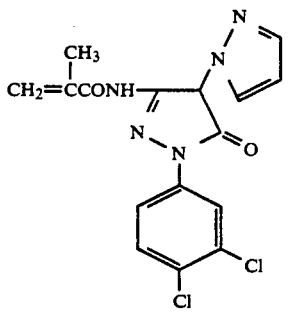
IX-209
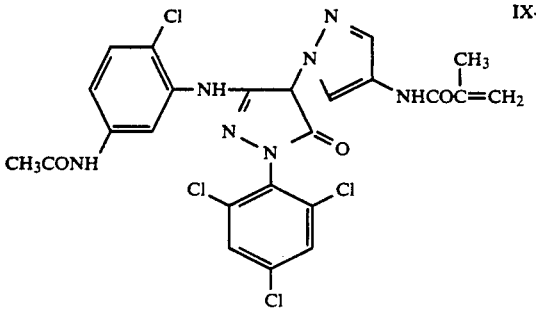
IX-210
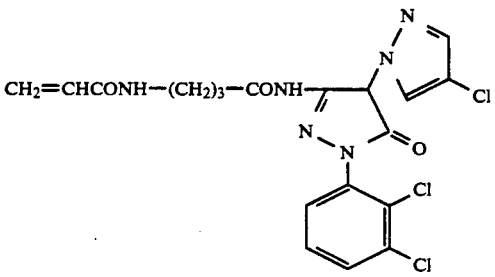
IX-211
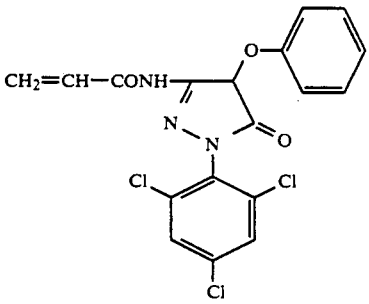
IX-212
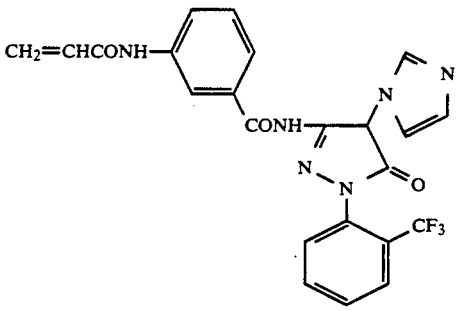
IX-213
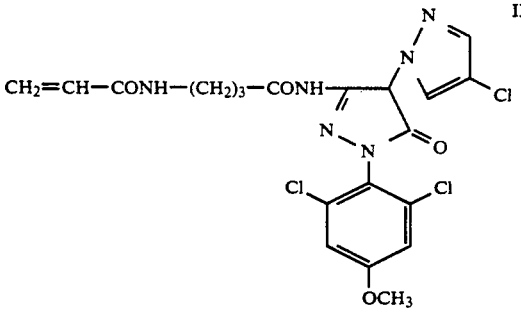
IX-214
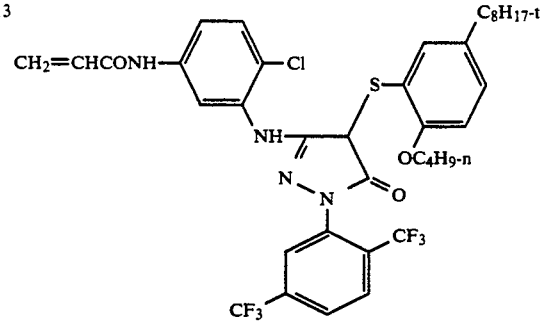
IX-215
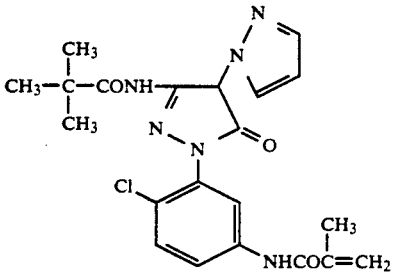
IX-216
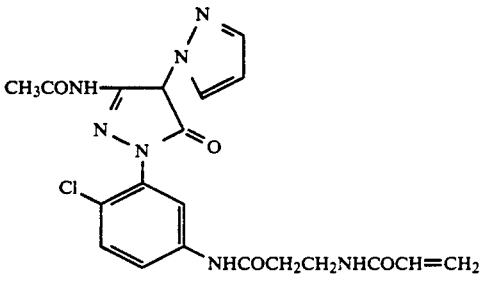

-continued
IX-217
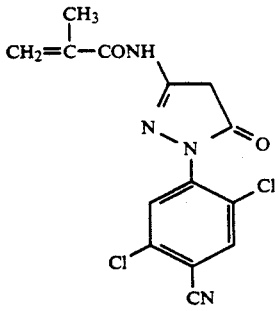
IX-218
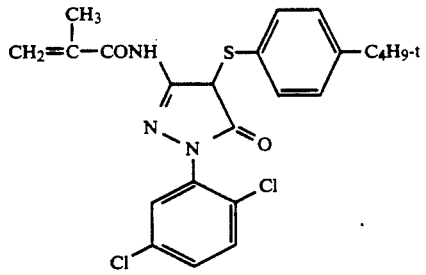
IX-219
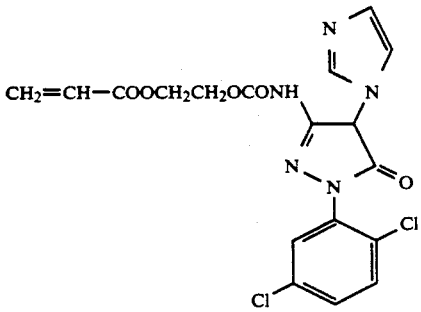
IX-220
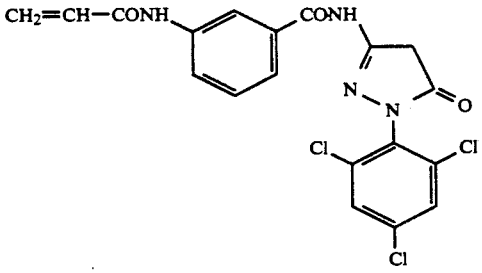
IX-221
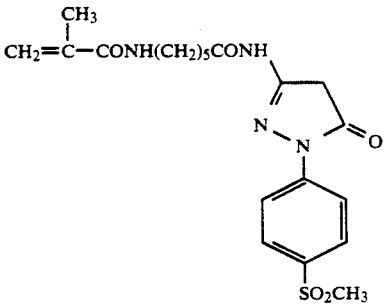
IX-222
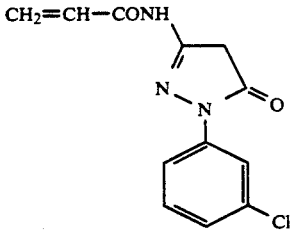
IX-223
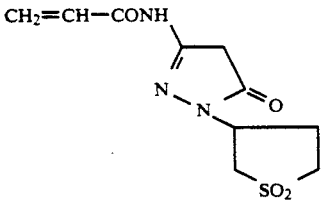
IX-224
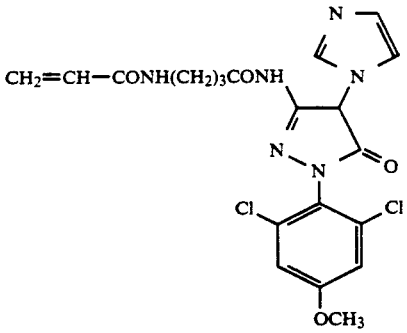
IX-225
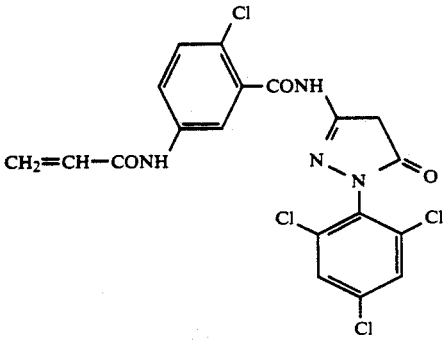
IX-226
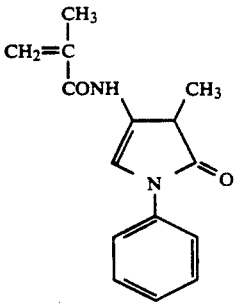

-continued
IX-227
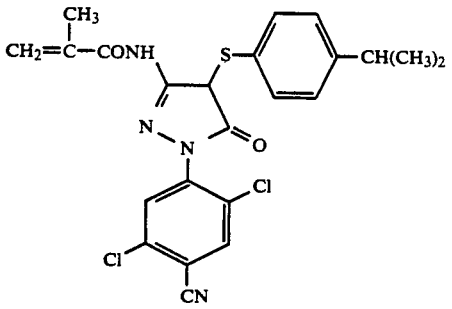
IX-228
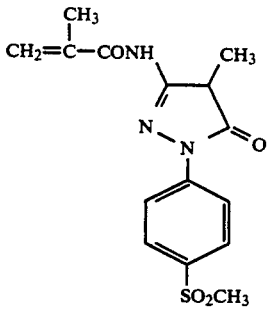
IX-229
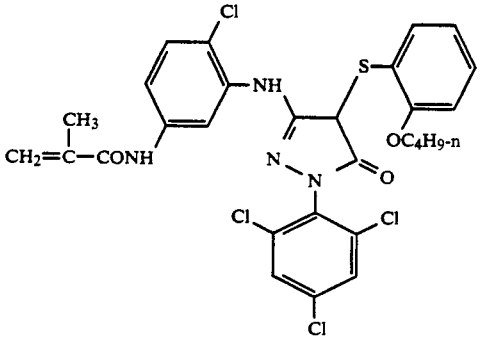
IX-230
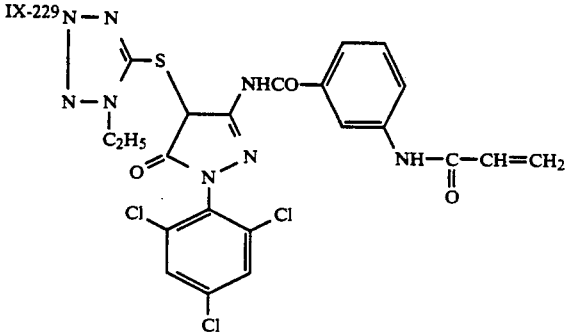
IX-231
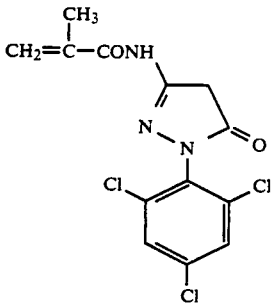
IX-232
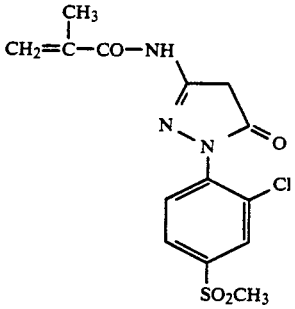
IX-233
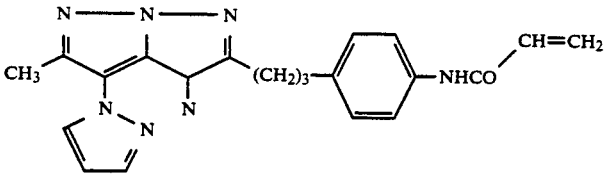
IX-234
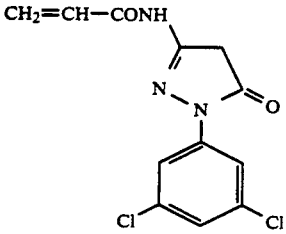
IX-235
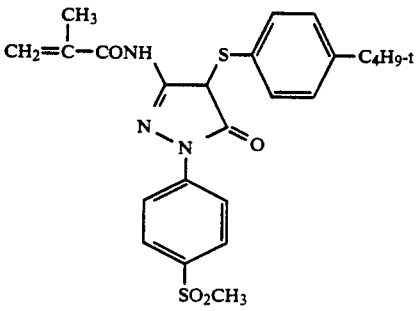

-continued
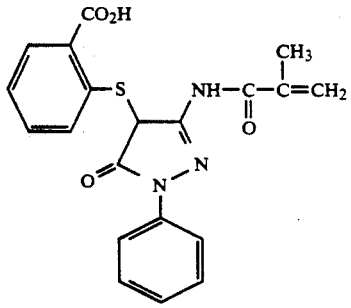
IX-236
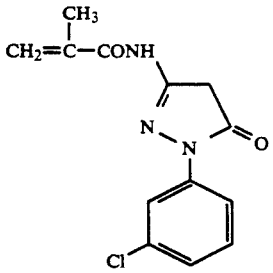
IX-237
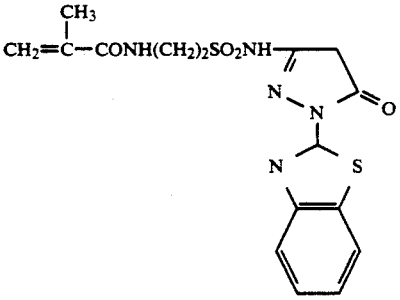
IX-238
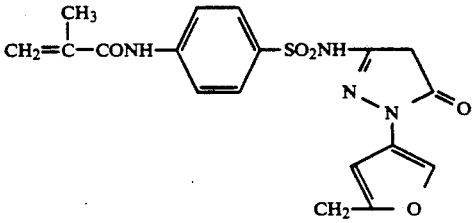
IX-239
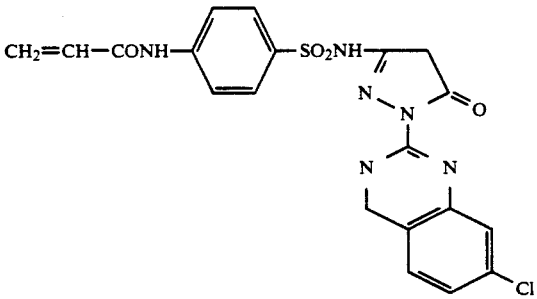
IX-240
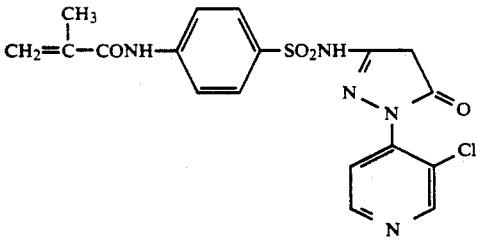
IX-241
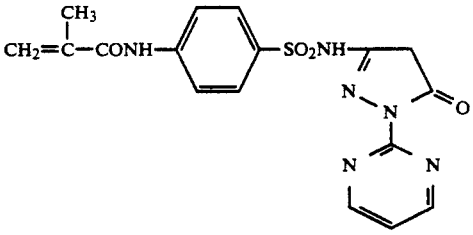
IX-242
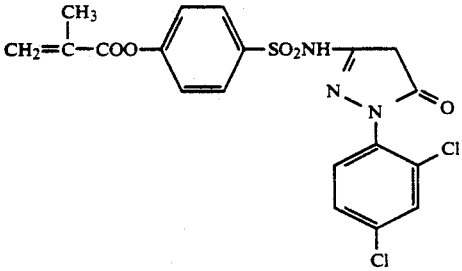
IX-243
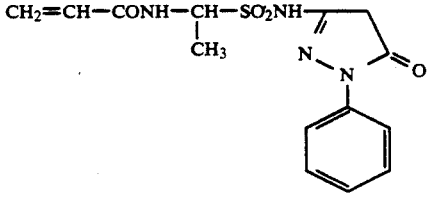
IX-244

-continued
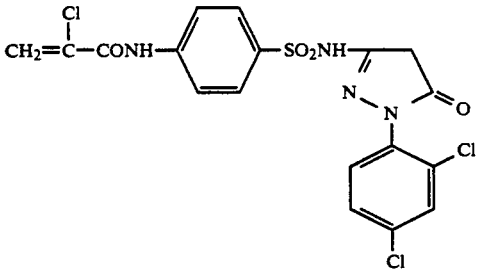
IX-245
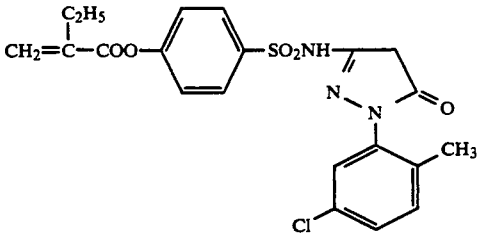
IX-246
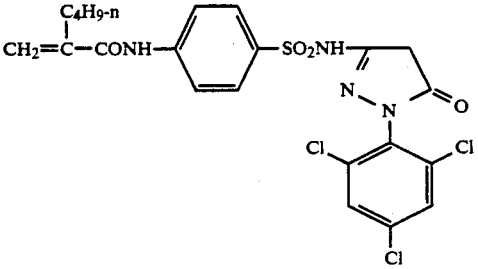
IX-247
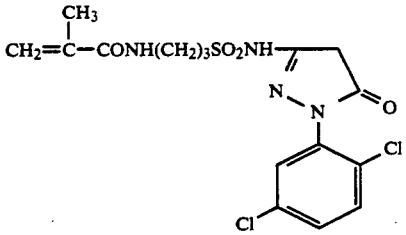
IX-248
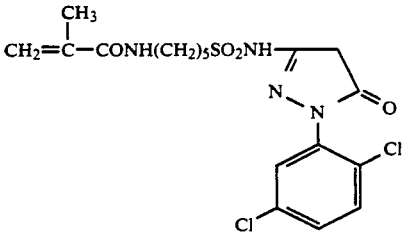
IX-249
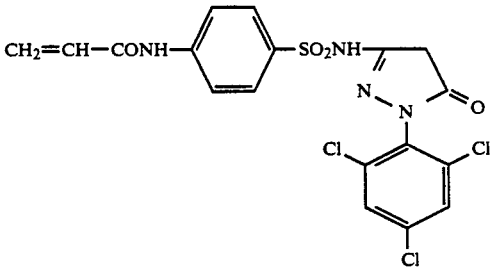
IX-250
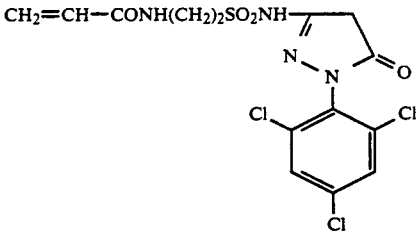
IX-251
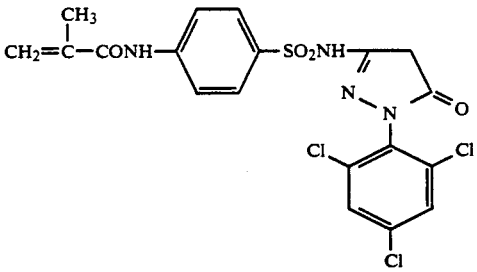
IX-252
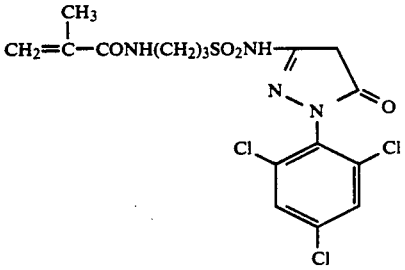
IX-253
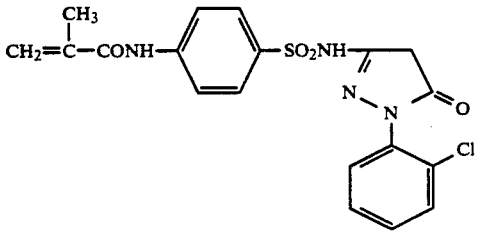
IX-254

-continued
IX-255
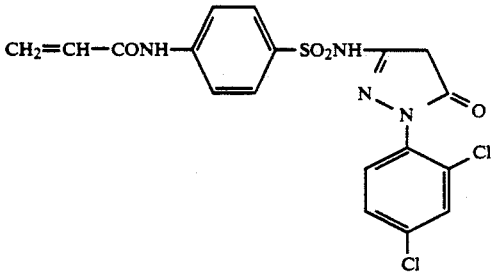
IX-256
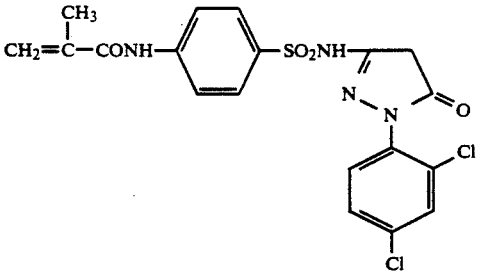
IX-257
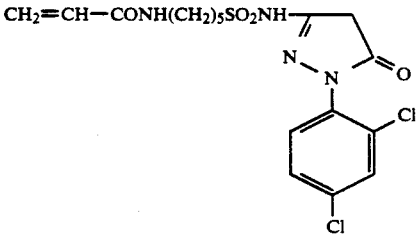
IX-258
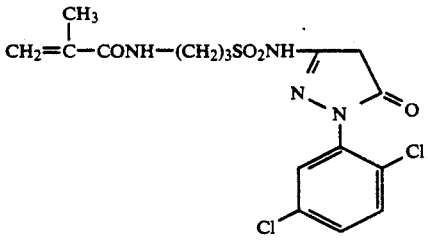
IX-259
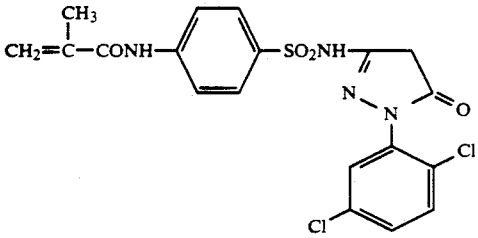
IX-260
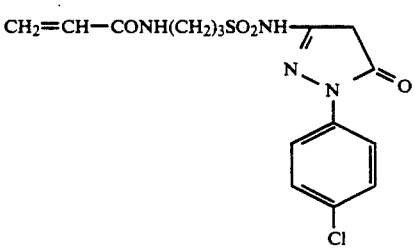
IX-261
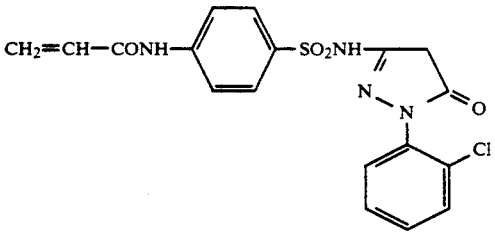
IX-262
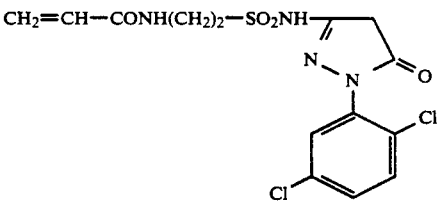
IX-263
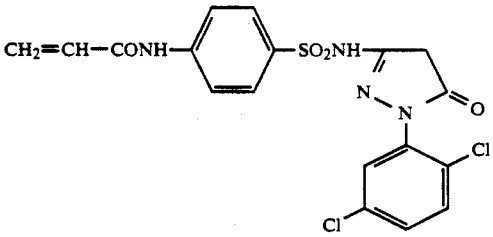
IX-264
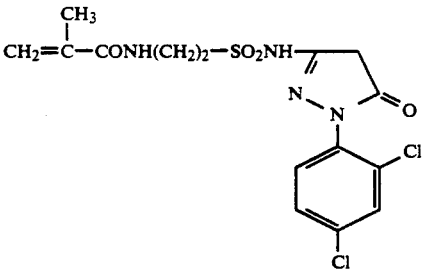
IX-265
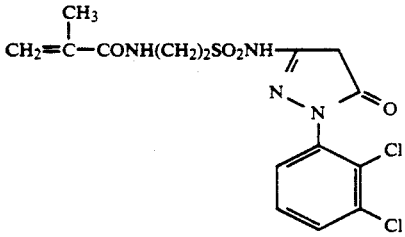
IX-266
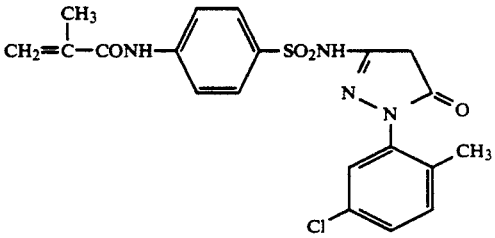

-continued
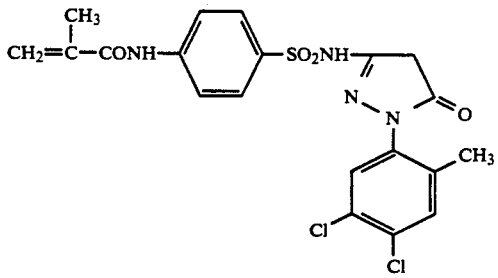
IX-267
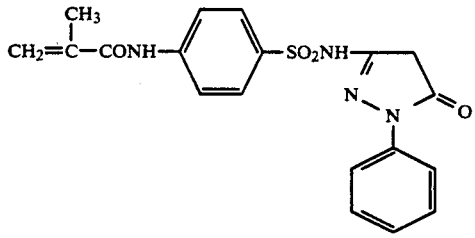
IX-268
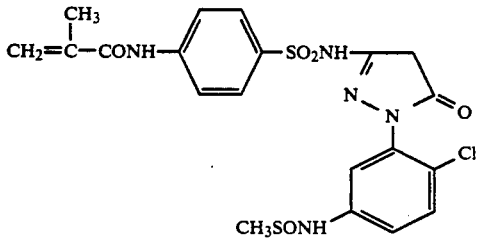
IX-269
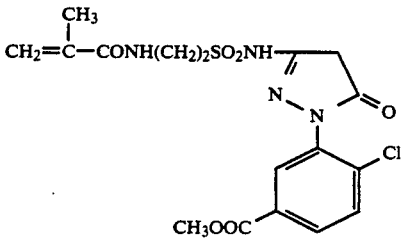
IX-270
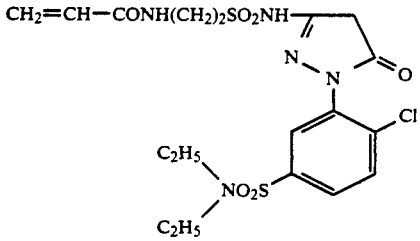
IX-271
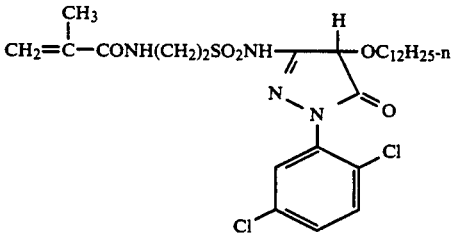
IX-272
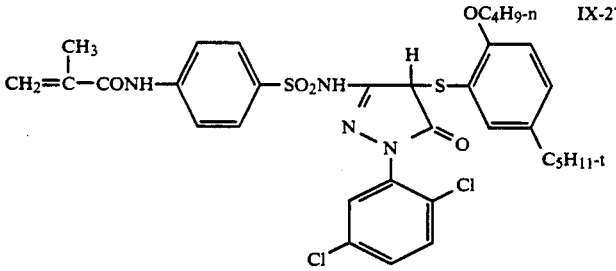
IX-273
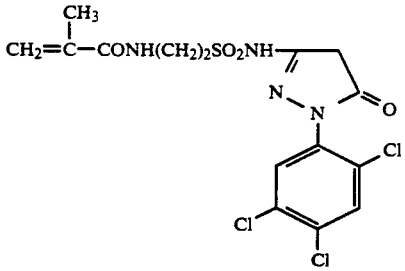
IX-274
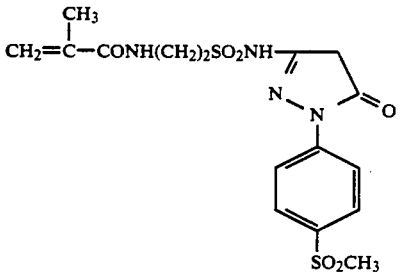
IX-275
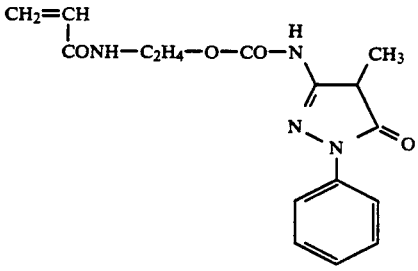
IX-276

-continued
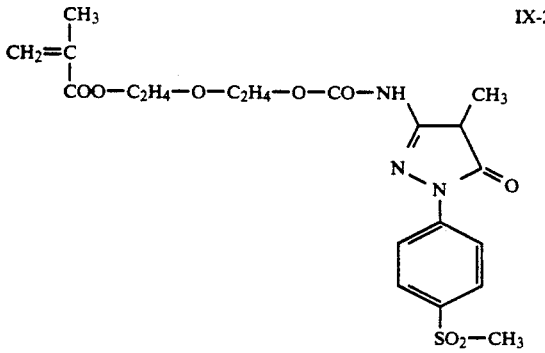
IX-277
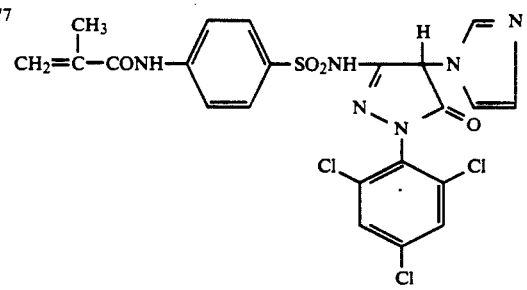
IX-278
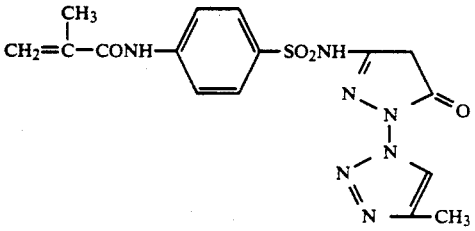
IX-279
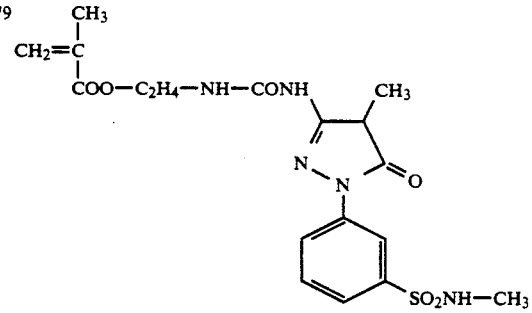
IX-280
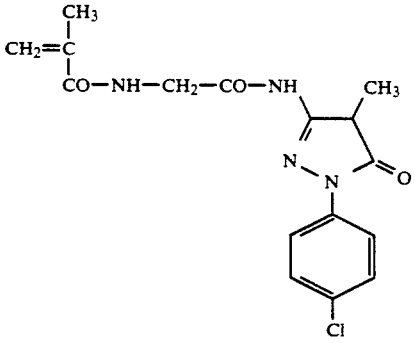
IX-281
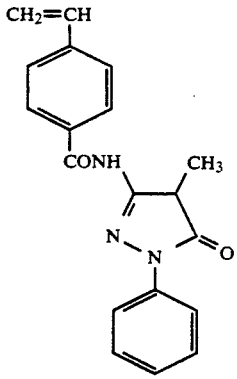
IX-282
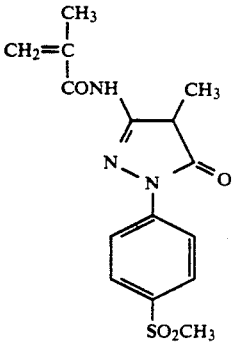
IX-283
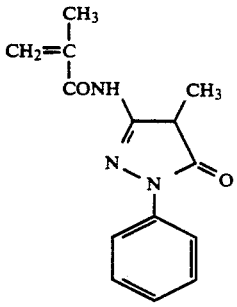
IX-284

-continued
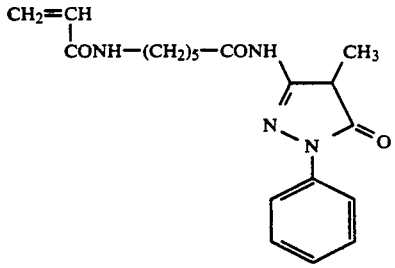
IX-285
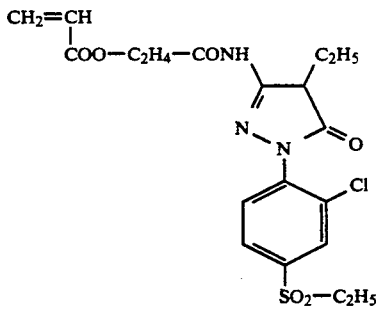
IX-286
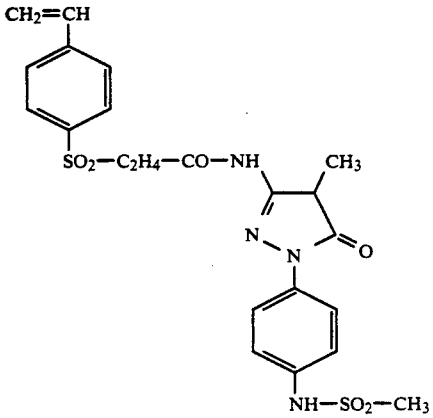
IX-287
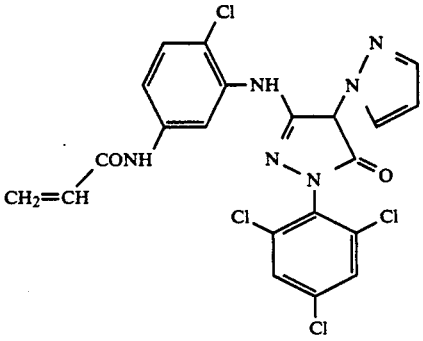
IX-288
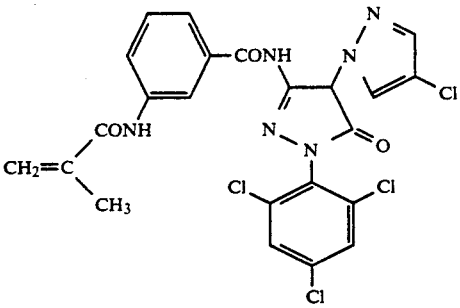
IX-289
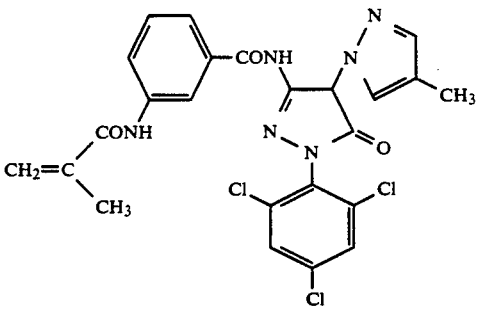
IX-290
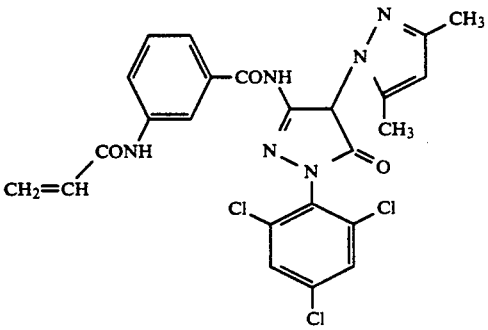
IX-291
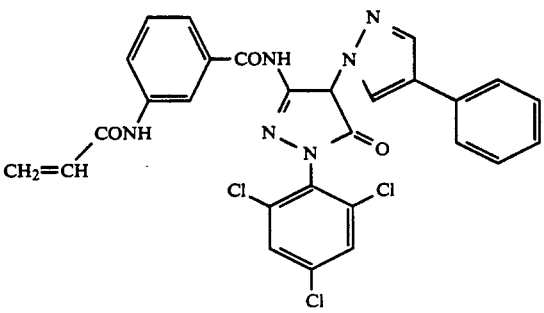
IX-292

-continued
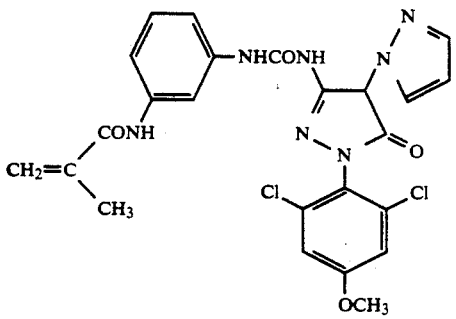
IX-293
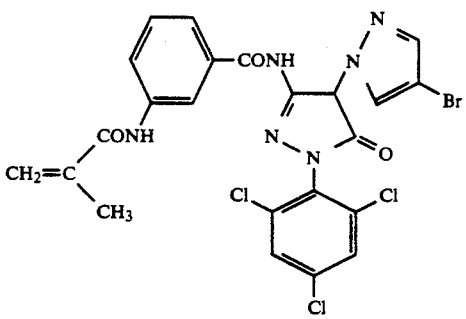
IX-294
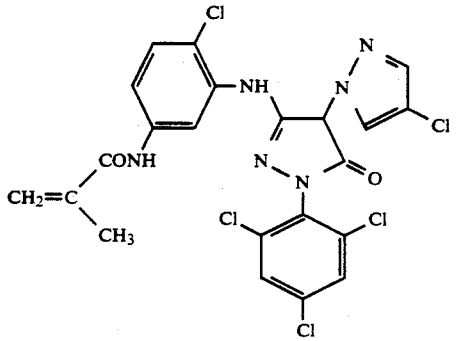
IX-295
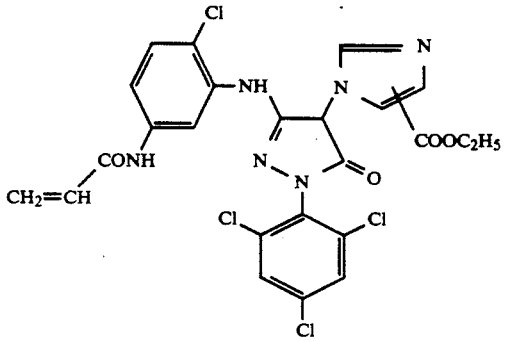
IX-296
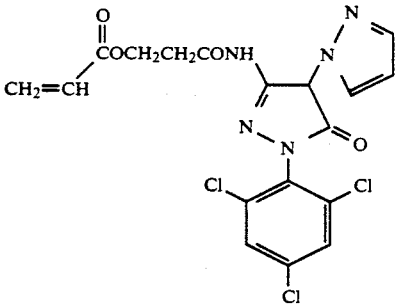
IX-297
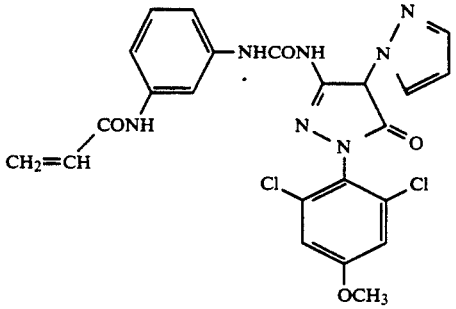
IX-298
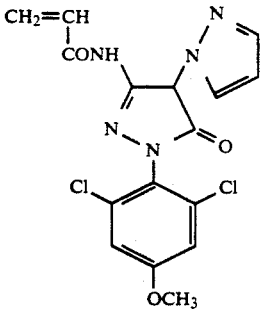
IX-299
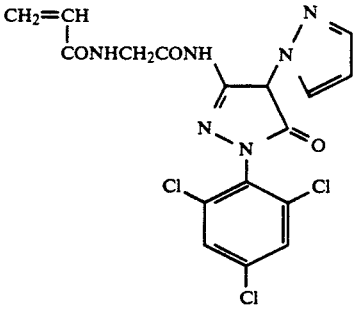
IX-300
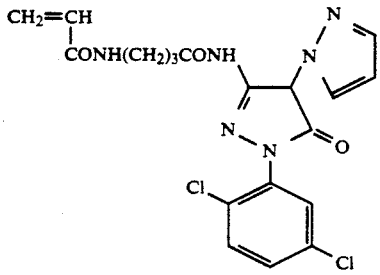
IX-301
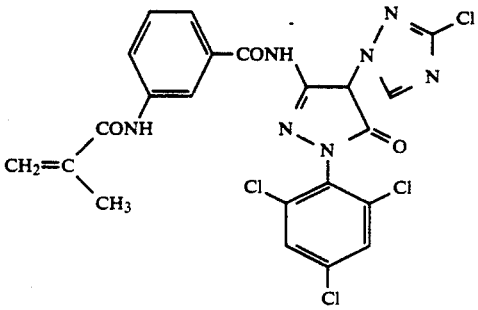
IX-302

-continued
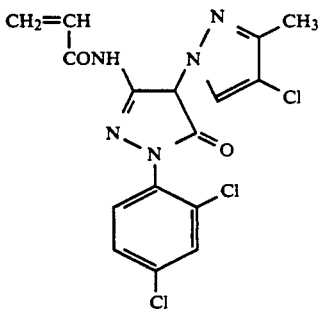
IX-303
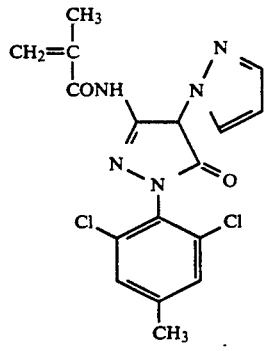
IX-304
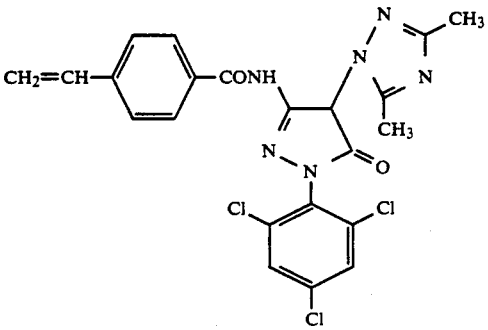
IX-305
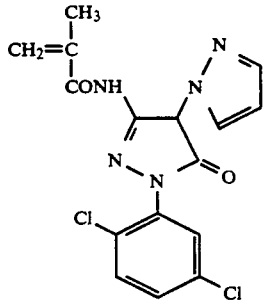
IX-306
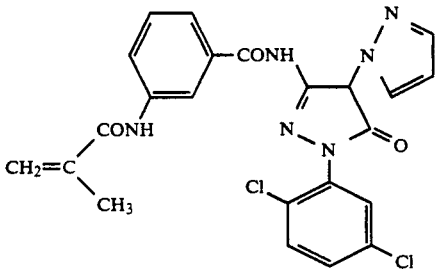
IX-307
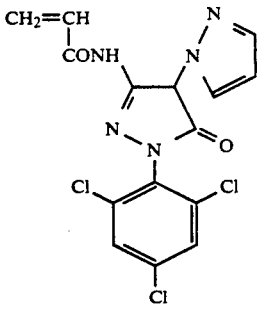
IX-308
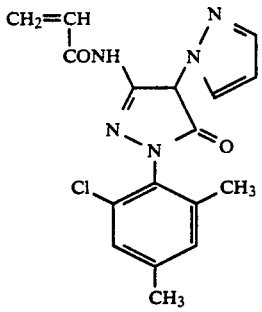
IX-309
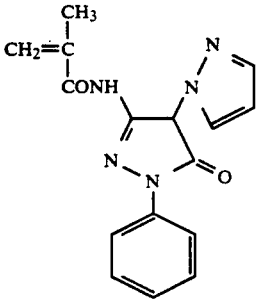
IX-310
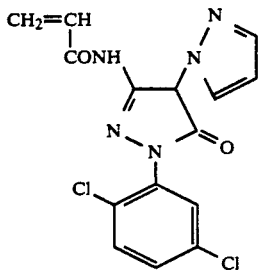
IX-311

-continued
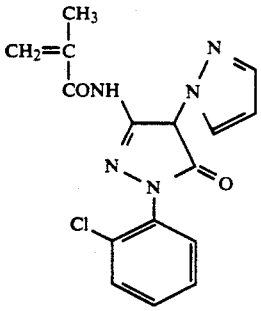
IX-312
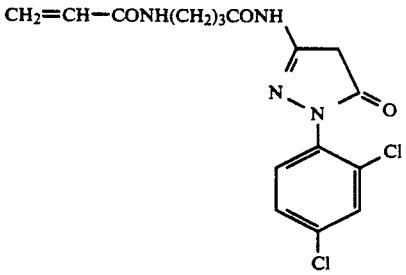
IX-313
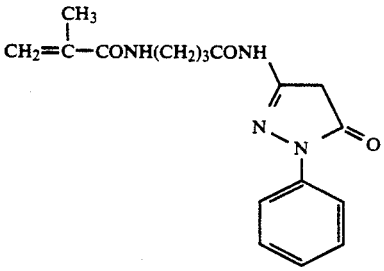
IX-314
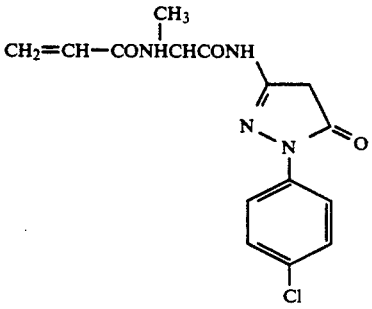
IX-315
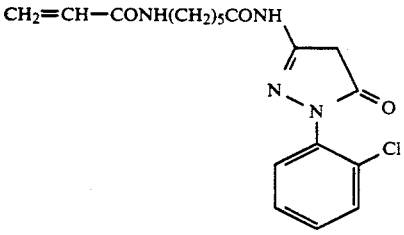
IX-316
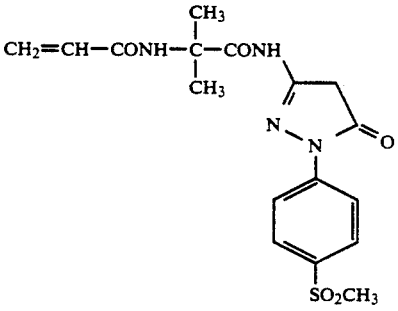
IX-317
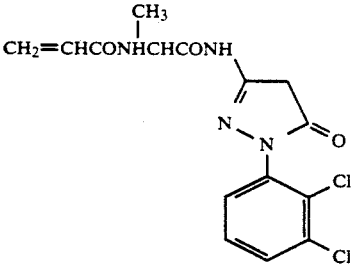
IX-318
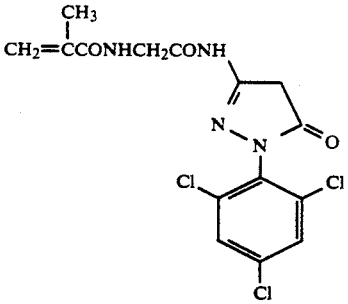
IX-319
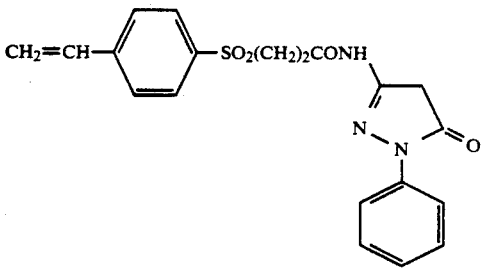
IX-320
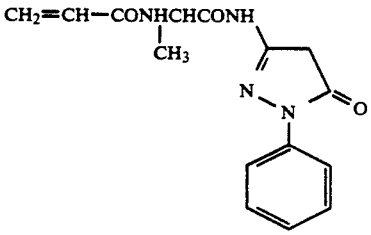
IX-321

-continued
IX-322
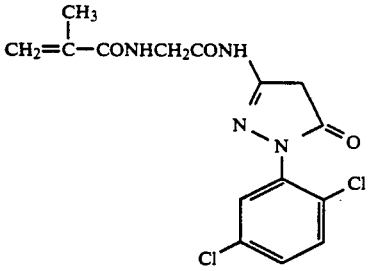
IX-323
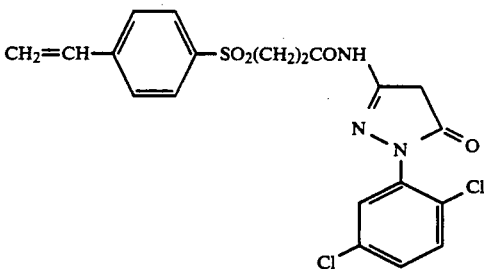
IX-324
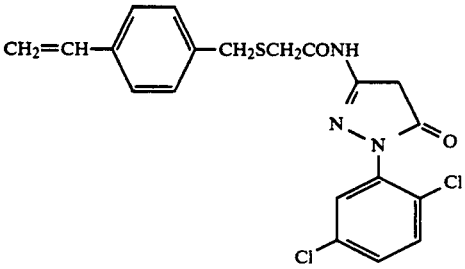
IX-325
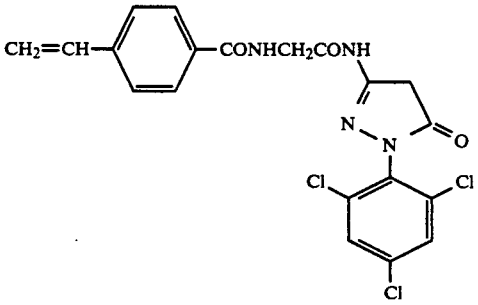
IX-326
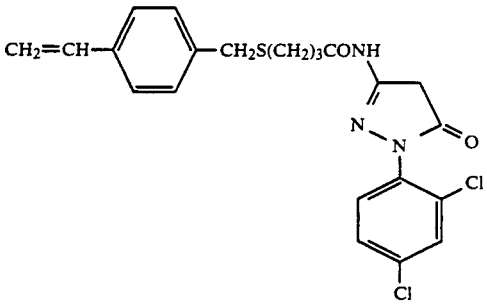
IX-327
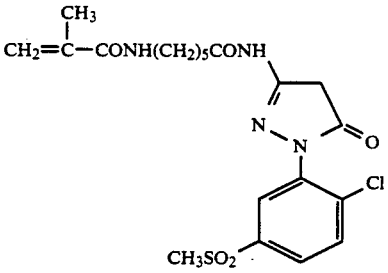
IX-328
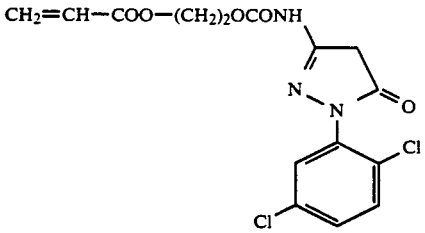
IX-329
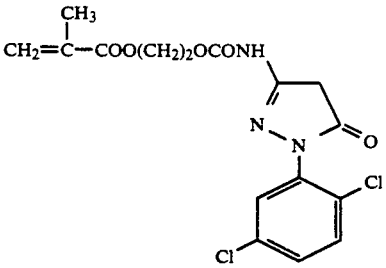
IX-330
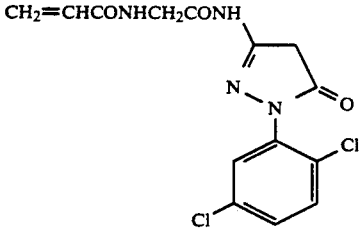
IX-331
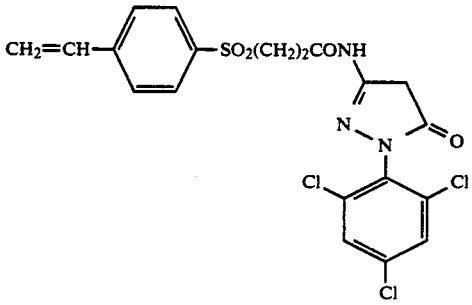

-continued

IX-332

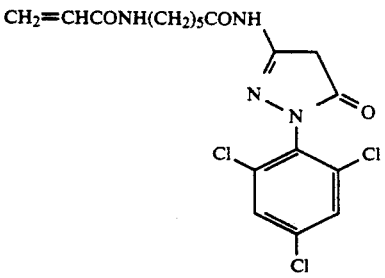

IX-333

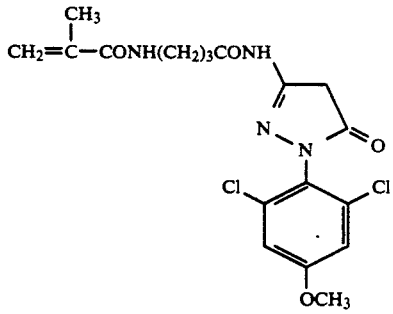

IX-334

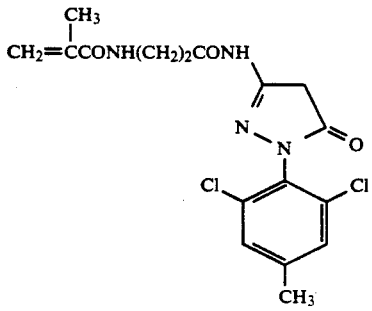

Q may represent a coupler group, capable of forming a yellow dye by coupling with an aromatic primary amine developing agent. Preferred yellow coupling groups are of the acylacetanilide-type (formula Y-1) and benzoylacetanilide-type (formulae Y-2 and Y-3):

Y-1

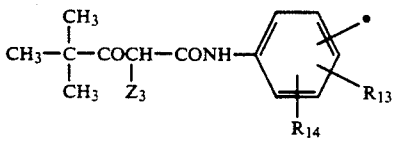

Y-2

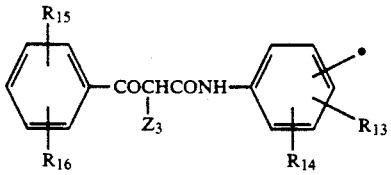

Y-3

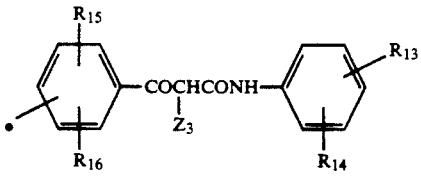

$R_{13}$, $R_{14}$, $R_{15}$, and $R_{16}$ each independently represents a hydrogen atom or a substituent which is conventional and well known in a yellow coupler group, for example, an alkyl group, an alkenyl group, an alkoxy group, an alkoxycarbonyl group, a halogen atom, an alkoxycarbamoyl group, an aliphatic amido group, an alkylsulfamoyl group, an alkylsulfonamido group, an alkylureido group, an alkyl-substituted succinimido group, an aryloxy group, an aryloxycarbonyl group, an arylcarbamoyl group, an arylamido group, an arylsulfamoyl group, an arylsulfonamido group, an arylureido group, carboxyl group, sulfo group, nitro group, cyano group, or thiocyano group.

$Z_3$ represents hydrogen atom or —$OR_{17}$ (in which $R_{17}$ represents an aryl group, a substituted aryl group or a heterocyclic group), or represents

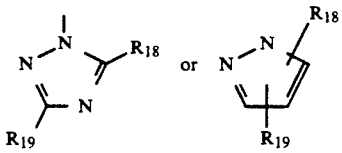

wherein $R_{18}$ and $R_{19}$ each independently represents a hydrogen atom, a halogen atom, a carboxylic acid ester residue, an amino group, an alkyl group, an alkylthio group, an alkoxy group, an alkylsulfonyl group, an alkylsulfamoyl group, a carboxylic acid group, a sulfonic acid group, a substituted or unsubstituted phenyl group, or a heterocyclic ring, or represents

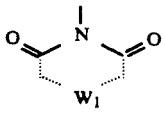

wherein $W_1$ is an atomic group necessary for forming a 4 to 7 membered ring together with:

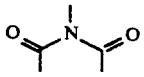

Particularly preferred among the foregoing are

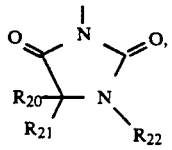

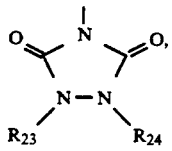

and

-continued

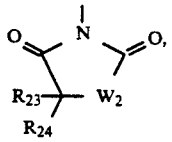

wherein $R_{20}$, $R_{21}$, and $R_{22}$ each independently represents a hydrogen atom, an alkyl group, an aryl group, an arylalkyl group, or an acyl group; $W_2$ represents an oxygen atom or a sulfur atom; $R_{23}$ and $R_{24}$ each independently represents a hydrogen atom, an alkyl group, an aryl group, an alkoxy group, an aryloxy group, or hydroxy group.

Preferred examples of photographically useful components that are yellow coupler groups are illustrated in Table X:

TABLE X

X-1

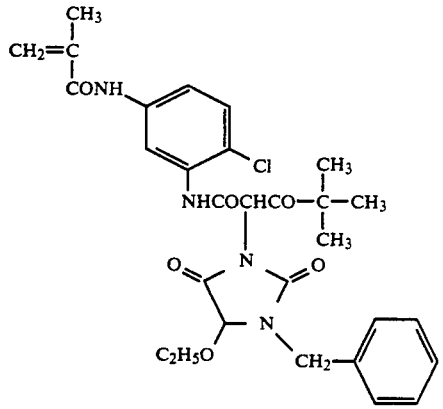

X-2

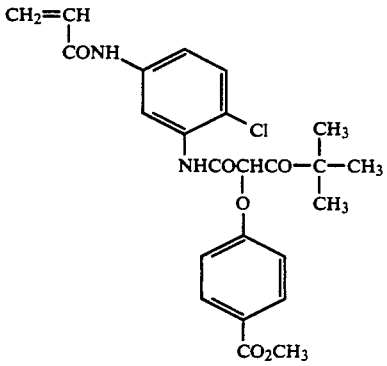

X-3

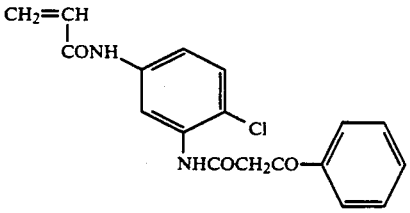

X-4

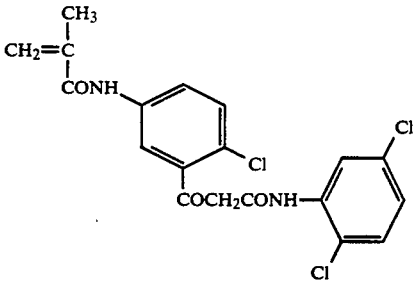

X-5

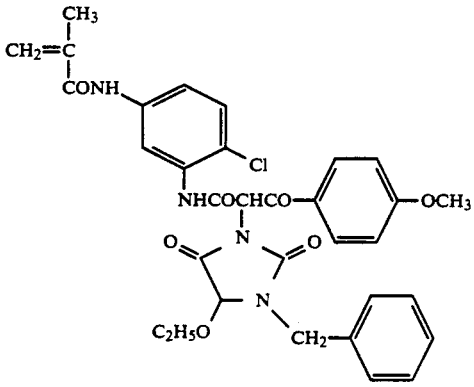

X-6

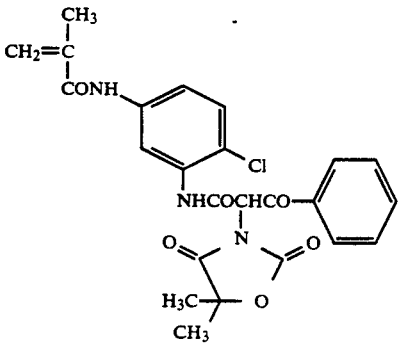

TABLE X-continued
X-7
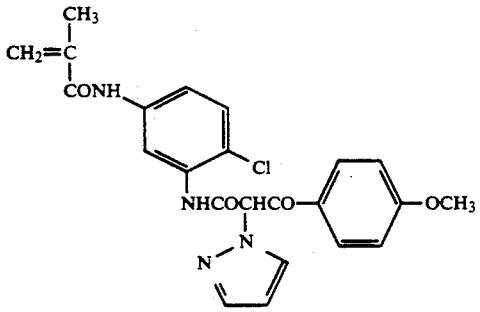
X-8
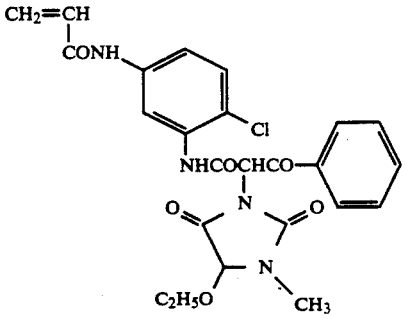
X-9
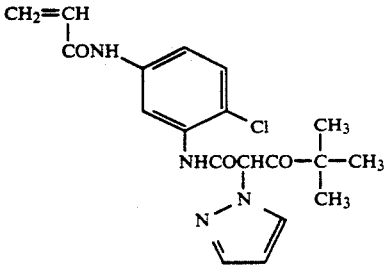
X-10
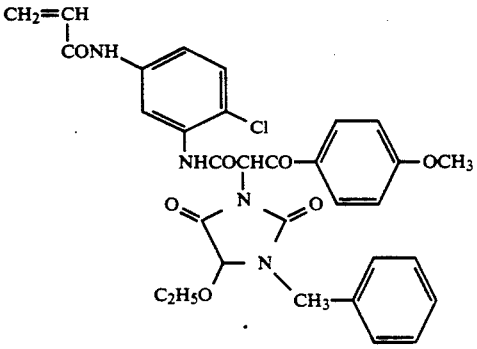
X-11
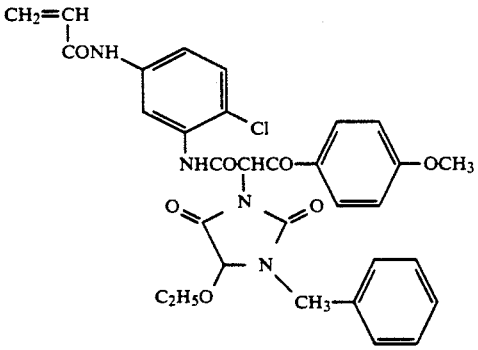
X-12
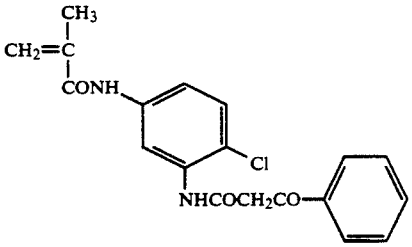
X-13
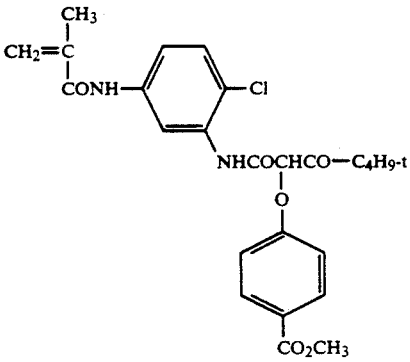
X-14
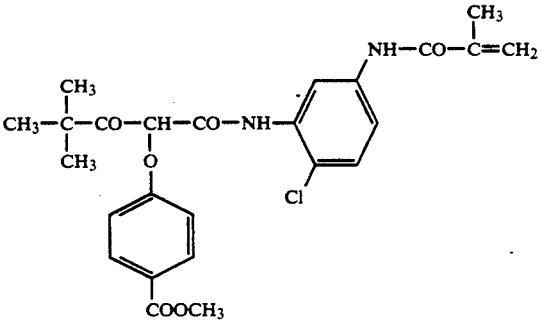

TABLE X-continued
X-15
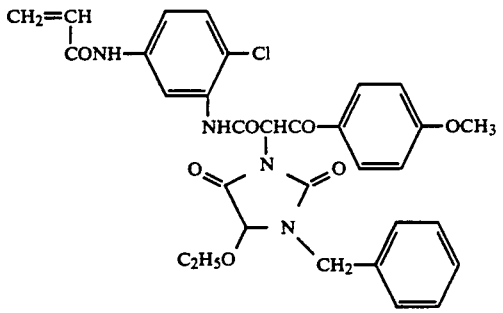
X-16
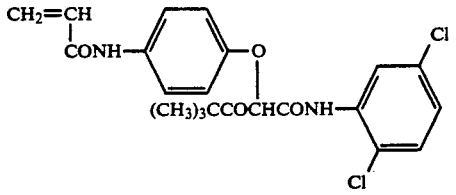
X-17
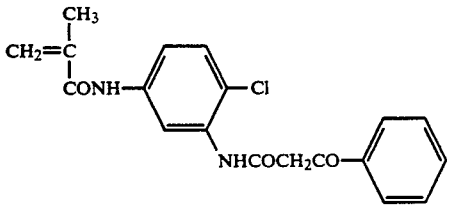
X-18
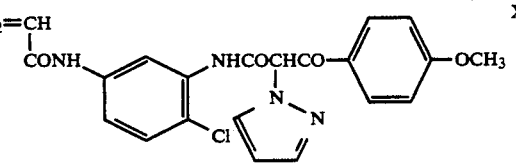
X-19
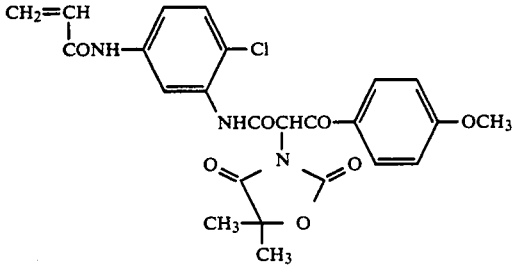
X-20
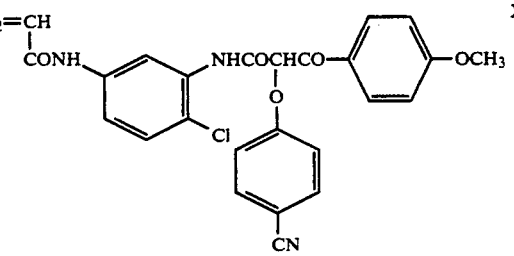
X-21
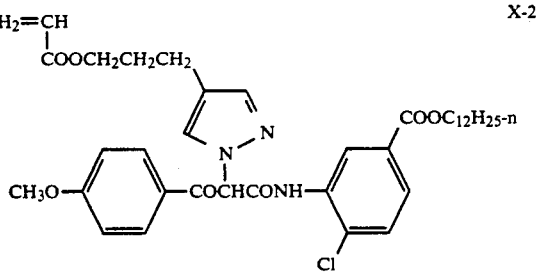
X-22
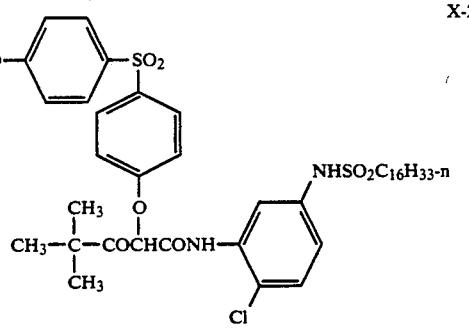
X-23
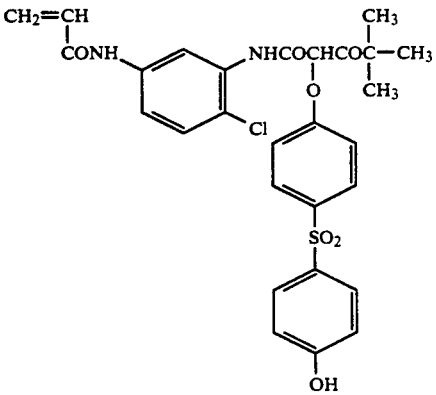
X-24
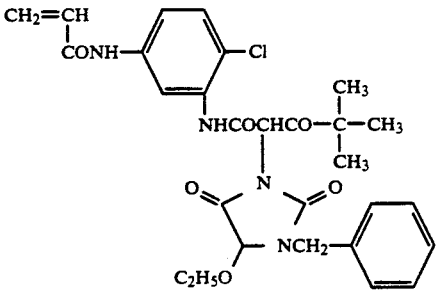

TABLE X-continued
X-25
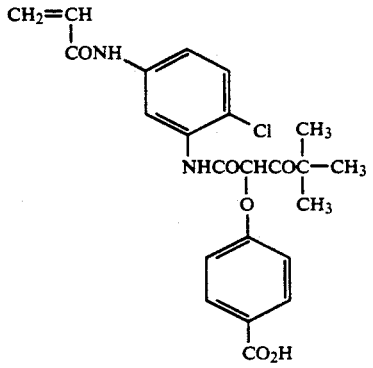
X-26
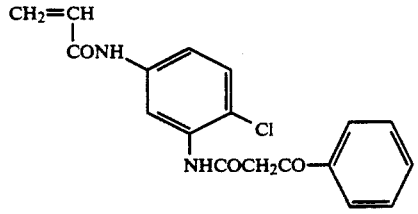
X-27
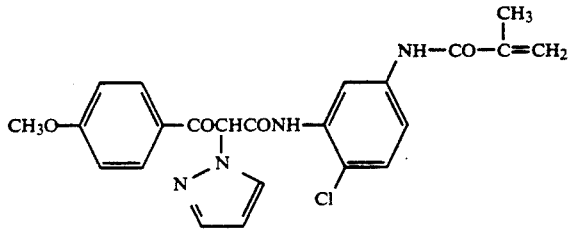
X-28
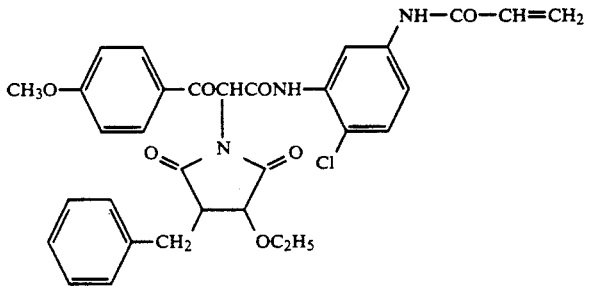
X-29
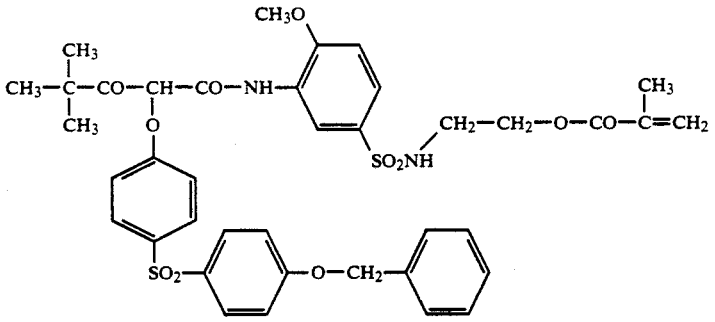
X-30
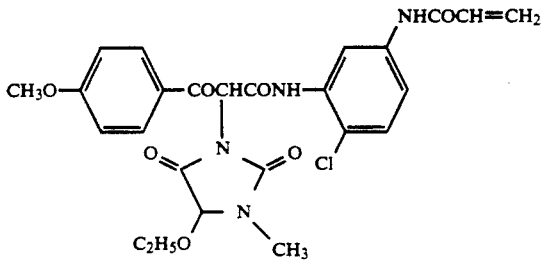

TABLE X-continued
X-31
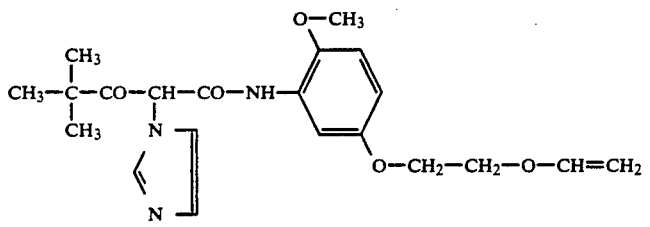
X-32
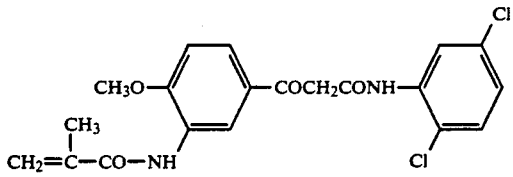
X-33
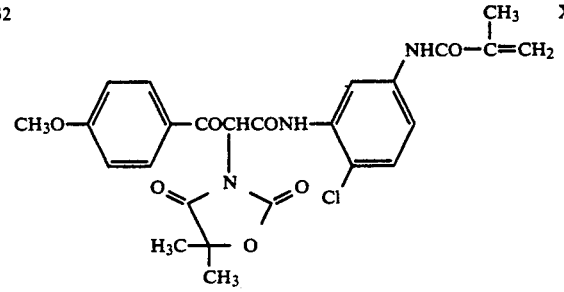
X-34
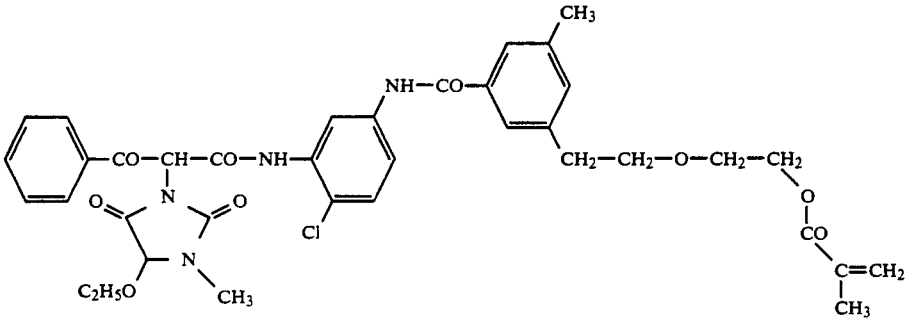
X-35
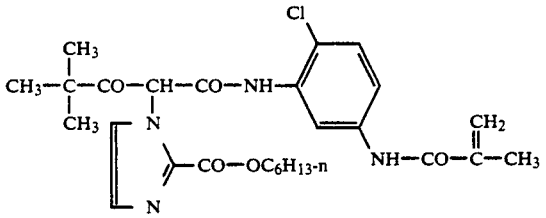
X-36
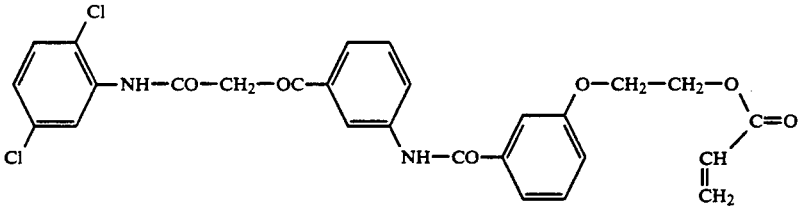
X-37
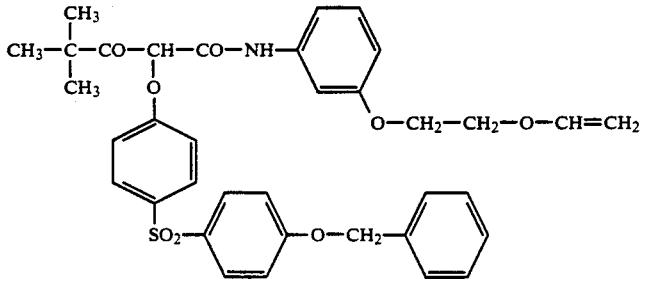

TABLE X-continued
X-38
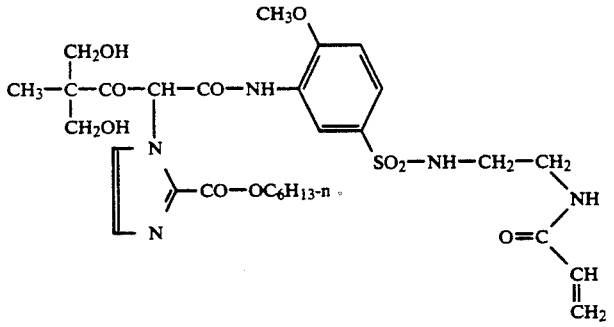
X-39
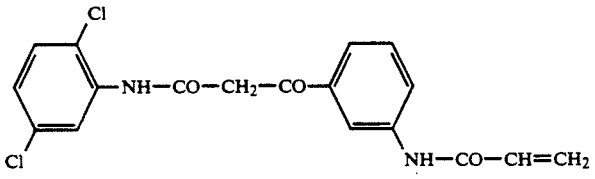
X-40
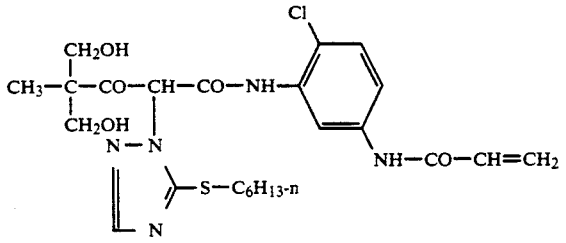
X-41
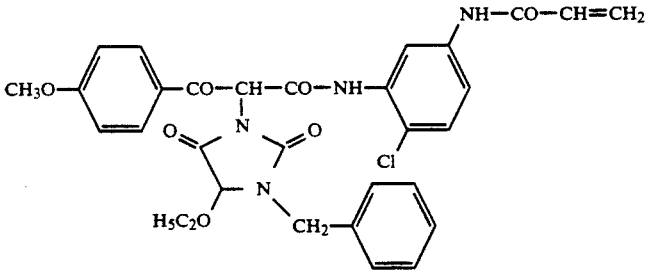
X-42
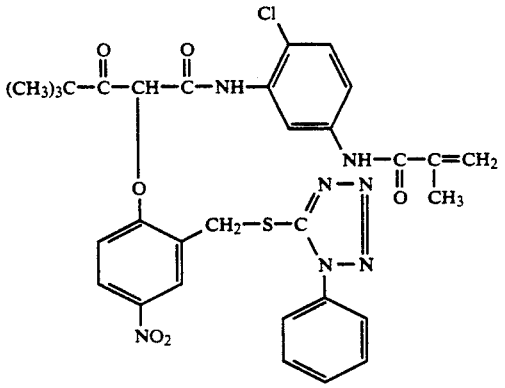

TABLE X-continued

X-43

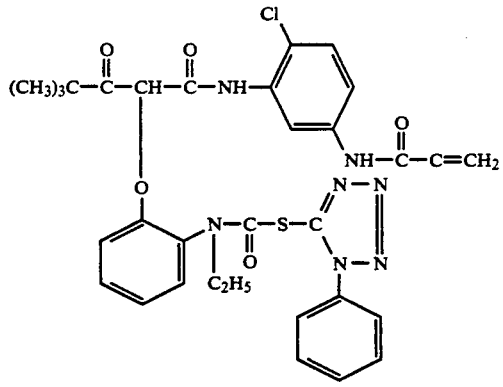

Polymerizable surface active agents and co-surfactants are preferred for many applications of microemulsion polymerization. Such materials generally fall within the structural definition given by formula (I) above. A listing of preferred examples is given below in Table PS. This list is not meant to limit the scope of polymerizable surface active agents or polymerizable co-surfactants which fall within the scope of this invention.

TABLE PS

PS-1

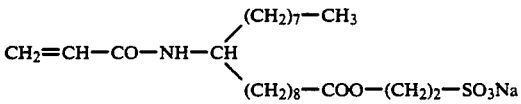

PS-2

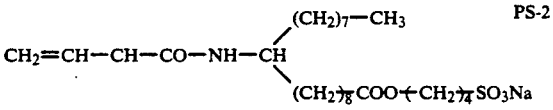

PS-3

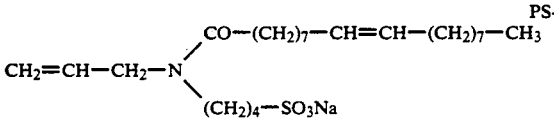

PS-4

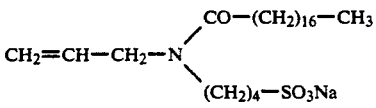

PS-5

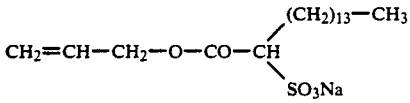

PS-6

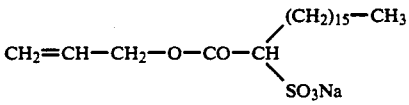

PS-7

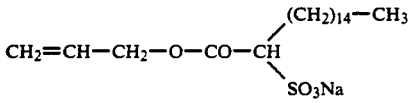

PS-8

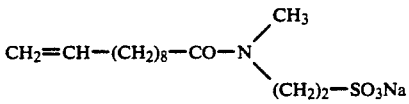

PS-9

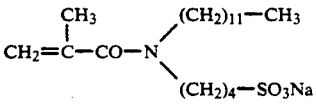

PS-10

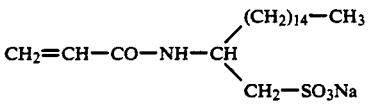

PS-11

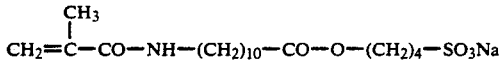

PS-12

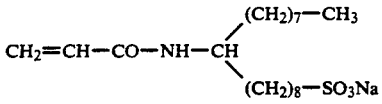

PS-13

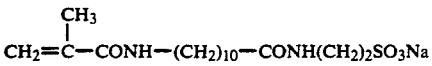

PS-14

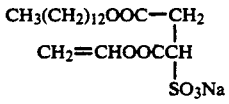

PS-15

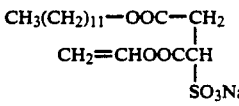

Preferred examples of monomers useful in formulating temporary barrier layers for photographic elements are described in U.S. Pat. Nos. 4,504,569 (see monomers listed on lines 35 to 68 of column 4 and the examples listed on lines 14 to 51 of column 5) and 4,865,946 (see examples listed on lines 23 to 56 of column 3 and examples listed on lines 4 to 41 of column 4). These cited monomers are incorporated herein by reference.

Preferred examples of monomers useful in formulating methacrylate polymeric latexes useful for reducing pressure sensitivity in photographic elements are described in U.S. Pat. No. 5,015,566 (see examples listed in Tables I, II, III, IV, and V beginning in columns 5, 6, 7, 8, and 9, respectively). These cited monomers are incorporated herein by reference.

Preferred examples of monomers useful in formulating polymers useful for accelerating the hardening of gelatin in photographic elements are described in U.S. Pat. Nos. 4,294,921 (see examples described on line 46 of column 3 through line 18 of column 4 and on line 25 of column 4 through line 27 of column 5) and 4,444,926 (see examples described on line 68 of column 3 through line 64 of column 5). These cited monomers are incorporated herein by reference.

Preferred examples of ethenic monomers useful in the preparation of aqueous polymer latexes that may be prepared according to the processes of the present invention are described in U.S. Pat. No. 4,368,258 (see line 18 of column 7 through line 63 of column 10). These cited monomers are incorporated herein by reference.

The following example is illustrative of the invention and is not to be intended as exhaustive of all possibilities.

EXAMPLE

Preparation of UV absorbing monomers, I-47 and I-48

I-47 and I-48, 2-[2-hydroxy-4-(¾-vinyl)benzyloxyphenyl]benzotriazole, were prepared according to the following method. Sodium nitrite (55.2 g) solution in water (100 mL) was added dropwise to a stirred suspension of o-nitroaniline (110.4 g) in 640 mL of concentrated HCl, while keeping the temperature below 0° C. The mixture was stirred for a further 2 h at 0° C., filtered, and added dropwise to a stirred mixture of resorcinol (132 g), concentrated HCl (120 mL), ice (4 kg), and water (10 L). The orange dye was filtered, washed with water, slurried in water (5 L) while sparging with nitrogen. Fresh zinc powder (140 g) was added, followed by NaOH (440 g in water; 1 L total volume), and the mixture was heated on a steam bath for 2 g until the red color was discharged. After the suspension was allowed to settle, the supernatent was poured under nitrogen onto ice (3 kg) and 2M aqueous HCl was poured into the stirred mixture until the product began to precipitate. The crude product was filtered, dried, and recrystallized from ethanol (yield 105 g). This product (80 g) was refluxed with potassium carbonate (24.6 g), sodium iodide (5.3 g), and topanol OC (0.3 g) in butanone (250 mL). Chloromethylstyrene (59.8 g) in butanone (175 mL) was added in 4 portions over 4 h. Potassium carbonate (12.3 g) and sodium iodide (1.8 g) were added before each subsequent addition of chloromethylstyrene. The mixture was further refluxed for 24 h, cooled to room temperature, the inorganic material was filtered off, and the mixture was evaporated to dryness. The product was recrystallized from ethanol (yield 51.5 g). This procedure produced a mixture of the two isomers in the appropriate mole ratio of 1:2 for the I-47 and I-48 isomers, respectively.

Tetrahydrofurfuryl methacrylate (THFM) was obtained from Sartomer (Sartomer 203); preservative was removed by passing the THFM dropwise through a DHR-4 column (Specialty Products, Webster, N.Y.). Aerosol-OT (S-3) was obtained from Fluka. A single-phase microemulsion was formulated by dissolving 0.377 g of the I-47/I-48 mixture in 8.84 g THFM at 60° C.; 0.100 g 2,2'-azobisisobutyronitrile (AIBN) was subsequently dissolved in this solution, immediately prior to formation of the microemulsion. An aqueous solution of Aerosol-OT (131.8 g of 6% (w/w) S-3) at 60° C., in a three-neck 250-mL round-bottomed flask, was sparged for 30 min with water saturated nitrogen. The comonomer solution containing initiator was then added to the reaction flask maintained at 60° C.; the solution turned clear immediately upon stirring. A nitrogen blanket was maintained over the reaction mixture, and the mixture was maintained at 60° C. for 23.5 h. The reaction mixture was analyzed for unreacted THFM by gas chromotography; and a conversion of 90% based on THFM was determined. The turbid concentrate was washed with distilled water in an AMICON membrane filtration system to remove excess S-3 (72 turnovers). The washed suspension of latex was determined to be 3.0% (w/w) solids. This suspension was diluted with distilled water (0.70 g suspension plus 56.83 g water), and this diluted suspension was examined by ultraviolet spectrophotometry (Cary 17D, Varian Analytical Instruments). The resulting optical absorption band is illustrated in FIG. 1. The wavelength of maximum absorption is approximately 340 nm. A 1-cm pathlength cell was used to contain the sample in the spectrophotometer, and a similar cell containing water was placed in the reference beam of the spectrophotometer.

Figure 2:
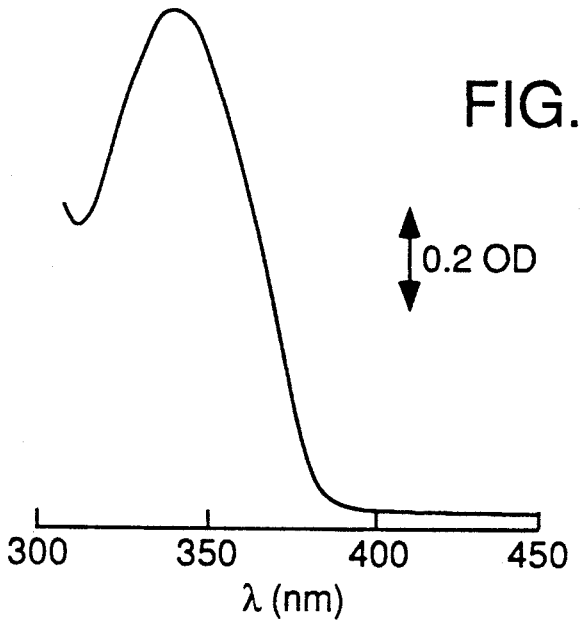
FIG. 2: Ultraviolet absorption spectrum of a coating of the ultraviolet-absorber-modified latex prepared according to this invention as described in the Example. The ordinate is optical absorbance, and the scale bar indicates 0.2 optical density units. The abscissa is wavelength in nanometers.

A coating of this copolymerized latex suspension was prepared by combining 5.8 g of the washed latex suspension, 0.58 g gelatin (50% water by weight), 0.1 g S-5 (10% w/w aqueous 10 G), and 0.48 g hardener solution (1.8% aqueous 1,1'-[methylenebis(sulfonyl)]bis-ethene). A coating of this melt at 40° C. at a total solids coverage of 700 mg/ft$^2$ was made onto 2-mil ESTAR (transparent support). An ultraviolet absorption spectrum (obtained with the instrumentation described above) of this coating is illustrated in FIG. 2; uncoated film support was placed in the reference beam of the spectrophotometer. The wavelength of maximum absorption is approximately 340 nm.

The invention has been described in detail with particular reference to preferred embodiments thereof, but it will be understood that variations and modification can be effected within the spirit and scope of the invention.

What is claimed is:

1. A free radical microemulsion polymerization process for the formation of a polymer or a copolymer of photographically useful components which comprises the steps of:

(a) forming an isotropic microemulsion, with droplet diameters predominantly in the range of 30 to 900 Å, by mixing surfactant, water, and at least one ethenic monomer according to structure (I)

$$CH_2{=}C(X)Y \qquad (I)$$

where

X is selected from the group consisting of hydrogen, methyl, ethyl, propyl, butyl, fluorine, chlorine, bromine, iodine;

Y is selected from the group consisting of ultraviolet (UV) absorbers and visible filter dyes, optical brighteners, oxidized developer scavangers, couplers, couplers that release photographically useful groups upon coupling with oxidized developer including development inhibitor releasing couplers, development inhibitor anchimerically releasing couplers, bleach accelerator releasing couplers, developer releasing couplers, reducing agent releasing couplers of any type, electron transfer agent releasing couplers, silver halide solvent releasing couplers, silver halide developers, sensitizing dyes for silver halides, photographically useful groups as described above that are attached to the polymer through timing switches of any sort, so as to release UV absorber dyes, visible filter dyes, reducing agents and electron transfer agents of any sort, silver halide solvents, bleach accelerators, development accelerators, couplers or other color image precursors, antifoggants, silver salt stabilizers, image stabilizers, materials to control radiation sensitivity;

(b) deaerating the microemulsion by passage of an inert gas therethrough or using an excess of initiator;

(c) initiating polymerization by addition of free radical initiator or by irradiating with ultraviolet light;

(d) continuing the polymerization reaction for a sufficient time at a sufficient temperature to form said polymer, copolymer, or latex.

2. A free radical microemulsion polymerization process according to claim 1, wherein the microemulsion formed is an oil-in-water microemulsion.

3. A free radical microemulsion polymerization process according to claim 1, wherein the microemulsion formed is a water-in-oil microemulsion.

4. A free radical microemulsion polymerization process according to claim 1, wherein said polymerization reaction forms a latex dispersion.

5. A free radical microemulsion polymerization process according to claim 1, wherein said polymer is recovered from said reaction mixture.

6. A process as described in claim 1, wherein the polymer formed is incorporated in a photographic element.

7. A process as described in claim 6, wherein said photographic element contains radiation sensitive silver halide.

8. A process as described in claim 1, wherein said radical initiator is substantially soluble in water.

9. A process as described in claim 1, wherein said radical initiator is substantially insoluble in water and substantially soluble in the nonaqueous phase.

10. A process as described in claim 1, further comprising mixing a cosurfactant.

11. A process as described in claim 1, which additionally comprises mixing aqueous electrolyte of any type.

12. A process as described in claim 1, wherein said surfactant is an ethenic monomer.

13. A process as described in claim 10, further comprising a cosurfactant which is an ethenic monomer.

14. A process according to claim 3, wherein said monomers are water soluble.

15. A process for forming a photographic element comprising a free radical microemulsion polymerization process for the formation of a polymer or copolymer of photographically useful components which comprises the steps of:

(a) forming an isotropic microemulsion, with droplet diameters predominantly in the range of 30 to 900 Å, by mixing surfactant, water, and at least one ethenic monomer according to structure (I)

$$CH_2{=}C(X)Y \qquad (I)$$

where

X is selected from the group consisting of hydrogen, methyl, ethyl, propyl, butyl, fluorine, chlorine, bromine, iodine;

Y is selected from the group consisting of photographically useful components and components which yield, upon polymerization, latexes and polymers that are useful in photographic elements;

(b) deaerating the microemulsion by passage of an inert gas there through or using an excess of initiator;

(c) initiating polymerization by addition of free radical initiator or by irradiating with ultraviolet light;

(d) continuing the polymerization reaction for a sufficient time at a sufficient temperature to form said polymer or copolymer;

(e) coating said polymer or copolymer to form a photographic element.

16. A free radical microemulsion polymerization process according to claim 15, wherein the microemulsion formed is an oil-in-water microemulsion.

17. A free radical microemulsion polymerization process according to claim 15, wherein the microemulsion formed is a water-in-oil microemulsion.

18. A free radical microemulsion polymerization process according to claim 15, wherein said polymerization reaction forms a latex dispersion.

19. A free radical microemulsion polymerization process according to claim 15, wherein said polymer is recovered from said reaction mixture.

20. A process as described in claim 15, wherein said photographic element contains radiation sensitive silver halide.

21. A process as described in claim 15, wherein said radical initiator is substantially soluble in water.

22. A process as described in claim 15, wherein said radical initiator is substantially insoluble in water and substantially soluble in the nonaqueous phase.

23. A process as described in claim 15, further comprising mixing a cosurfactant.

24. A process as described in claim 15, which additionally comprises mixing aqueous electrolyte of any type.

25. A process as described in claim 15, wherein said surfactant is an ethenic monomer.

26. A process as described in claim 23, further comprising a cosurfactant which is an ethenic monomer.

27. A process according to claim 17, which comprises monomers which are water soluble.

28. A process as described in claim 15, wherein prior to said coating the polymerized microemulsion suspension is concentrated.

29. A process as described in claim 15, wherein prior to said coating the polymerized microemulsion suspension is washed to remove low molecular weight soluble material.

30. A free radical microemulsion polymerization process for the formation of a polymer or a copolymer of photographically useful components which comprises the steps of:

(a) forming an isotropic microemulsion, with droplet diameters predominantly in the range of 30 to 900

Å, by mixing surfactant, water, and at least one ethenic monomer according to structure (I)

$$CH_2{=}C(X)Y \quad (I)$$

where

X is selected from the group consisting of hydrogen, methyl, ethyl, propyl, butyl, fluorine, chlorine, bromine, iodine;

Y is selected from the group consisting of ultraviolet (UV) absorbers, visible filter dyes, and couplers;

(b) deaerating the microemulsion by passage of an inert gas therethrough or using an excess of initiator;

(c) initiating polymerization by addition of free radical initiator or by irradiating with ultraviolet light;

(d) continuing the polymerization reaction for a sufficient time at a sufficient temperature to form said polymer, copolymer, or latex.

31. A free radical microemulsion polymerization process according to claim 30, wherein the microemulsion formed is an oil-in-water microemulsion.

32. A free radical microemulsion polymerization process according to claim 30, wherein the microemulsion formed is a water-in-oil microemulsion.

33. A free radical microemulsion polymerization process according to claim 30, wherein said polymerization reaction forms a latex dispersion.

34. A free radical microemulsion polymerization process according to claim 30, wherein said polymer is recovered from said reaction mixture.

35. A process as described in claim 30, wherein the polymer formed is incorporated in a photographic element.

36. a process as described in claim 35, wherein said photographic element contains radiation sensitive silver halide.

37. A process as described in claim 30, wherein said radical initiator is substantially soluble in water.

38. A process as described in claim 30, wherein said radical initiator is substantially insoluble in water and substantially soluble in the nonaqueous phase.

39. A process as described in claim 30, further comprising mixing a cosurfactant.

40. A process as described in claim 30, which additionally comprises mixing aqueous electrolyte of any type.

41. A process as described in claim 30, wherein said surfactant is an ethenic monomer.

42. A process as described in claim 39, further comprising a cosurfactant which is an ethenic monomer.

43. A process according to claim 32, wherein said monomers are water soluble.

* * * * *